US012674252B2

(12) United States Patent
Xia et al.

(10) Patent No.: US 12,674,252 B2
(45) Date of Patent: Jul. 7, 2026

(54) SPINNING DEVICE AND METHOD FOR PRODUCING WRAPPED-CORE YARNS

(71) Applicant: WUHAN TEXTILE UNIVERSITY, Wuhan (CN)

(72) Inventors: Zhigang Xia, Wuhan (CN); Ao Xu, Wuhan (CN); Zhishan Xiong, Wuhan (CN); Weilin Xu, Wuhan (CN)

(73) Assignee: WUHAN TEXTILE UNIVERSITY, Wuhan (CN)

( * ) Notice: Subject to any disclaimer, the term of this patent is extended or adjusted under 35 U.S.C. 154(b) by 0 days.

(21) Appl. No.: 19/021,584

(22) Filed: Jan. 15, 2025

(65) Prior Publication Data

US 2025/0154693 A1 May 15, 2025

Related U.S. Application Data

(63) Continuation of application No. PCT/CN2024/089208, filed on Apr. 22, 2024.

(30) Foreign Application Priority Data

Apr. 28, 2023 (CN) ..... 202310477455.1
Apr. 28, 2023 (CN) ..... 202310477634.5
(Continued)

(51) Int. Cl.
*D01H 5/72* (2006.01)
*D01H 1/14* (2006.01)
(Continued)

(52) U.S. Cl.
CPC ..... *D01H 5/72* (2013.01); *D01H 1/14* (2013.01); *D01H 13/04* (2013.01); *D02G 3/367* (2013.01); *D02G 3/38* (2013.01)

(58) Field of Classification Search
CPC ..... D01H 1/14; D01H 5/72; D01H 13/04; D02G 3/367; D02G 3/38
See application file for complete search history.

(56) References Cited

U.S. PATENT DOCUMENTS 6,318,060 B1 * 11/2001 Dinkelmann ..... D01H 1/025 57/328
6,405,519 B1 * 6/2002 Shaikh ..... D02G 3/281 57/328
(Continued)

FOREIGN PATENT DOCUMENTS

CN 203212719 U * 9/2013
CN 103498229 B * 8/2015
(Continued)

OTHER PUBLICATIONS

Translation CN 113943990.*
(Continued)

*Primary Examiner* — Shaun R Hurley
(74) *Attorney, Agent, or Firm* — Hemisphere Law, PLLC

(57) ABSTRACT

Provided are a calculus spinning device and method for producing wrapped-core yarns. The calculus spinning device includes a feeding unit, an auxiliary core-wrapping unit and a yarn winding unit. The feeding unit includes: a staple fiber feeding unit, configured to stretch a roving into a staple fiber strand and feed the staple fiber strand into the auxiliary core-wrapping unit, and a core yarn feeding unit, configured to feed a core yarn into the auxiliary core-wrapping unit. The auxiliary core-wrapping unit includes: an auxiliary core-wrapping assembly; a pressurizing/conveying assembly, configured to provide pressure or power to the auxiliary core-wrapping assembly; a yarn guiding assembly, disposed between the auxiliary core-wrapping assembly and the yarn winding unit; and a wrapping area for wrapping and converging.

14 Claims, 27 Drawing Sheets

(30) Foreign Application Priority Data

| | | |
|---|---|---|
| Apr. 28, 2023 | (CN) | 202310477916.5 |
| Apr. 28, 2023 | (CN) | 202310478351.2 |
| Apr. 28, 2023 | (CN) | 202310478633.2 |
| Apr. 28, 2023 | (CN) | 202310479013.0 |

(51) Int. Cl.

| | |
|---|---|
| ***D01H 13/04*** | (2006.01) |
| ***D02G 3/36*** | (2006.01) |
| ***D02G 3/38*** | (2006.01) |

(56) References Cited

U.S. PATENT DOCUMENTS

| | | | | |
|---|---|---|---|---|
| 2002/0134068 | A1* | 9/2002 | Gnos | D01H 5/72<br>57/75 |
| 2010/0162677 | A1* | 7/2010 | Qiu | D02G 3/367<br>57/12 |

FOREIGN PATENT DOCUMENTS

| | | | | | |
|---|---|---|---|---|---|
| CN | 106337229 | B | * | 11/2018 | D01H 1/02 |
| CN | 113943990 | A | * | 1/2022 | D01H 11/00 |
| DE | 102019135719 | A1 | * | 6/2021 | D02G 3/324 |

OTHER PUBLICATIONS

Translation DE 102019135719.*
Translation CN 106337229.*
Translation CN 103498229.*
Translation CN 203212719.*

* cited by examiner

SPINNING DEVICE AND METHOD FOR PRODUCING WRAPPED-CORE YARNS

TECHNICAL FIELD

The disclosure relates to the field of textile processing, particularly to a spinning device and method for producing wrapped-core yarns.

BACKGROUND

Wrapped-core yarn, also known as coated yarn, generally takes inorganic or organic filaments with good strength or elasticity as core yarn, wraps staple fiber such as cotton, wool, or viscose fiber on the outside of core yarn, and finally forms a yarn composed of two or more fibers. The wrapped-core yarn is a novel type of yarn with excellent properties of filament core yarn (i.e., the synthetic fiber filament, inorganic or organic filaments) and the wrapped staple fiber, which can optimize the structure and characteristics of spun yarn and is popular among people. For the wrapped-core yarn, a volume ratio of the core yarn of the staple wrapped-core yarn also has an important influence on the performance of the staple wrapped-core yarn, except covering condition of the staple fiber on the core yarn.

At present, there are many spinning methods for the wrapped-core yarn: ring spinning, friction spinning (also referred to as twistless spinning), vortex spinning (also referred to as air-jet spinning) and rotor spinning. The ring spinning is a mainstream technology for preparing the wrapped-core yarn. The wrapped-core yarn based on the ring spinning is prepared by using a conventional ring spinning machine with the addition of a filament feeding device, through which filament is fed from a middle of a staple fiber strand, and the staple fiber strand is wrapped around the filament to form the wrapped-core yarn through the rotational twisting of a balloon. However, conventional ring spinning tends to cause hairiness on the surface of the wrapped-core yarn due to the existence of a twisting triangular space, and the core yarn is easily exposed. In order to eliminate the hairiness, a compact spinning technology (i.e., improved ring spinning) has been widely studied, and its core is to add a gathering device in front of an output of a front roller nip, so that the staple fiber strand is gathered first and then output for twisting, and an adhesion force between an edge fiber and a twisted whisker body (i.e., the staple fiber strand) is increased, thereby reducing the hairiness. However, the current wrapped-core yarn based on the improved ring spinning still tends to have a higher risk of core yarn exposure. In order to ensure the covering effect and yarn quality of the wrapped-core yarn, factories usually adopt the method of increasing the proportion of the outer covering fiber (i.e., the staple fiber), resulting in a proportion of the core yarn (i.e., core yarn ratio) in the wrapped-core yarn generally below 15%.

In order to overcome the above problems, a Chinese patent application with an application No. CN202111337262.3 (publication No. CN113943990A) discloses a wrapped-core yarn spinning device and a novel structural wrapped-core yarn spinning method for macro-core full wrapping. In the wrapped-core yarn spinning device, an auxiliary core-wrapping device is arranged between a front roller nip and a guide hook of a conventional ring spinning frame, and the auxiliary core-wrapping device includes a first yarn channel for transmitting an outer covering material, a second yarn channel for transmitting a core layer material and a wrapping point for wrapping and converging. In a spinning process, a staple fiber strand and filament form a y-shaped twisting structure with the filament in a straight state, and the filament remains in a straight state at a wrapping point, and the staple fiber strand is wrapped around an outer side of the filament by the twisting rotation of the filament and a partial twist of the staple fiber strand at the wrapping point, thus forming a wrapped-core yarn with good wrapping effect, which solves the problem of core yarn exposure. However, the wrapped-core yarn spinning device has the following shortcomings: firstly, a capacity of the first yarn path for transmitting the staple fiber strand is limited, and the staple fiber strand are easy to block the first yarn channel during high-speed transmission of the staple fiber strand, resulting in spinning breakage; secondly, when the staple fiber strand passes through the first yarn channel, the staple fiber strand often touches a side wall of the first yarn channel and cannot be fully stretched, resulting in a limited coating area and a limited coating effect, and the core yarn ratio is difficult to break through more than 50%.

In view of this, it is necessary to propose a spinning device and method for producing wrapped-core yarns to solve the above problems.

SUMMARY

The disclosure aims to provide a spinning device and method for producing wrapped-core yarns. The spinning device is provided with an auxiliary core-wrapping unit with a special structure, so that a staple fiber strand is differential to form staple fiber strands with a certain width and a uniform structure in the auxiliary core-wrapping assembly. By cooperating with a feeding unit, other components of the auxiliary core-wrapping unit and a yarn winding unit, the auxiliary core-wrapping assembly realizes the tight integral wrapping of the staple fiber strands on a core yarn, so as to obtain a wrapped-core yarn with a good covering effect and a relatively larger core yarn ratio, which maximizes the utilization of the staple fiber and reduces the raw material cost of the wrapped-core yarn; and solves the problem that the core yarn is easily exposed on a ring spinning machine, and the core yarn ratio is lower.

In order to achieve objectives of the disclosure, the disclosure provides a spinning device. The spinning device includes a feeding unit, an auxiliary core-wrapping unit and a yarn winding unit. The feeding unit includes: a staple fiber feeding unit, configured to stretch a roving into a staple fiber strand and feed the staple fiber strand into the auxiliary core-wrapping unit, and a core yarn feeding unit, configured to feed a core yarn into the auxiliary core-wrapping unit. The auxiliary core-wrapping unit includes: an auxiliary core-wrapping assembly; a pressurizing/conveying assembly, configured to provide pressure or power to the auxiliary core-wrapping assembly; a yarn guiding assembly, disposed between the auxiliary core-wrapping assembly and the yarn winding unit; and a wrapping area for wrapping and converging. The auxiliary core-wrapping unit is configured to make the staple fiber strand intersect and converge with the core yarn at the wrapping area and make the staple fiber strand wrap the core yarn to form a wrapped-core yarn; and is configured to convey the wrapped-core yarn to the yarn winding unit for twisting and winding.

The disclosure also provides a spinning method, implemented by the spinning device described above, and the spinning method including the following steps:

S1', stretching, by the staple fiber feeding unit, the roving into the staple fiber strand, and feeding the staple fiber strand into the auxiliary core-wrapping unit, and feeding the core yarn into the auxiliary core-wrapping unit;

S2', feeding the core yarn and the staple fiber strand at a target spacing into the auxiliary core-wrapping unit, to make the staple fiber strand is evenly spread on the auxiliary core-wrapping assembly with a target width and a target fiber parallelism; and driving the staple fiber strand to wrap around an outer layer of the core yarn at the wrapping area under rotation of the core yarn to form the wrapped-core yarn; and S3', conveying the wrapped-core yarn to the yarn winding unit for twisting and winding.

The disclosure has at least the following beneficial effects.

The disclosure provides a spinning device and method. The spinning device includes a feeding unit, an auxiliary core-wrapping unit and a yarn winding unit. The auxiliary core-wrapping unit includes an auxiliary core-wrapping assembly, a pressurizing/conveying assembly for providing pressure or power to the auxiliary core-wrapping assembly, a yarn guiding assembly and a wrapping area for wrapping and converging. The spinning device of the disclosure is provided with the auxiliary core-wrapping unit with a special structure, so that the staple fiber strands is differential to form staple fiber strands each with a certain width and a uniform structure through the auxiliary core-wrapping assembly. By cooperation operation of the auxiliary core-wrapping assembly, the feeding unit, other components of the auxiliary core-wrapping unit and the yarn winding unit, the tight integral wrapping of the staple fiber strands on the core yarn is realized, so as to obtain the wrapped-core yarn with a good covering effect and a larger core yarn ratio, which maximizes the utilization of the staple fiber strands and reduces the raw material cost of the wrapped-core yarn, and solves the problem in the related art that the core yarn is easily exposed from the wrapped-core yarn for a ring spinning machine, and the core yarn ratio is lower. Through the cooperation of various units, the spinning device can be applied to industrial production, realizing industrial high-speed and batch spinning, and the produced wrapped-core yarn has good comprehensive properties and has great market application prospects.

The auxiliary core-wrapping assembly of the disclosure enables the staple fiber strands very differentiated and dispersed to form the staple fiber strands each with a certain width, high fiber parallelism and uniform fiber distribution in a wider channel by its own force; after the staple fiber strands converge with the core yarn in the wrapping area, the staple fiber strands are evenly integral wrapped on a surface of the core yarn by the rotation of the core yarn, thereby achieving a good wrapping effect. In addition, the staple fiber channel with a larger width compared with the filament channel is only used to support and transport the staple fiber strands, and no twist is applied to the staple fiber strands, thus avoiding the problem that the staple fiber strands are aggregated and are not conducive to the subsequent coating of the core yarn.

According to the disclosure, the core yarn and the staple fiber strand are limited to enter the auxiliary core-wrapping assembly at a certain spacing, and the core yarn after being output is offset to the staple fiber strand through the limitation of the yarn guiding assembly. In this way, the staple fiber strand or the staple fiber strand do not need to change its angle, and is conveyed in a natural state in the auxiliary core-wrapping unit, thus ensuring the integrity of the staple fiber strand or the staple fiber strand and avoiding aggregation thereof. The core yarn converge with the staple fiber strand formed by the staple fiber strand at the wrapping area at a certain angle, which not only helps the core yarn to rotate and drive the staple fiber strand to wrap around an outer layer of the core yarn to form a wrapped-core yarn with uniform integral wrapping structure, but also avoids the problem that a twist of a bottom yarn is transferred to the staple fiber strand, which leads to self-twisting of the staple fiber strand and is not conducive to the formation of staple fiber strand. In addition, by setting the spacing between the wrapping area and the nip for inputting the staple fiber strand to be greater than a fiber length of the staple fiber strand, the staple fiber strand can be wrapped on the outer layer of the core yarn by better utilizing the rotation of the core yarn, and the high-speed rotation of the core yarn can also produce a certain stretching effect on the staple fiber strand, thereby further improving the yarn quality of the wrapped-core yarn.

In the disclosure, setting the negative pressure air suction assembly in the auxiliary core-wrapping assembly not only increases a clamping force of the staple fiber channel on the staple fiber strands, but also reduces a hairiness on a surface of the wrapped-core yarn, and does not form any twist on the staple fiber strands, which is beneficial to the formation of the uniform staple fiber strands in the staple fiber channel.

The spinning device of the disclosure only needs to improve an auxiliary core-wrapping unit on the ordinary ring frame with a spindle to realize the fiber separation of the staple fiber strands to form the dispersed staple fiber strands; further, the core yarn feeding unit is disposed to adjust the angle of the core yarn fed to the auxiliary core-wrapping unit and to adjust a spacing between the core yarn and the staple fiber strands, so as to realize the effect of tightly wrapping the core yarn by the staple fiber strands to form the wrapped-core yarn. The spinning device of the disclosure has low cost, wide application range and good industrial application prospect and value.

In a spinning device of an embodiment 6, the electrostatic fiber opening assembly is disposed in the core yarn feeding unit and is used to open the core yarn to obtain the ribbon-like fibers, and the auxiliary core-wrapping unit is used to open the staple fiber strands and further expand the ribbon-like fibers, so that the staple fiber strands and the ribbon-like fibers are completely or partially overlapped and embedded with each other, and then automatically wrapped by the rotation of the ribbon-like fibers and the acting force between the staple fiber strands to form a wrapped-core yarn with a sandwich structure, which greatly increases the proportion of the ribbon-like fibers in the wrapped-core yarn and its mechanical properties, while reducing a hairiness index. The spinning method and the spinning device of the disclosure overcome the technical problems of poorer wrapping effect and higher hairiness index caused by the fact that the staple fiber strands and the filament of the traditional ring spinning wrapped-core yarn cannot be spread and are difficult to hold. In this device, firstly, the multi-filament is spun by the electrostatic fiber opening assembly, so as to form dispersed ribbon-like fibers with a certain width; then, a spacing between the ribbon-like fibers and the staple fiber strand before entering the auxiliary core-wrapping unit through the roller nip between the front roller and the front top roller is controlled; and the negative pressure suction assembly of the auxiliary core-wrapping unit is used to define the shape and size of the negative pressure suction port, so as to open the staple fiber strand, without generating an agglomeration force, and at the same time, the ribbon-like fibers are further expanded, so that the staple fiber strand and the ribbon-like fibers are completely or partially overlapped and embedded on the surface of the grid circle. The rotation of the filament drives the staple fiber strand embedded with the filament to be wrapped on the surface of the filament, the ribbon-like fibers and the staple fiber strand are further twisted and integral wrapped by the acting force between the staple fiber strand, and a wrapped-core yarn with a sandwich structure is finally formed. The wrapped-core yarn utilizes twisting between filaments and the staple fiber strand to effectively improve the clamping cohesion between the filaments and staple fiber strand, and the formed wrapped-core yarn has a stable structure, wear resistance and less hairiness, and has application value in the fields of high-grade sewing, textile and clothing, military uniforms, protective clothing and the like.

The spinning device of an embodiment 8 of the disclosure overcomes the technical problems that the staple fiber strand entering the wrapping area cannot be completely spread and are difficult to hold, leading to the loose wrapping and easy exposure of core yarn, and loose wrapping and easy dispersion. The negative pressure suction port with a width greater than or equal to that of the fed staple fiber strand is arranged on the special shaped air suction plate, the suction assembly at the negative pressure suction port expands and spreads the staple fiber strand in the width and length directions, and the staple fiber strand is evenly spread on the grid circle. At the same time, the single fiber is straightened by the tensile force in the conveying direction, and the negative pressure holding staple fibers with a certain width, a higher parallelism and uniform distribution is obtained on the grid circle under the coordinated stretching forces in both the width and length directions. At the same time, the spacing between the core yarn and the staple strand/wrapping composite is 2-5 mm on the front roller, so that the core yarn formed in the wrapping area is in a straight line with the core yarn conveyed to the grid circle and forms a y-shaped structure with the staple strand/wrapping composite conveyed to the grid circle. The rotation of the core yarn drives a staple fiber strand near the core yarn, the wrapping yarn and a staple fiber strand far away from the core yarn to be sequentially wrapped and wound to an outer layer of the core yarn at the wrapping area, thereby forming a wrapped-core yarn with the wrapping yarn and the core yarn holding the staple fiber strand close to the core yarn as a core and with the staple fiber strand far away from the core yarn as a sheath, or the rotation of the core yarn drives the staple fiber strand, the wrapping yarn and a second staple fiber strand to be sequentially wrapped and wound to an outer layer of the core yarn at the wrapping area to form a wrapped-core yarn with the staple fiber strand sandwiched by the wrapping yarn and the core yarn as a core and with the second staple fiber strand as a sheath, thereby effectively improving the clamping cohesion between the core yarn and the wrapped sheath staple fibers, increasing the interface bonding force and fastness between the wrapped sheath staple fibers and the core yarn, and thoroughly solving the problem that the core yarn and the staple fiber sheath are easy to slide and fall off. At the same time, the staple fiber strand is completely spread on the core yarn so the covering effect is good, the core yarn with the content of 60-70% is covered without core leakage, and the problems of core yarn leakage and lower core yarn content of wrapped-core yarn are solved. In particular, the staple fibers are tightly wrapped around the core yarn by negative pressure holding, which has greater wrapping strength and higher compactness, and the yarn strength is improved and the hairiness is reduced.

When the core yarn is a fine-denier flat core yarn and the wrapping yarn is a fine-denier flexible wrapping yarn, in the process of yarn formation, the fine-denier flat core yarn rotates to form a uniform spiral structure, and at the same time, the rotation of the core yarn causes the core yarn, the wrapping yarn and a part of staple fiber strand close to the core yarn to twisted together, and the wrapping yarn and the part of staple fiber strand near the core yarn reinforce and shape the spiral structure formed by the rotation of the core yarn. At the same time, uniform pores are formed between the spiral structure, the wrapping yarn and the part of staple fiber strand close to the core yarn, so as to obtain a spiral, uniform and fluffy core layer in which the wrapping yarn and the core yarn clamp the part of staple fiber strand close to the core yarn; then, under the rotation of the core yarn, a part of the staple fiber strand far away from the core yarn is further wrapped and wound on the core layer to obtain a soft and wear-resistant yarn. Firstly, the core and outer layer of this structured yarn are more tightly and securely bonded, eliminating the disadvantage of easy slippage between the core and the outer layer, which increases wear resistance. Secondly, the uniform and fluffy spiral and porous core structure significantly enhances the softness of the yarn, resulting in a soft wear-resistant yarn that combines both wear resistance and softness.

The spinning device of the embodiment 12 of the disclosure overcomes the technical prejudice that the core yarn and the outer coated staple fiber of a ring spinning wrapped-core yarn need to be overlapped to form yarn together before the yarn is formed, and overcomes the technical problem of easy-to-expose yarn at the same time. The negative pressure air suction port is disposed on the special shaped air suction plate, and the corresponding negative pressure air flow guide assembly is disposed above the negative pressure air suction port, so that the negative pressure formed inside the special shaped air suction plate makes the surrounding air gather towards the special shaped air suction plate. At the same time, the negative pressure air flow guide assembly makes the gathered air flow form a diffusion air flow through the diffusion guide holes, and under the mutual cooperation of the diffusion guide holes and the negative pressure air suction mechanism, the staple fiber strand is diffused and spread in the width and length directions, and the staple fiber strand is evenly spread on the grid circle, so that the spread-out staple fiber strand with a certain width and higher parallelism is obtained on the grid circle. In addition, by arranging the airflow stabilizing holes, the widened and flattened staple fiber strand is further attached to the surface of the grid circle under the action of vertical airflow. At the same time, the spacing between the core yarn and the staple fiber strand is 2-5 mm on the front roller, so that the core yarn formed in the wrapping area is in a straight line with the core yarn conveyed to the grid circle, and forms a y-shaped structure with the staple fiber strand conveyed to the grid circle. The rotation of the core yarn drives the staple fiber strand to be tightly wrapped and wound to the outer layer of the core yarn at the wrapping area, forming a wrapped-core yarn with a larger proportion of core yarns and higher quality.

REFERENCE NUMERALS

Figure 1:
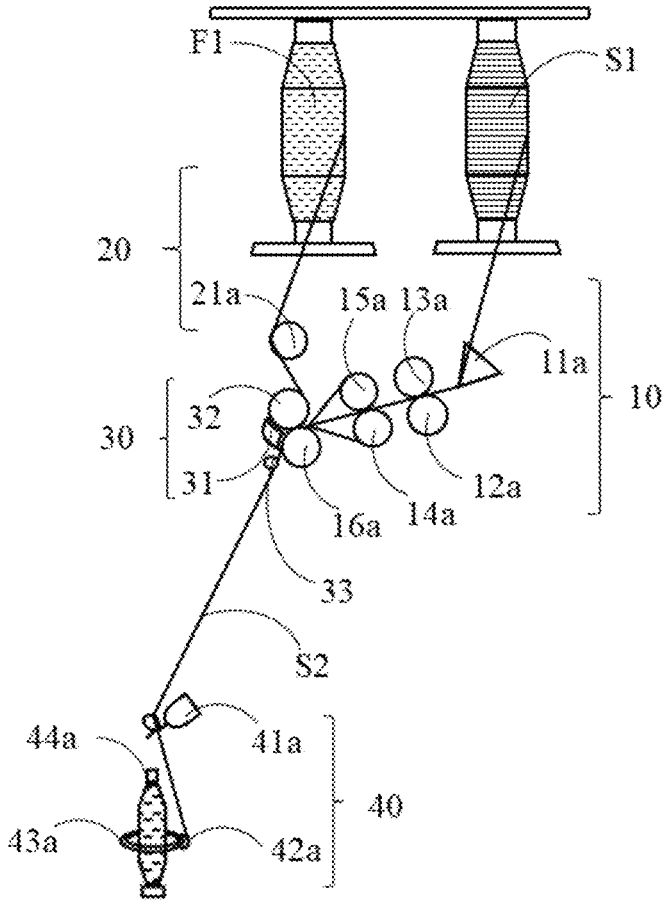
FIG. 1 illustrates a schematic structural diagram of a spinning device according to an embodiment 1.

S0, S1—roving; S11—staple fiber strand; S12—second staple fiber strand; F1—core yarn; F2—wrapping yarn; F11—ribbon-like filaments; S2—wrapped-core yarn; S13—partial staple fiber strand near the core yarn F1; S14—partial staple fiber strand facing away from the core yarn F1;

10—staple fiber feeding unit; 11*a*, 11*b*, 11*c*, 11*d*, 11*e*, 11*f*—bell mouth; 12*a*, 12*b*, 12*c*, 12*d*, 12*e*, 12*f*—rear roller; 13*a*, 13*b*, 13*c*, 13*d*, 13*e*, 13*f*—back top roller; 14*a*, 14*b*, 14*c*, 14*d*, 14*e*, 14*f*—middle roller; 15*a*, 15*b*, 15*c*, 15*d*, 15*e*, 15*f*—middle top roller; 16*a*, 16*c*, 16*d*, 16*e*, 16*f*—front roller;

20—core yarn feeding unit; 21*a*, 21*b*, 21*c*, 21*d*, 21*e*, 21*f*—godet; 22—electrostatic fiber opening assembly; 23—core yarn unwinding unit; 24—tension adjusting frame;

30—auxiliary core-wrapping unit; 31—auxiliary core-wrapping assembly; 32—pressurizing/conveying assembly; 33—yarn guiding assembly; 34—wrapping area; 35*d*, 35*e*, 35*f*—transmission gear; 36—negative pressure air flow guide assembly; 311—staple fiber channel; 312—filament channel; 313—fiber spreading roller; 314—special shaped pipe; 315*c*, 315*d*, 315*e*,

315*f*—grid circle; 316*d*, 316*e*, 316*f*—special shaped air suction plate; 317*d*, 317*e*, 317*f*—drive roller; 321*a*, 321*b*, 321*c*, 321*d*, 321*e*, 321*f*—front top roller; 322*a*, 322*c*, 322*d*, 322*e*, 322*f*—bridge component; 323*c*, 323*c*, 323*e*, 323*f*—drive top roller; 324*c*, 324*d*, 324*e*, 324*f*—roller groove; 331*a*, 331*b*, 331*c*, 331*f*—yarn guiding rod; 332*a*, 332*b*—heating groove; 333—connecting component; 334—compliant reinforced component; 361—diversion housing; 362—diffusion guide hole; 363—airflow stabilizing hole; 3131—roller body; 3132*b*, 3132*d*, 3132*e*, 3132*f*—negative pressure adsorption assembly; 3133*b*, 3133*c*, 3133*d*, 3133*e*, 3133*f*—negative pressure suction port; 3134—grid hole; 3135—negative pressure fiber expansion area; 3311*f*—yarn groove; 3341—heating compliant block; 3342—reinforcing block; 3343—arc groove; 33421—fixing block; 33422—tension adjusting plate;

40—yarn winding unit; 41*a*, 41*b*, 41*c*, 41*d*, 41*e*, 41*f*—guide hook; 42*a*, 42*b*, 42*c*, 42*d*, 42*e*, 42*f*—traveler; 43*a*, 43*b*, 43*c*, 43*d*, 43*e*, 43*f*—steel ring; 44*a*, 44*b*, 44*c*, 44*d*, 44*e*, 44*f*—ring bobbin.

DETAILED DESCRIPTION OF EMBODIMENTS

In order to make the objectives, technical solutions and advantages of the disclosure clearer, the disclosure will be described in detail with accompanying drawings and specific embodiments.

Here, it should also be noted that in order to avoid obscuring the disclosure with unnecessary details, only the structures and/or processing steps closely related to the technical solutions of the disclosure are shown in the drawings, while other details that are not related to the disclosure are omitted.

In addition, it should be noted that the terms "including", "containing" or any other variation thereof are intended to cover non-exclusive inclusion, so that a process, a method, an article or a device including a series of elements includes not only those elements, but also other elements not explicitly listed, or elements inherent to such process, method, article or device.

As illustrated in FIG. 1 through FIG. 42, the disclosure provides a spinning device, which includes a feeding unit, an auxiliary core-wrapping unit 30 and a yarn winding unit 40.

The feeding unit includes a staple fiber feeding unit 10 and a core yarn feeding unit 20. The staple fiber feeding unit 10 is configured to stretch a roving S1 into staple fiber strand S11 and feed the staple fiber strand S11 into the auxiliary core-wrapping unit 30. The core yarn feeding unit 20 is configured to feed a core yarn F1 into the auxiliary core-wrapping unit 30.

The auxiliary core-wrapping unit 30 includes an auxiliary core-wrapping assembly 31, a pressurizing/conveying assembly 32 configured to provide pressure or power to the auxiliary core-wrapping assembly 31, a yarn guiding assembly 33 disposed between the auxiliary core-wrapping assembly 31 and the yarn winding unit 40, and a wrapping area 34 for wrapping and converging the staple fiber strand S11 and the core yarn F1.

The auxiliary core-wrapping unit 30 is configured to make the staple fiber strand S11 intersect and converge with the core yarn F1 at the wrapping area 34, and make the staple fiber strand S11 wrap the core yarn F1 to form a wrapped-core yarn S2. The auxiliary core-wrapping unit 30 is further configured to convey the wrapped-core yarn S2 to the yarn winding unit 40 for twisting and winding. In a process of yarn formation, the staple fiber strand obtained by stretching the roving S1 through the staple fiber feeding unit 10 is differentially dispersed and expanded into highly stretched and fully dispersed flat ribbon-like single fibers under the action of the auxiliary core-wrapping unit 30, and the ribbon-like single fibers are wrapped around an outer layer of the self-rotating twisted core yarn F1 in an orderly revolution one by one, and finally, the ribbon-like single fibers are wrapped around the core yarn F1 by continuously gathering to form the wrapped-core yarn S2. The whole process of yarn formation adopts the principle of "differentiation first and integration second". Moreover, a yarn guiding assembly 33 further makes a structure of the wrapped-core yarn S2 more compact and improves the quality of the wrapped-core yarn S2, which is equivalent to further integration. Based on above, the device of the disclosure is named as a spinning device.

The disclosure will be described in detail by specific embodiments and comparative examples.

Embodiment 1

As illustrated in FIG. 1 through FIG. 5, a staple fiber channel 311 and a filament channel 312 are disposed in the auxiliary core-wrapping assembly 31. The filament channel 312 is separated from the staple fiber channel 311 by a spacing, and a width of the staple fiber channel 311 is 5-10 mm.

The spinning device of this embodiment is provided with the auxiliary core-wrapping assembly 31 with a special structure, so that the staple fiber strands S11 form staple fiber strands each with a certain width and a uniform structure in the staple fiber channel 311. By cooperation operation of the auxiliary core-wrapping assembly 31, the feeding unit, other components of the auxiliary core-wrapping unit 30 and the yarn winding unit 40, the tight integral wrapping of the staple fiber strands on the core yarn F1 is realized, so as to obtain the wrapped-core yarn S2 with a good covering effect and a core yarn ratio of 60%-70%, which maximizes the utilization of the staple fiber strands and reduces the raw material cost of the wrapped-core yarn S2, and solves the problem in the related art that the core yarn is easily exposed from the wrapped-core yarn for a ring spinning machine, and the core yarn ratio is lower. Through the cooperation of various units, the spinning device can be applied to industrial production, realizing industrial high-speed and batch spinning, and the produced wrapped-core yarn has good comprehensive properties and has great market application prospects.

Figure 2:
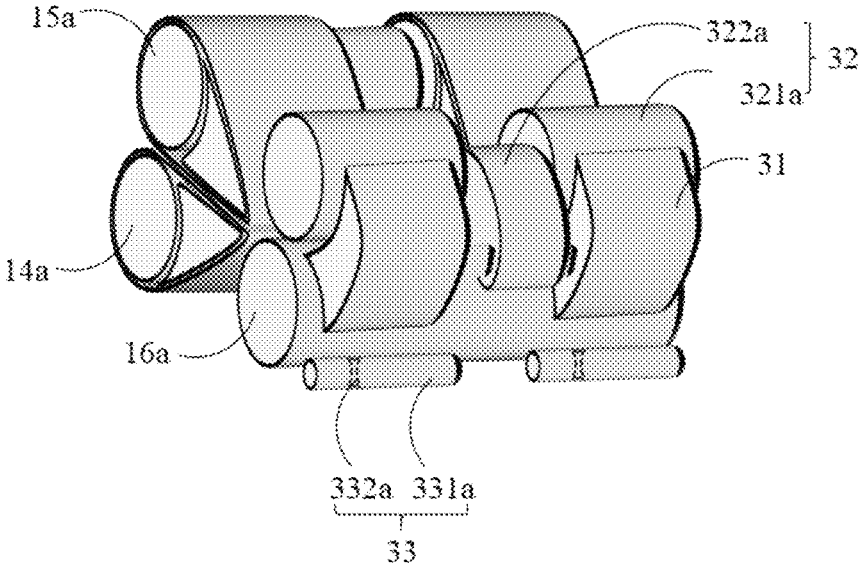
FIG. 2 illustrates a specific schematic structural diagram of an auxiliary core-wrapping unit in the embodiment 1.
Figure 3:
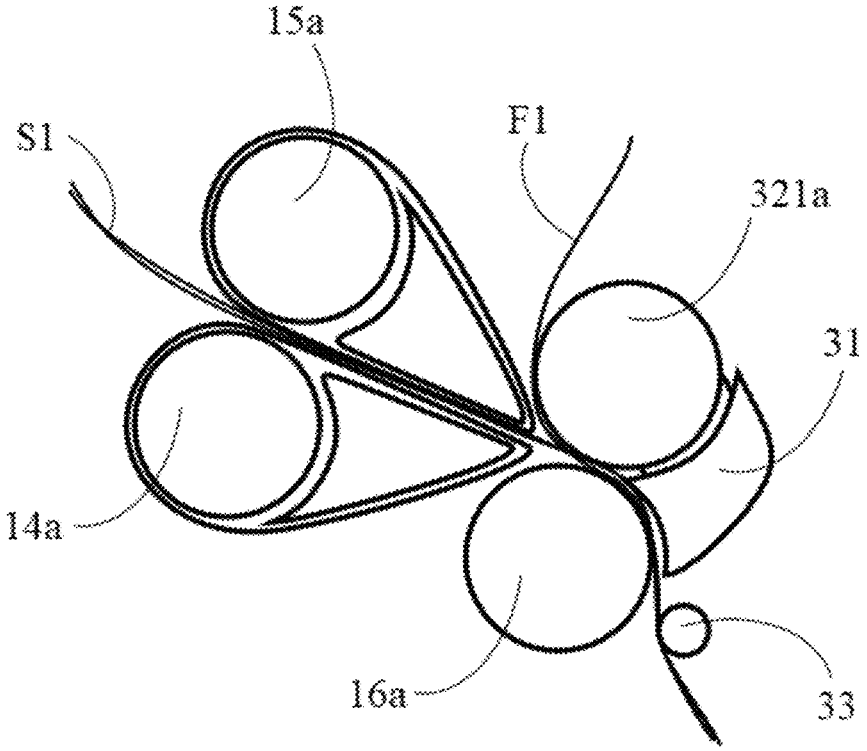
FIG. 3 illustrates an enlarged view of a partial structure of the auxiliary core-wrapping unit in FIG. 1.
Figure 4:
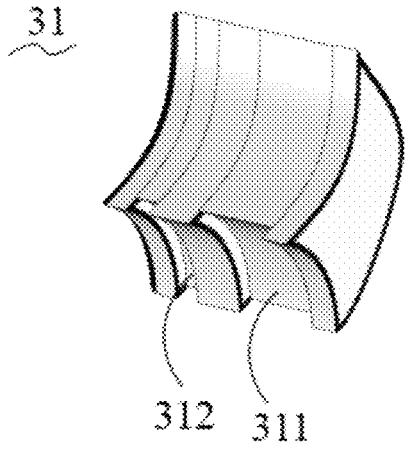
FIG. 4 illustrates a schematic diagram of an internal partial structure of the auxiliary core-wrapping assembly in FIG. 2.

In particular, as illustrated in FIG. 2 through FIG. 4, the staple fiber channel 311 is a channel with a same width along a conveying direction of the staple fiber strands S11, or a channel with a shape of gradually widening along the conveying direction of the staple fiber strands S11, so as to avoid generating a concentrated force by the staple fiber channel 311 on the staple fiber strands S11 and enable the staple fiber strands S11 to form staple fiber strands each with a certain width in the staple fiber channel 311. When the staple fiber channel 311 is the channel with the shape of gradually widening, a width of a narrower portion of the staple fiber channel 311 is 5-7 mm. In this way, during a high-speed spinning process, the roving S1 is stretched by the staple fiber feeding unit 10 to form staple fiber strands S11, and a diameter of each of the staple fiber strands S11 is 1-3 mm; after the staple fiber strands S11 enter the staple fiber channel 311, the staple fiber strands S11 form the staple fiber strands each with a certain width, high fiber parallelism and uniform fiber distribution in a wider channel by its own force; after the staple fiber strands converge with the core yarn F1 in the wrapping area 34, the staple fiber strands are evenly wrapped on a surface of the core yarn F1 by the rotation of the core yarn F1, thereby achieving a good wrapping effect. In addition, the staple fiber channel 311 with a larger width compared with the filament channel 312 is only used to support and transport the staple fiber strands S11, and no twist is applied to the staple fiber strands S11, thus avoiding the problem that the staple fiber strands S11 are aggregated and are not conducive to the subsequent coating of the core yarn F1.

Specifically, the spacing between the staple fiber channel 311 and the filament channel 312 is 2-5 mm. A width of the filament channel 312 is 3-5 mm. The yarn guiding assembly 33 includes a yarn guiding rod 331*a* and a heating groove 332 disposed on the yarn guiding rod 331*a*. The heating groove 332*a* is directly opposite to an output port of the staple fiber channel 311, so that the staple fiber strands are output from the staple fiber channel 311 in a straight line (from FIG. 5, it can be seen that a conveying direction of the staple fiber strands S11 in the staple fiber channel 311 is the same as a conveying direction of the staple fiber strands output from the staple fiber channel 311), and the core yarn F1 is output from the filament channel 312 in a broken line (from FIG. 5, a conveying direction of the core yarn F1 in the filament channel 312 is different from a conveying direction of the core yarn F1 output from the filament channel 312) and offset to the staple fiber strands S11, and the core yarn F1 and the staple fiber strands formed by the staple fiber strands S11 enter the wrapping area 34 at a certain angle and converge in the wrapping area 34. In this way, the staple fiber channel 311 is separated from the filament channel 312 by the spacing, and the core yarn F1 after being output from the filament channel 312 is offset to the staple fiber strands under the arrangement of the yarn guiding assembly 33. As such, the core yarn F1 converges with the staple fiber strands formed by the staple fiber strands S11 at the wrapping area 34 at a certain angle, which not only helps the core yarn F1 to rotate and drive the staple fiber strands to wrap around an outer layer of the core yarn F1 to form the wrapped-core yarn with a uniform wrapping structure, but also avoids the problem that a twist of a bottom yarn is transferred to the staple fiber strands S11, which leads to self-twisting of the staple fiber strands S11, which is not conducive to the formation of staple fiber strands. In addition, in this process, it is unnecessary to change an angle of the staple fiber strands S11, so that the staple fiber strands S11 can be transported to the staple fiber channel 311 in a natural state, so as to maintain the integrity of the staple fiber strands formed by the staple fiber strands S11 in the staple fiber channel 311 and avoid aggregation of the staple fiber strands S11.

It should be noted that a temperature of the heating groove 332*a* disposed in the yarn guiding rod 331*a* is 100-200° C., and the higher the modulus, vitrification or softening temperature of the used staple fiber strands, the higher the setting temperature of the heating groove 332*a*. Besides positioning a yarn forming path, surfaces of the staple fiber strands can be ironed and softened by the heating groove 332*a*, and a yarn forming smoothness can be improved through the heating groove 332*a*, and the yarn forming path from a nip formed between a front roller 16*a* and a front top roller 321*a* to the yarn guiding rod 331*a* is adhered to a surface of the front roller 16*a*. It is also possible to adjust a tension of the wrapped-core yarn S2 on the front roller 16*a* by adjusting a vertical position of the yarn guiding rod 331*a* perpendicular to the yarn forming path, and further, a yarn lateral movement caused by airflow is eliminated, and a structure of the wrapped-core yarn S2 is more stable.

In some other embodiments, a negative pressure air suction assembly is disposed in the auxiliary core-wrapping assembly 31, a surface facing towards the negative pressure air suction assembly of the staple fiber channel 311 is provided with uniform grid holes, and the staple fiber strands S11 in the staple fiber channel 311 are adsorbed by the negative pressure air suction assembly through the uniform grid holes, so that the staple fiber strands S11 are laid flat on an inner surface of the staple fiber channel 311 to form staple fiber strands with a uniform structure. Setting the negative pressure air suction assembly not only increases a clamping force of the staple fiber channel 311 on the staple fiber strands S11, but also reduces a hairiness on a surface of the wrapped-core yarn S2, and does not form any twist on the staple fiber strand S11, which is beneficial to the formation of the uniform staple fiber strands in the staple fiber channel 311. According to the disclosure, the staple fiber strands S11 are firstly formed into widened staple fiber strands, and then the core yarn F1 is coated by the widened staple fiber strands, so that the core yarn ratio of the wrapped-core yarn is improved, the consumption of the roving is saved, and the preparation cost of the wrapped-core yarn is reduced.

Compared with the wrapped-core yarn spinning device in the related art, the spinning device of the disclosure does not form any twist on the staple fiber strands S11, and does not make the staple fiber strands S11 gather, so that the core yarn F1 is wrapped by the staple fiber strands S11 in a natural state only through the support of the staple fiber channel 311 for the staple fiber strands S11. The spinning device of the disclosure is suitable for high-speed spinning of ring spinning in practical factories, and will not exert an excessive force on the staple fiber strands S11 during high-speed spinning, and thus the staple fiber strands with uniform structure are formed, rather than leading to warping or agglomeration, staple fiber accumulation, winding and other problems.

As illustrated in FIG. 1, the feeding unit further includes a front roller 16*a* disposed at an input end of the auxiliary core-wrapping unit 30. The staple fiber feeding unit 10 includes a bell mouth 11*a*, a rear roller 12*a*, a rear top roller 13*a*, a middle roller 14*a* and a middle top roller 15*a*, which are sequentially arranged along a feeding and stretching direction of the roving S1. The front roller 16*a* is disposed to be in contact with the auxiliary core-wrapping assembly 31. The pressurizing/conveying assembly 32 includes a front top roller 321*a* and a bridge component 322*a* connecting the front top roller 321*a* and the auxiliary core-wrapping assembly 31. The front top roller 321*a* and the front roller 16*a* are disposed opposite to each other, and the nip is defined as a nipping jaw between front top roller 321*a* and the front roller 16*a*. Both the staple fiber strand S11 and the core yarn F1 are output from the nip to enter the auxiliary core-wrapping assembly 31. The bridge component 322*a* is configured to apply pressure to the auxiliary core-wrapping assembly 31, so that an inner side of the auxiliary core-wrapping assembly 31 is attached to a surface of the front roller 16*a*.

The core yarn feeding unit 20 includes a godet 21*a* configured to change an angle of the core yarn F1. The core yarn F1 is guided by the godet 21*a*, and is input into the filament channel 312 via the nip between the front top roller 321*a* and the front roller 16*a* at a certain angle. After being output from the filament channel 312, the core yarn F1 and the staple fiber strands S11 enter the wrapping area 34 at a certain angle (that is to say, the certain angel is formed between the core yarn F1 and the staple fiber strands S11)

and converge in the wrapping area 34, and a rotation of the core yarn F1 drives the staple fiber strands S11 to be wrapped around an outer layer of the core yarn F1 to form the wrapped-core yarn S2.

The spinning device of the disclosure only needs to improve an auxiliary core-wrapping unit on the ordinary ring spinning device to realize the fiber separation of the staple fiber strands S11 to form the staple fiber strands; further, the core yarn feeding unit 20 is disposed to adjust the angle of the core yarn F1 fed to the auxiliary core-wrapping unit 30 and to adjust a spacing between the core yarn and the staple fiber strands S11, so as to realize the effect of tightly wrapping the core yarn F1 by the staple fiber strands S11 to form the wrapped-core yarn. The spinning device of the disclosure has low cost, wide application range and good industrial application prospect and value.

Figure 5:
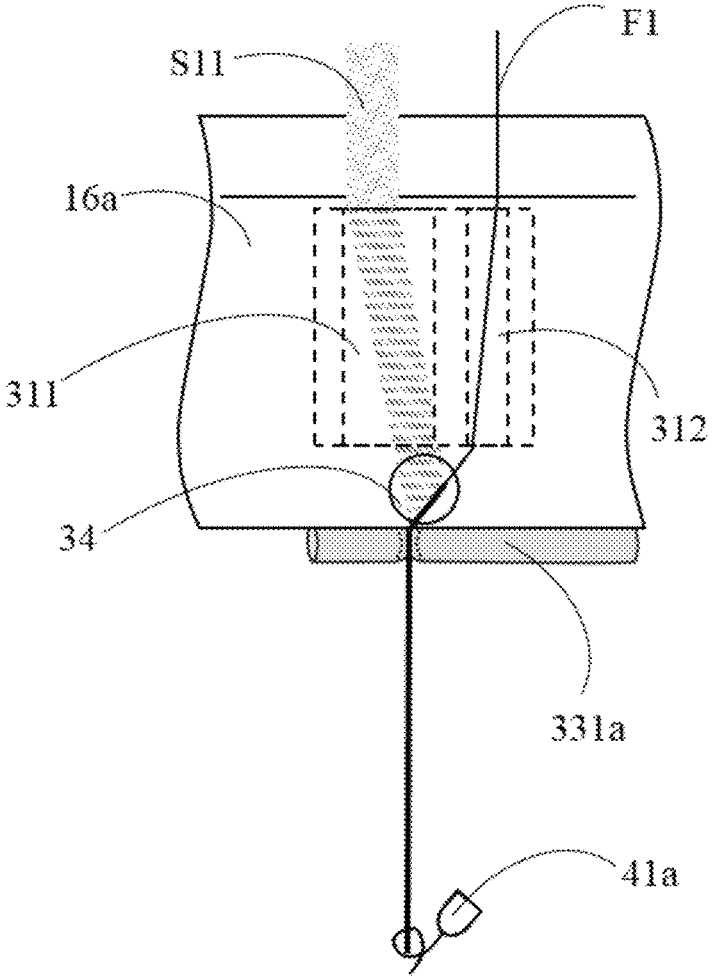
FIG. 5 illustrates a schematic diagram of a spinning method according to the embodiment 1.

A spinning method implemented by the spinning device provided in the embodiment 1 is provided, as illustrated in FIG. 5.

In the spinning method, the staple fiber feeding unit 10 stretches a roving S1 into staple fiber strands S11. Then, the staple fiber strands S11 are conveyed into the staple fiber channel 311 of the auxiliary core-wrapping assembly 31 through the nip between the front top roller 321*a* and the front roller 16*a*, and the staple fiber strands S11 form staple fiber strands in the staple fiber channel 311. Then the staple fiber strands are output from the staple fiber channel 311 and are conveyed forward along an operation direction of the front roller 16*a*.

Simultaneously, a core yarn F1 is guided by the godet 21*a*, and is input into the filament channel 312 of the auxiliary core-winding assembly 31 from the nip between the front top roller 321*a* and the front roller 16*a* at a certain angle, and after being output, the core yarn F1 and the staple fiber strands on a surface of the front roller 16*a* enter the winding area 34 at a certain angle (that is to say, the certain angel is formed between the core yarn F1 and the staple fiber strands) and converge in the winding area 34, and the rotation of the core yarn F1 drives the staple fiber strands to be wrapped around an outer layer of the core yarn F1 to form a core-wrapped-core yarn S2.

The wrapped-core yarn S2 passes through the heating groove 332*a* on the yarn guiding rod 331*a*, so as to realize the positioning of a yarn forming path and eliminate a yarn lateral movement caused by airflow. The yarn guiding rod 331*a* conveys the wrapped-core yarn S2 to a guide hook 41*a* of the yarn winding unit 40, and the wrapped-core yarn S2 is wound on a ring bobbin 44*a* by a traveler 42*a* rotating at higher speed on the steel ring 43*a*, therefore, the spinning process is completed.

In particular, a spacing between the wrapping area 34 and the nip is greater than a fiber length of each of the staple fiber strands S11, so that the staple fiber strand S11 can be wrapped on a surface of the core yarn F1 by the rotation of the core yarn F1. An input spacing between the staple fiber strand S11 and the core yarn F1 in the nip is 2-5 mm, and the input spacing indicates a spacing between the staple fiber strand S11 and the core yarn F1 before inputting into the nip. By setting the spacing between the wrapping area 34 and the nip between the front top roller 321*a* and the front roller 16*a* to be greater than the fiber length of each of the staple fiber strand S11, the staple fiber strand S11 can be wrapped on the outer layer of the core yarn F1 by better utilizing the rotation of the core yarn F1, and the high-speed rotation of the core yarn F1 can also produce a certain stretching effect on the staple fiber strand S11, thereby further improving the yarn quality of the wrapped-core yarn S2. The purpose of restricting the input spacing between the staple fiber strand S11 and the core yarn F1 in the nip between the front top roller 321*a* and the front roller 16*a* (that is to say, before entering the nip, the staple fiber strand S11 are separated from the core yarn F1 by the input spacing) is to match the spacing between the staple fiber channel 311 and the filament channel 312 and the restriction function of the yarn guiding assembly 33, so that the core yarn F1 converges with the staple fiber strands formed by the staple fiber strand S11 at the wrapping area 34 at a certain angle, which is beneficial to the wrapping effect of the staple fiber strands on the core yarn F1.

In this embodiment, the spacing between the staple fiber channel 311 and the filament channel 312 is 5 mm, a width of the filament channel 312 is 3 mm, the staple fiber channel 311 is a channel with a same width of 10 mm along a conveying direction of the staple fiber strand S11. In the spinning process, the input spacing between the staple fiber strand S11 and core yarn F1 in the nip is 5 mm.

Figure 6:
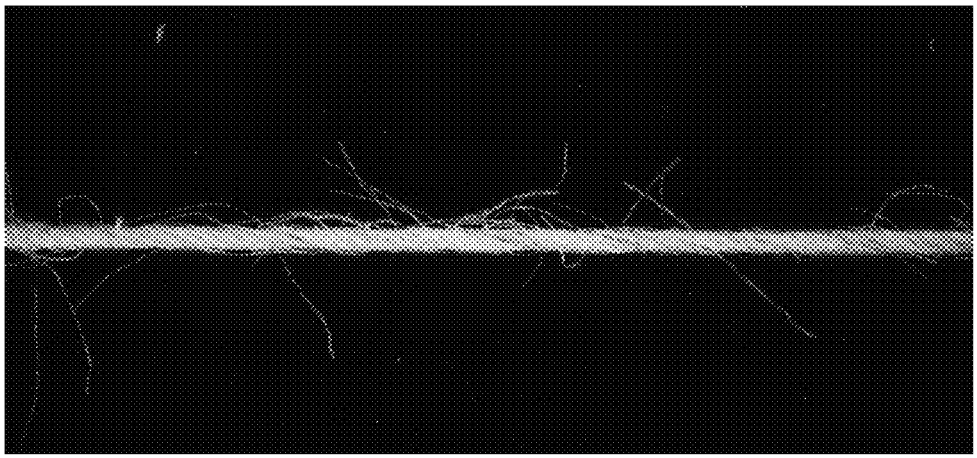
FIG. 6 illustrates a polyester-cotton wrapped-core yarn spun by the core wrapping device and method in the embodiment 1 under 35 times magnification using a 3D microscope.

As illustrated in FIG. 6, FIG. 6 illustrates a polyester-cotton wrapped-core yarn spun by the spinning device and method in the embodiment 1 under 35 times magnification using a 3D microscope. A material of a core yarn of the polyester-cotton wrapped-core yarn is 120D blue polyester yarn. A material of a staple fiber strand is 735 tex cotton roving. Process parameters are as follows: a spindle speed is 8000 r/min, a twist is 70 T/10 cm, a speed of a front roller is 11.43 m/min, a total drafting multiple is 82.68, a linear density of cortical cotton fiber is 8.89 tex, and a back zone drafting multiple is 1.25. In FIG. 6, a core yarn ratio of the polyester-cotton wrapped-core yarn is 60%.

As can be seen from FIG. 6, in the polyester-cotton wrapped-core yarn spun by the spinning device and method in the embodiment 1, a polyester core yarn is completely covered by an outer cotton fiber without exposure the polyester core yarn, an overall yarn coating effect is good, and parallelism of the outer cotton fiber is higher.

Comparative Example 1

The comparative example 1 provides a wrapped-core yarn device and method. Compared with the embodiment 1, the difference is that the device in the comparative example 1 is a conventional ring spinning device, and the method in the comparative example 1 includes: gathering staple fiber strands around a core yarn and twisting the staple fiber strands to obtain a wrapped-core yarn. The rest process is basically the same as that of the embodiment 1, so the details are not repeated herein.

Figure 7:
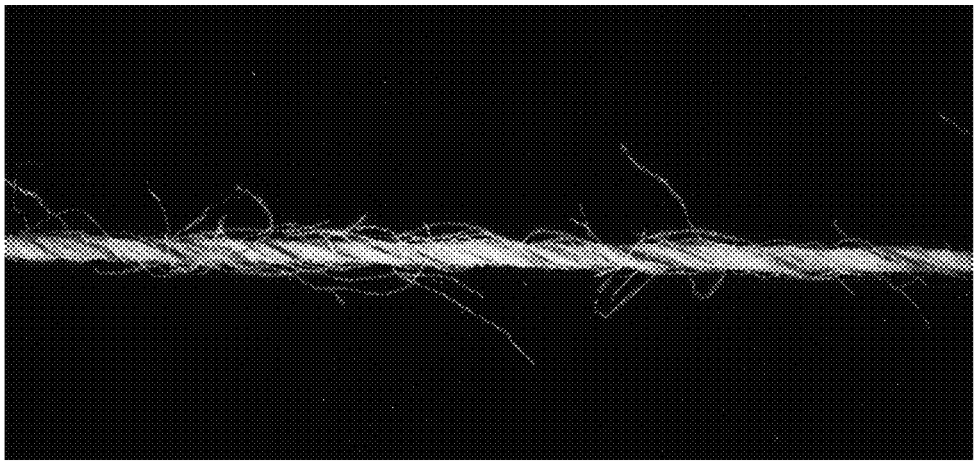
FIG. 7 illustrates a polyester-cotton wrapped-core yarn spun by a conventional ring core spinning method in a comparative example 1 under 35 times magnification using a 3D microscope.

FIG. 7 illustrates a polyester-cotton wrapped-core yarn spun by an ordinary ring core spinning method under 35 times magnification using a 3D microscope. The ordinary ring core spinning method directly gathers staple fiber strands and twists the staple fiber strands and a core yarn to prepare the polyester-cotton wrapped-core yarn, and the auxiliary core-wrapping unit 30 of the disclosure is not provided therein. As can be seen from FIG. 7, the polyester-cotton wrapped-core yarn spun by the ordinary ring core spinning method can't cover the core yarn well when the core yarn ratio is 60%, and there is an obvious phenomenon that the blue polyester core yarn is exposed, and the yarn quality of the wrapped-core yarn is poorer.

Comparative Example 2

This comparative example 2 provides another spinning device and method. Compared with the embodiment 1, the difference is that the staple fiber channel 311 and the filament channel 312 are closely disposed (i.e., there is no spacing between the staple fiber channel 311 and the filament channel 312), and the rest are basically the same as those in the embodiment 1, so the details are not repeated herein.

Figure 8:
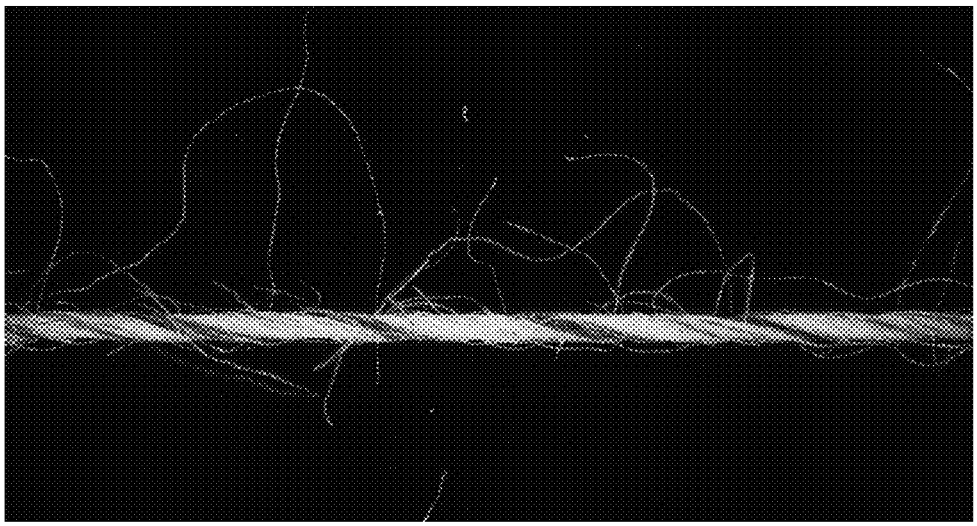
FIG. 8 illustrates a polyester-cotton wrapped-core yarn in a comparative example 2 under 35 times magnification using a 3D microscope.
Figure 9:
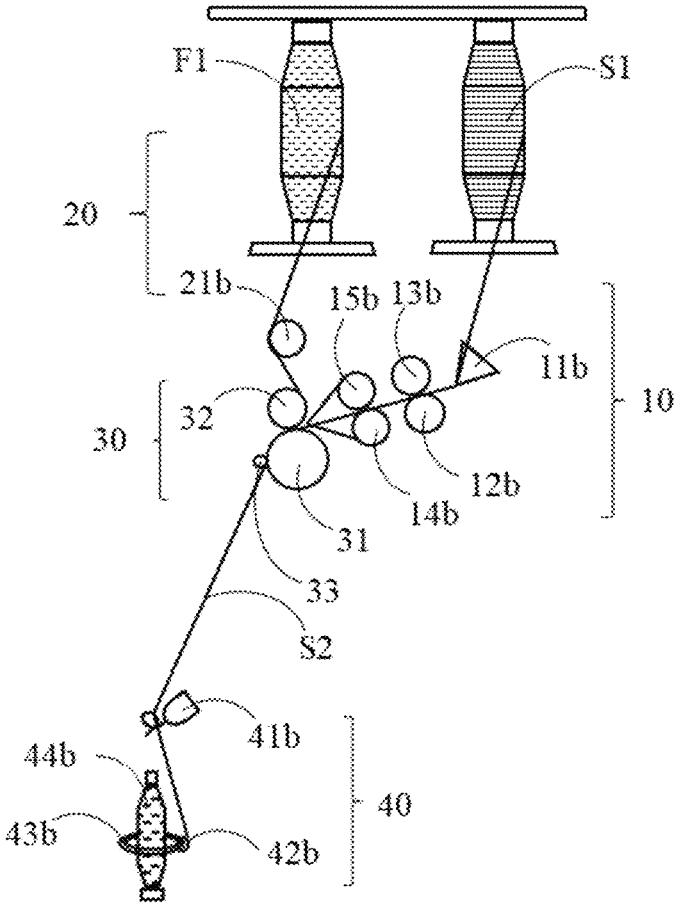
FIG. 9 illustrates a schematic structural diagram of a spinning device according to an embodiment 2.

As illustrated in FIG. 8, FIG. 8 illustrates a polyester-cotton wrapped-core yarn spun by a device with no spacing between the staple fiber channel 311 and the filament channel 312 in a comparative example 2 under 35 times magnification using a 3D microscope, in which a core yarn ratio is 60%. As can be seen from FIG. 8, the polyester-cotton wrapped-core yarn spun by the device with no spacing between the staple fiber channel 311 and the filament channel 312 forms the appearance of a plied yarn, and a blue polyester core yarn is twisted with an outer cotton fiber instead of completely covering the blue polyester core yarn.

The wrapped-core spun yarns spun in the embodiment 1 and the comparative examples 1-2 are compared in terms of core yarn ratio, breaking strength and elongation at break, and corresponding results are shown in Table 1.

TABLE 1

Comparative results of performance of wrapped-core yarns in embodiment 1 and comparative examples 1-2

| | Core yarn ratio (%) | Breaking strength (centiNewton (cN)) ± Standard deviation | Elongation at break (%) ± Standard deviation |
|---|---|---|---|
| Embodiment 1 | 60 | 930.57 ± 8.07 | 7.72 ± 0.16 |
| Comparative example 1 | 60 | 712.91 ± 28.57 | 7.42 ± 0.22 |
| Comparative example 2 | 60 | 745.63 ± 10.34 | 7.56 ± 0.21 |

As can be seen from Table 1, the wrapped-core yarn of the embodiment 1 is closer to an ideal wrapped-core yarn structure in structure, in a stretching process, the core yarn of the wrapped-core yarn mainly bears stress, therefore, a breaking strength of the wrapped-core yarn is higher. However, in the wrapped-core yarn in the comparative example 1, the wrapped-core yarn is exposed from the wrapped-core yarn, and the core yarn is not completely straightened in a yarn body (i.e., wrapped-core yarn), but is constantly transferred from inside to outside. Therefore, during a stretching process of the wrapped-core yarn in the comparative example 1, the core yarn and the staple fiber strands are jointly stressed, and the core yarn is subjected to a shearing force generated by the stretching of the staple fiber strands, so a breaking strength of the wrapped-core yarn is lower, there is a higher likelihood that the core yarn and the staple fiber strands will break at different times, and a standard deviation is higher. The wrapped-core yarn in the comparative example 2 completely presents the appearance of the plied yarn. During a stretching process of the wrapped-core yarn in the comparative example 2, the core yarn and the staple fiber strands are jointly stressed, and the core yarn and the staple fiber strands are twisted together. The breaking strength and the elongation at break of the wrapped-core yarn in the comparative example 1 are lower than those of the wrapped-core yarn in the embodiment 1, and the standard deviation in the comparative example 1 is lower than that in the embodiment 1.

Embodiment 2

As illustrated in FIG. 9 through FIG. 13, the auxiliary core-wrapping assembly 31 is a fiber spreading roller 313, the pressing/conveying assembly 32 is a front top roller 321*b* disposed opposite to the fiber spreading roller 313. The fiber spreading roller 313 is configured to perform negative pressure fiber expansion on the staple fiber strands S11 conveyed from the staple fiber feeding unit 10 to form widened fiber strands, the widened fiber strands tightly wrap the core yarn F1 conveyed from the core yarn feeding unit 20 to form a wrapped-core yarn S2, and the formed wrapped-core yarn S2 is conveyed to the yarn winding unit 40 by the yarn guiding assembly 33.

In this spinning device, the auxiliary core-wrapping unit 30 is set to perform negative pressure fiber expansion on the staple fiber strand S11 to form the widened fiber strands, and the feeding unit and the yarn winding unit 40 are cooperated with the auxiliary core-wrapping unit 30 to realize the tight integral wrapping of the core yarn F1 by the widened fiber strands, so that the wrapped-core yarn S2 with good covering effect and a ratio of the core yarn F1 to the wrapped-core yarn S2 accounting for 60%-80% can be obtained. The spinning device in the embodiment 2 has advantages as the same as those of the spinning device in the embodiment 1, and will not be described herein.

Figure 10:
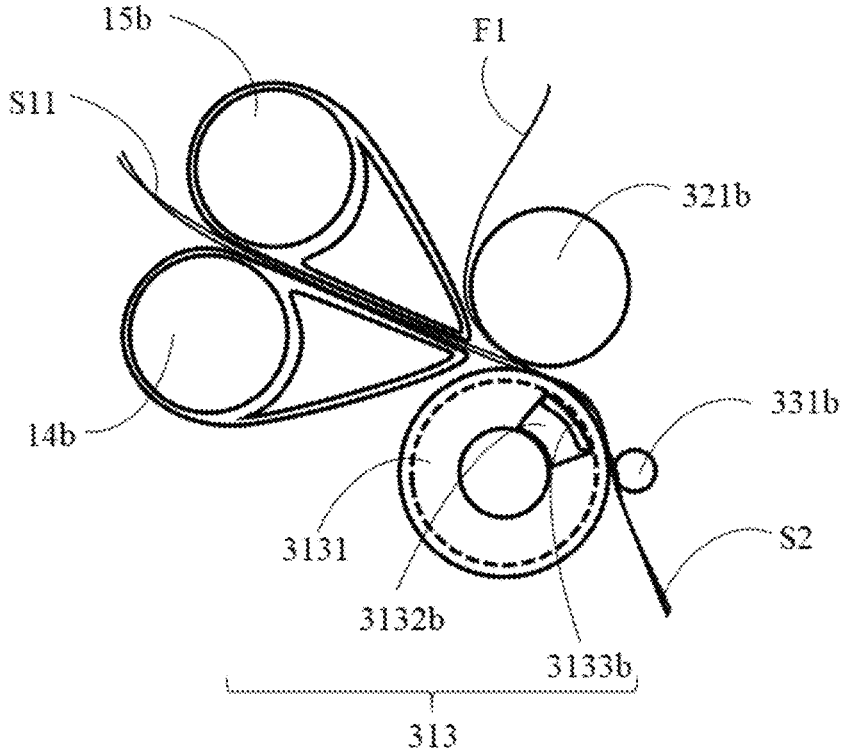
FIG. 10 illustrates an enlarged view of a partial structure of an auxiliary core-wrapping unit in FIG. 9.
Figure 11:
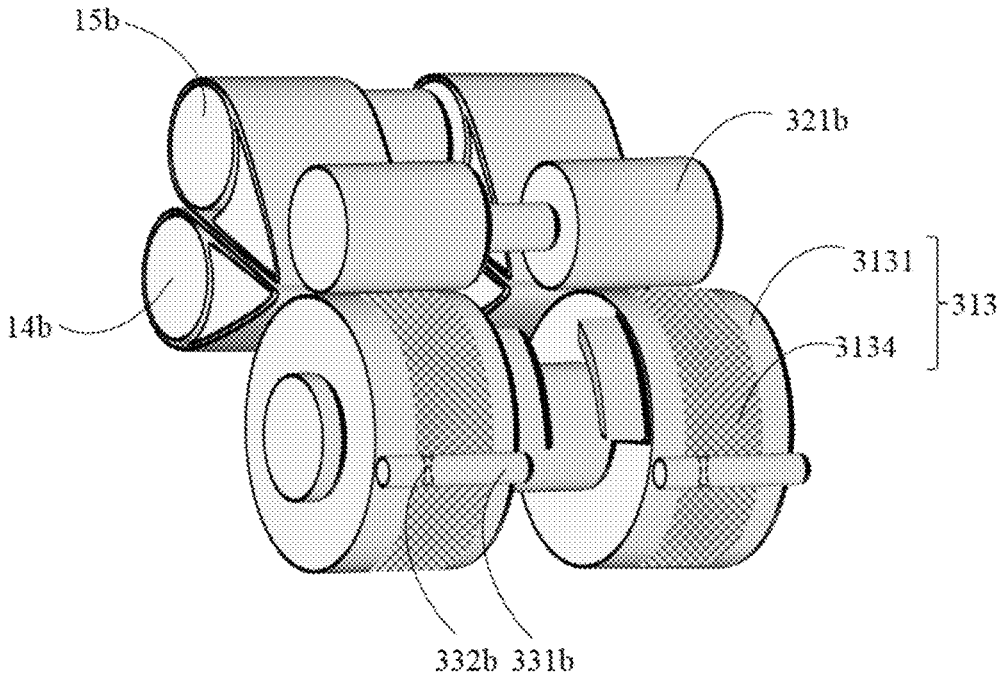
FIG. 11 illustrates a specific schematic structural diagram of the auxiliary core-wrapping unit of the spinning device in the embodiment 2.
Figure 12:
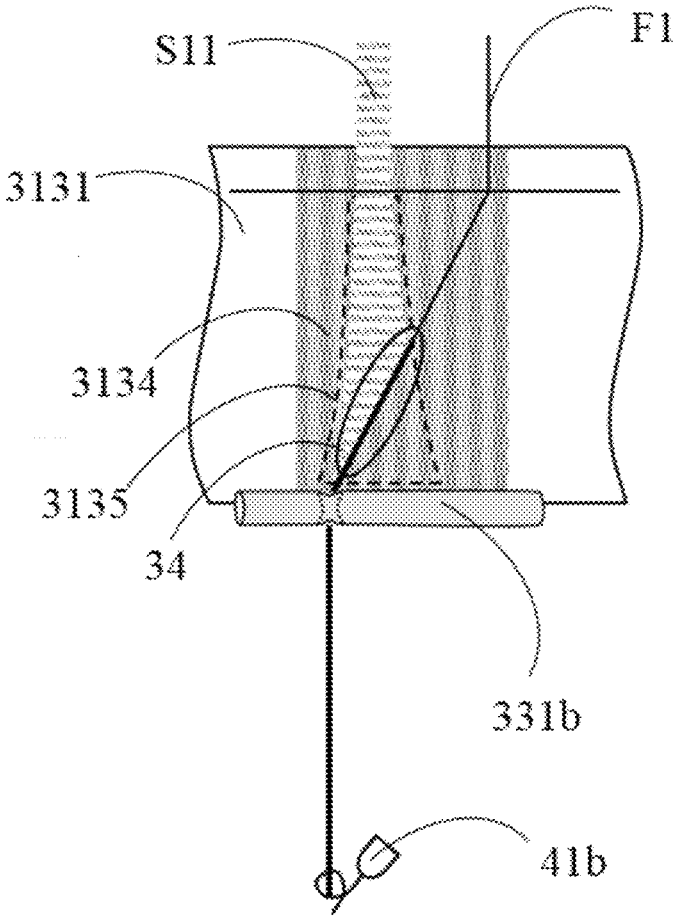
FIG. 12 illustrates a schematic diagram of a spinning method according to the embodiment 2.

As illustrated in FIG. 10 through FIG. 11, the fiber spreading roller 313 includes a central shaft, a roller body 3131, and a negative pressure adsorption assembly 3132*b* disposed in the roller body 3131. The negative pressure adsorption assembly 3132*b* is fixedly disposed on the central shaft of the fiber spreading roller 313 and does not rotate with the fiber spreading roller 313. A surface of the roller body 3131 is provided with evenly distributed grid holes 3134, which only allow airflow to pass therethrough and have the function of supporting and transporting the staple fiber strand S11. The negative pressure adsorption assembly 3132*b* is configured to adsorb the staple fiber strand S11 to surfaces of the grid holes 3134 under negative pressure, thereby forming a negative pressure fiber expansion area 3135 (as illustrated in FIG. 12). The negative pressure adsorption assembly 3132*b* in this embodiment increases a clamping force of the fiber spreading roller 313 to the staple fiber strand S11, which is beneficial to the formation of the uniform fiber belt on the surface of the fiber spreading roller 313. A specific function of the negative pressure adsorption assembly 3132*b* is the same as that of the negative pressure air suction assembly in the embodiment 1, and will not be described herein.

In some specific embodiments, the core yarn F1 is an inorganic fiber filament, an organic fiber filament, an organic/inorganic composite filament, or a staple yarn or a filament/staple composite yarn.

Specifically, the negative pressure adsorption assembly 3132*b* includes a negative pressure suction port 3133*b*, which is disposed to face towards the grid holes 3134 (i.e., the negative pressure suction port 3133*b* is disposed to close to the grid holes 3134). The negative pressure air suction port 3133*b* has air inlets with a same width along a conveying direction of the staple fiber strand S11, or the negative pressure air suction port 3133*b* has air outlets gradually widened along the conveying direction of the staple fiber strand S11, so as to realize the fiber spreading of the staple fiber strand S11. In this way, the staple fiber strand S11 are adsorbed on the surface of the fiber spreading roller 313 through the grid holes 3134 by the negative pressure adsorption assembly 3132*b*, such that the staple fiber strand S11 are supported and transported by the negative pressure adsorption assembly 3132*b*, and no twist is applied to the staple fiber strand S11. Moreover, through a guiding spreading action of a negative pressure airflow generated by the negative pressure suction port 3133*b* with the air outlets and a micro-vibration action of the fiber spreading roller 313, the fiber spreading of the staple fiber strand S11 is realized, and the widened fiber strands each with a certain width, high fiber parallelism and uniform fiber distribution are formed. After the widened fiber strands converge with the core yarn F1 in the wrapping area 34, the widened fiber strands are evenly wrapped on the surface of the core yarn F1 by the rotation of the core yarn F1.

Figure 13:
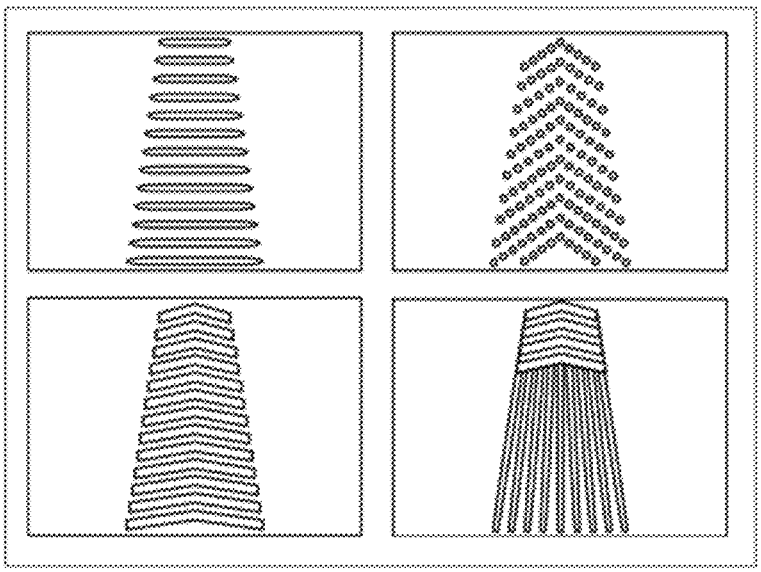
FIG. 13 illustrates examples of shapes of grid holes.

As illustrated in FIG. 13, FIG. 13 illustrates examples of shapes of the grid holes 3134 of the disclosure. It can be seen that the shape of the grid holes 3134 is not unique. For example, a suction area gradually widened along the conveying direction of the staple fiber strand S11 can be formed according to the shape of the negative pressure suction port 3133*b*, so that the staple fiber strand S11 can be adsorbed in the suction area under the guidance of a negative pressure airflow, and the staple fiber strand S11 can be expanded to form the widened fiber strands with uniform structure.

It should be noted that a diameter of the staple fiber strand S11 output by the staple fiber feeding unit 10 is 1-3 mm, so a width of the negative pressure suction port 3133*b* is 5-10 mm, and a width of a narrowest portion of the negative pressure suction port 3133*b* is 5-7 mm. In this way, the staple fiber strand S11 can be better expanded in the negative pressure spreading area 3135 on the surface of the fiber spreading roller 313, and no aggregation occurs, thereby forming the widened fiber strands with uniform structure.

Specifically, the yarn guiding assembly 33 is disposed on a surface of the fiber spreading roller 313. The yarn guiding assembly 33 is a yarn guiding rod 331*a*, and the yarn guiding rod 331*a* is provided with a heating groove 332*b* thereon. A temperature of the heating groove 332*b* is 100-200° C., and a setting principle for the temperature is the same as that in the embodiment 1. Through the heating groove 332*b*, the wrapped-core yarn S2 is formed between the fiber spreading roller 313 and the yarn guiding assembly 33, and the wrapped-core yarn S2 formed by wrapping the spreading fibers onto F1 is then passed into the heating groove 332*b* of the yarn guiding assembly 33 to the yarn winding unit 40, and the heating groove 332*b* locates a yarn forming path of the wrapped-core yarn S2, and a surface of the wrapped-core yarn S2 can be ironed and softened to improve the smoothness of the wrapped-core yarn S2. The position of the heating groove 332*b* on the yarn guiding assembly 33 satisfies a condition that an angle of the staple fiber strand S11 when staple fiber strand S11 are input into the auxiliary core-wrapping unit 30 is the same as an angle of the widened fiber strands when the widened fiber strands are transported in the auxiliary core-wrapping unit 30, so as to maintain the integrity and structural uniformity of the widened fiber strands formed by the staple fiber strand S11 in the auxiliary core-wrapping unit 30 and make the widened fiber strands cover the surface of the core yarn F1 in a natural state. By only adjusting the core yarn F1 to generate an included angle between the core yarn F1 and the widened fiber strands, it is not only beneficial to the covering of the core yarn F1 by the widened fiber strands, but also avoids the problem that a twist of a bottom yarn (i.e., the core yarn F1) is transferred to the staple fiber strand S11, which leads to self-twisting of the staple fiber strand S11, and it is not beneficial the staple fiber strand S11 to expand to form the widened fiber strands. The position of the yarn guiding assembly 33 in a direction perpendicular to the yarn forming path can be adjusted to adjust a tension of the wrapped-core yarn S2 on the fiber spreading roller 313, and to eliminate a yarn lateral movement caused by airflow, so that the structure of the wrapped-core yarn S2 is more stable.

Specifically, the staple fiber feeding unit 10 includes a bell mouth 11*b*, a back roller 12*b*, a back top roller 13*b*, a middle roller 14*b* and a middle top roller 15*b*, which are sequentially arranged along a feeding direction of the roving S1 in that order. After the roving S1 is stretched into the staple fiber strand S11 by the staple fiber feeding unit 10, the staple fiber strand S11 are clamped by the middle roller 14*b* and the middle top roller 15*b*, and are conveyed between the fiber spreading roller 313 and the front top roller 321*b* of the auxiliary core-wrapping unit 30. The core yarn feeding unit 20 includes a godet 21*b* configured to change an angle of the core yarn F1. The core yarn F1 is guided by the godet 21*b*, and then is input into the auxiliary core-wrapping unit 30 from the nip between the front top roller 321*b* and the fiber spreading roller 313 at a certain angle. Then, the core yarn F1 converges with the widened fiber strands on the surface of the negative pressure fiber expansion area 3135 at a certain angle in the wrapping area 34, and the core yarn F1 rotates to drive the widened fiber strands to be wrapped around an outer layer of the core yarn F1 to form a wrapped-core yarn S2.

The godet 21*b* of the core yarn feeding unit 20 can change the angle of the core yarn F1 (i.e., an inputting angle of the core yarn F1 into the nip), so as to control the included angle between the core yarn F1 and the widened fiber strands in the wrapping area to be 5°-65°, so that the widened fiber strands can better rotate and wrap the surface of the core yarn F1. The staple fiber feeding unit 10 is configured to stretch the roving S1 to thereby obtain staple fiber strand S11, and feed the obtained staple fiber strand S11 into the auxiliary core-wrapping unit 30 for negative pressure fiber expansion to form the widened fiber strands. By defining the spacing between the staple fiber strand S11 and the core yarn F1 before entering the auxiliary core-wrapping unit 30 and defining the position of the heating groove 332*b* in the yarn guiding assembly 33, the following effects are brought out: the widened fiber strands are conveyed in the auxiliary core-wrapping unit 30 in a natural state without changing the conveying angle of the widened fiber strands, and the structural integrity and uniformity of the widened fiber strands are maintained; and an included angle is generated between the core yarn F1 and the widened fiber strands, which is not only beneficial to the covering of the core yarn F1 by the widened fiber strands, but also avoids the problem that a twist of the bottom yarn is transferred to the staple fiber strand S11, which leads to self-twisting of the staple fiber strand S11, and it is not beneficial the staple fiber strand S11 to expand to form the widened fiber strands.

Compared with the core spinning device in the related art, the spinning device of this embodiment of the disclosure has the same advantages as in the embodiment 1. In addition, when the staple fiber strand S11 encounter breakage or other operational issues, the difficulty for workers to repair is lower, and no additional unnecessary operations on the spinning device are required.

As illustrated in FIG. 12, FIG. 12 illustrates a schematic diagram of a spinning method according to the embodiment 2. Specifically, the staple fiber strand S11 are subjected to negative pressure expansion by the auxiliary core-wrapping unit 30 to form widened fiber strands each with a certain width and parallelism, and the widened fiber strands tightly wrap the core yarn F1 to obtain the wrapped-core yarn S2. The specific spinning method is as follows.

The staple fiber feeding unit 10 stretches the roving S1 into the staple fiber strand S11 and conveys the staple fiber strand S11 to the fiber spreading roller 313 of the auxiliary core-wrapping unit 30. The staple fiber strand S11 are adsorbed by the negative pressure absorption assembly 3132*b* through the grid holes 3134 and spread on the surface of the roller body 3131, and a widened fiber strands is formed in the negative pressure spreading area 3135. Then, the widened fiber strands are transported forward along an operation direction of the fiber spreading roller 313.

Simultaneously, the core yarn F1 is guided by the godet 21*b*, and its guiding principle and conveying path thereof are as described above.

The heating groove 332*b* of the yarn guiding assembly 33 locates a yarn forming path of the wrapped-core yarn S2 and eliminates a yarn lateral movement caused by airflow. The yarn guiding assembly 33 conveys the wrapped-core yarn S2 to the guide hook 41*b* of the yarn winding unit 10, and the wrapped-core yarn S2 is wound on the ring bobbin 44*b* by a traveler 42*b* rotating at a higher speed on the steel ring 43*b*, thereby completing the wrapped-core yarn process in which the staple fiber strands are spread and tightly wrapped with high-proportion core yarns.

Particularly, the spacing between the wrapping area 34 and the nip between the front top roller 321*b* and the fiber spreading roller 313 is greater than a fiber length of each of the staple fiber strand S11, so that the staple fiber strand S11 are wrapped on an outer layer of the core yarn F1 by the rotation of the core yarn F1. The core yarn F1 has a certain spacing from the staple fiber strand S11 at a feeding position of the nip of the fiber spreading roller 313, and the certain spacing between the core yarn F1 and the staple fiber strand S11 is preferably 2-5 mm. The included angle between the core yarn F1 and the widened fiber strands in the wrapping area 34 is in range from 5° to 65°.

In this spinning method, after the core yarn F1 is guided by the godet 21*b*, the core yarn F1 enters the nip between the front top roller 321*b* and the fiber spreading roller 313. Before the core yarn F1 enters the nip between the front top roller 321*b* and the fiber spreading roller 313, the core yarn F1 is separated from the staple fiber strands by with a certain spacing. After the core yarn F1 enters the nip between the front top roller 321*b* and the fiber spreading roller 313, the core yarn F1 converges with the widened fiber strands conveyed forward by the fiber spreading roller 313 at a certain angle in the wrapping area, and then the widened fiber strands are driven by the rotation of the core yarn F1 to be wrapped around an outer layer of the core yarn F1, thereby forming the wrapped-core yarn S2 with a uniform wrapping structure. In addition, the spacing between the wrapping area 34 and the nip between the front top roller 321*b* and the fiber spreading roller 313 is greater than the fiber length of each of the staple fiber strand S11, so as to better wrap the staple fiber strand S11 on the outer layer of the core yarn F1 by the rotation of the core yarn F1, and the high-speed rotation of the core yarn F1 can also produce a certain stretching effect on the staple fiber strand S11, further improving the yarn quality of the wrapped-core yarn S2.

Figure 14:
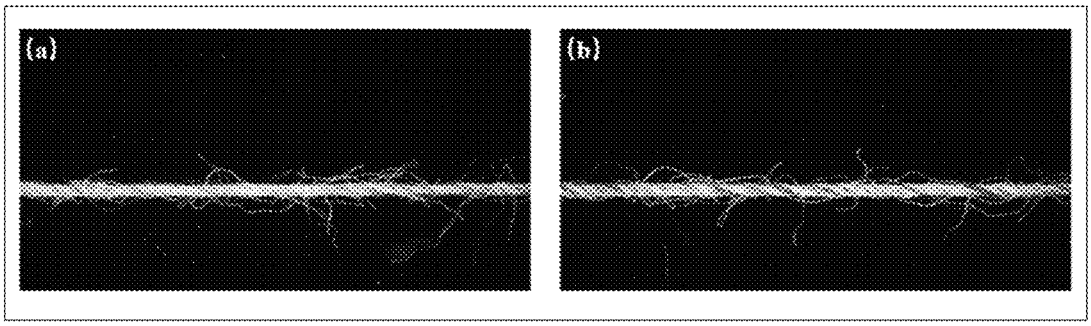
FIG. 14 illustrates micrographs of polyester-cotton wrapped-core yarns spun in the embodiment 2 and a comparative example 3, which are respectively shown in a and b of FIG. 14.

As illustrated in FIG. 14, (a) shows a polyester-cotton wrapped-core yarn spun by using the spinning device and method in the embodiment 2 under 35 times magnification using a 3D microscope. A material of a core yarn of the polyester-cotton wrapped-core yarn is 162D blue polyester yarn. A material of a staple fiber strand is 653 tex red colored cotton roving. Process parameters are as follows: a spindle speed is 11000 r/min, a twist is 104 T/10 cm, a speed of a front roller is 10.58 m/min, a total drafting multiple is 54.42, a linear density of cortical cotton fiber is 12.00 tex, and a back zone drafting multiple is 1.25. The core yarn ratio of the polyester-cotton wrapped-core yarn is 60%.

As can be seen from a of FIG. 14, in the polyester-cotton wrapped-core yarn spun in the embodiment 2, a blue polyester core yarn is completely covered by an outer red colored cotton fiber when the core yarn ratio is 60%. An overall yarn coating effect is good, and parallelism of an outer coated fiber is higher.

Comparative Example 3

Comparative example 3 provides a wrapped-core yarn device and method. The wrapped-core yarn device is a conventional ring spinning device. The method includes: gathering staple fiber strands around a core yarn and twisting the staple fiber strands to obtain a wrapped-core yarn. Used materials and process parameters in the comparative example are the same as those in the embodiment 2.

As illustrated in FIG. 14, (b) shows a polyester-cotton wrapped-core yarn spun in the comparative example 3 under 35 times magnification using a 3D microscope. As can be seen from (b) of FIG. 14, the structural uniformity of the wrapped-core yarn is poorer, and a blue polyester yarn is exposed seriously.

Embodiment 3

The embodiment 3 provides a spinning device and method. Compared with the embodiment 2, the difference is that the wrapped-core yarn in the embodiment 3 is a double twist yarn of a basalt filament and a flame-retardant polyester filament, a linear density of the core yarn is 48 tex, and a core yarn ratio of the wrapped-core yarn is 80%. The rest are basically the same as those in the embodiment 1, and will not be described herein.

Comparative Example 4

The comparative example 4 provides a wrapped-core yarn device and method. The wrapped-core yarn device is a conventional ring spinning device. The method includes: gathering staple fiber strands around a core yarn and twisting the staple fiber strands to obtain a wrapped-core yarn. Used materials and process parameters in the comparative example are the same as those in the embodiment 3.

Figure 15:
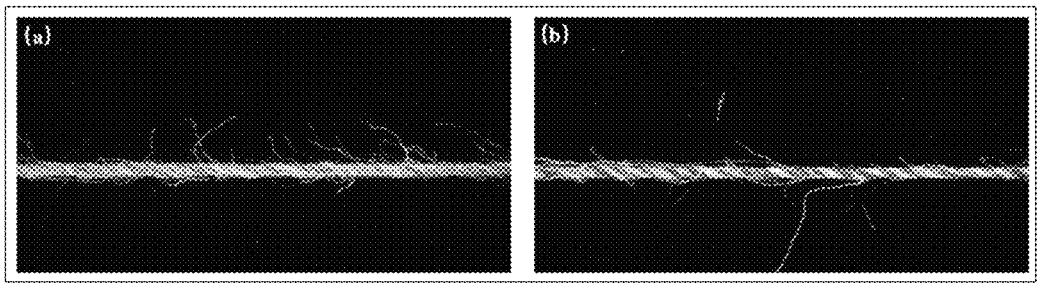
FIG. 15 illustrates micrographs of basalt/polyester/cotton wrapped-core yarns spun in an embodiment 3 and a comparative example 4, which are respectively shown in a and b of FIG. 15.

As illustrated in FIG. 15, (a) shows a basalt/polyester/cotton wrapped-core yarn spun by using the spinning device and method in the embodiment 2 under 35 times magnification using a 3D microscope; and b shows a basalt/polyester/cotton wrapped-core yarn spun in the comparative example 4 under 35 times magnification using a 3D microscope. As can be seen from FIG. 15, in the comparative example 4, an outer fiber of the conventional ring spinning wrapped-core yarn cannot completely cover the core yarn, and there is a serious exposure phenomenon.

The yarns spun in the embodiments 2-3 and the comparative examples 3-4 are compared in terms of core yarn ratio, breaking strength and elongation at break, and corresponding results are shown in Table 2.

TABLE 2

Comparative results of performance of yarns spun in the embodiments 2-3 and the comparative examples 3-4

| | Core yarn ratio (%) | Breaking strength (CN) ± Standard deviation | Elongation at break (%) ± Standard deviation |
|---|---|---|---|
| Embodiment 2 | 60 | 659.43 ± 12.69 | 23.82 ± 1.24 |
| Comparative example 3 | 60 | 603.32 ± 23.00 | 34.42 ± 3.18 |
| Embodiment 3 | 80 | 761.40 ± 21.55 | 7.95 ± 0.88 |
| Comparative example 4 | 80 | 713.03 ± 9.60 | 12.80 ± 0.98 |

As can be seen from Table 2, compared with the wrapped-core yarns made by conventional ring spinning method, the wrapped-core yarns spun in the embodiments 2-3 can greatly increase the core yarn ratio of the yarn, with the core yarn ratio as high as 80%, on the premise of ensuring the good covering effect of the wrapped-core yarn and no core exposure. In addition, the wrapped-core yarn spun by the spinning device and method of the embodiment 2-3 is closer to the wrapped-core yarn structure in the ideal state in the yarn structure, and the core yarn of the wrapped-core yarn mainly bears stress during a stretching process. However, the wrapped-core yarn spun by the conventional ring spinning core spinning method is similar to a Sirofil yarn in the yarn structure, and the core yarn is seriously exposed. During a stretching process of the wrapped-core yarn spun by the conventional ring core spinning method, the core yarn and the staple fiber strands are jointly stressed, and the core yarn is subjected to a greater shear force, as such, the breaking strength of the wrapped-core yarn in the comparative example 3 is lower than the breaking strength of the wrapped-core yarn in the embodiment 2, the breaking strength of the wrapped-core yarn in the comparative example 4 is lower than the breaking strength of the wrapped-core yarn in the embodiment 3, the elongation at break of the wrapped-core yarn in the comparative example 3 is greater than the elongation at break of the wrapped-core yarn in the embodiment 2, and the elongation at break of the yarn in the comparative example 4 is greater than the elongation at break of the wrapped-core yarn in the embodiment 3.

Embodiment 4

Figure 16:
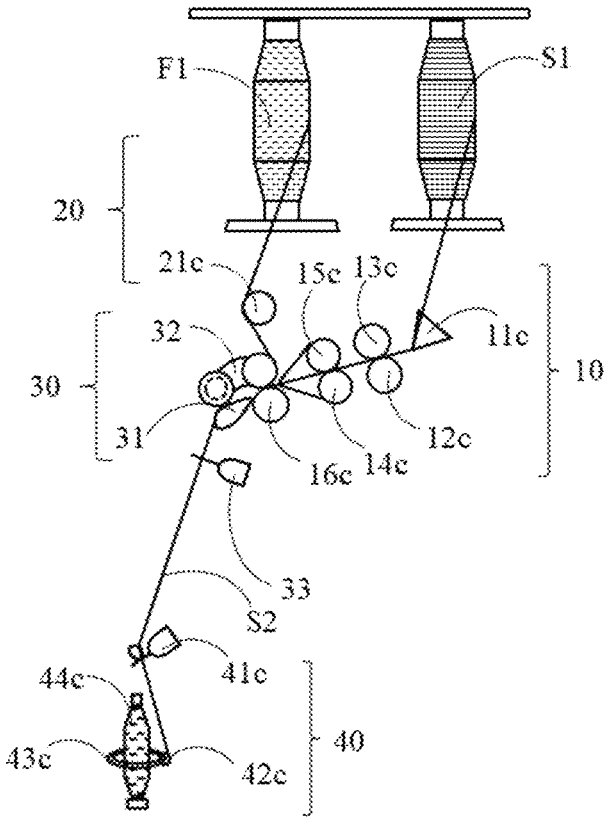
FIG. 16 illustrates a schematic structural diagram of a spinning device according to an embodiment 4.
Figure 17:
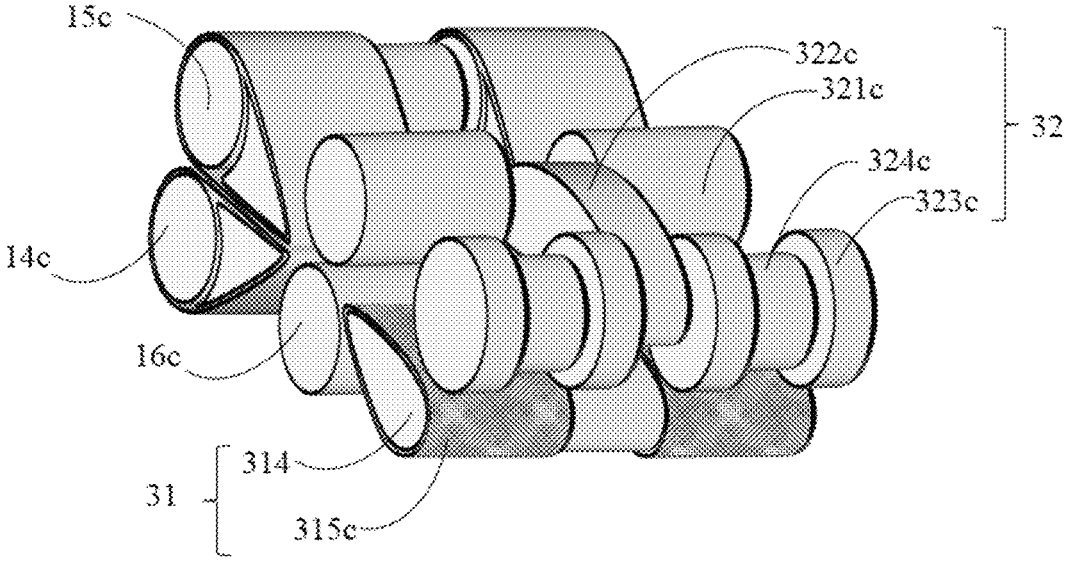
FIG. 17 illustrates a schematic view of a partial structure of an auxiliary core-wrapping unit in the embodiment 4.
Figure 18:
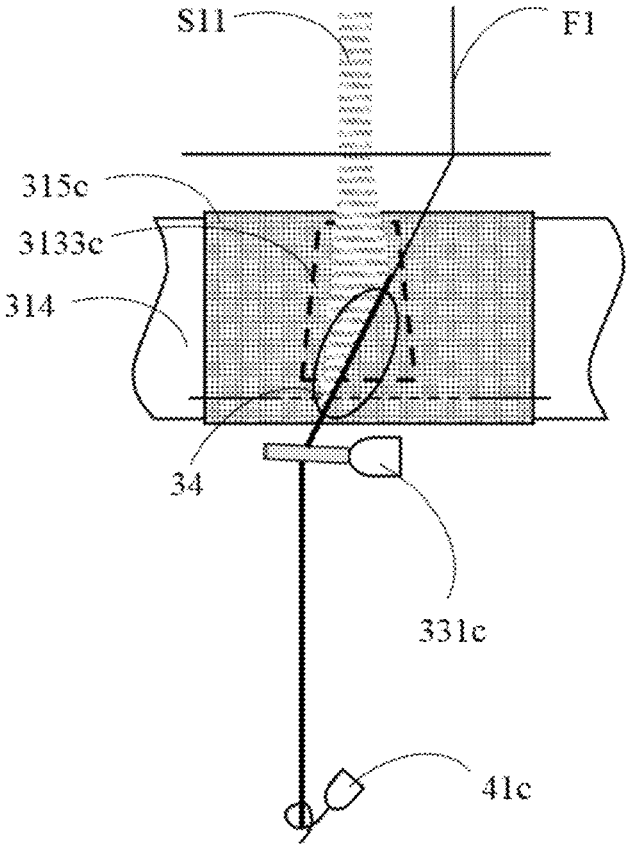
FIG. 18 illustrates a schematic diagram of a spinning method according to the embodiment 4.

As illustrated in FIG. 16 through FIG. 18, the auxiliary core-wrapping assembly 31 widens and expands the staple fiber strand S11 to form widened strand, and the widened strand stably cover a core yarn to obtain a wrapped-core yarn S2. The yarn guiding assembly 33 is a yarn guiding rod 331*c*, and the yarn guiding rod 331*c* is provided with a heating groove with a temperature of 100-200° C. A temperature setting principle and function of the heating groove are the same as those of the heating groove 332*a*. The yarn guiding rod 331*c* changes a transmission path of the wrapped-core yarn S2 output from the auxiliary core-wrapping unit 30 through the heating groove, and conveys the wrapped-core yarn S2 to the yarn winding unit 40.

In this device, through cooperation operation of the auxiliary core-wrapping unit 30, the staple fiber feeding unit 10 and the core yarn feeding unit 20, by using a grid circle 315*c* covered on a special shaped pipe 314 of the auxiliary core-wrapping unit 30, the widened strands formed after fiber opening and expansion are uniformly coated on an outer layer of the core yarn F1, and the wrapped-core yarn with good coating effect and a ratio of the core yarn F1 to the wrapped-core yarn S2 accounting for 60%-70% is obtained. Its advantages are the same as those of the embodiment 1, so it will not be described herein.

As illustrated in FIG. 17, the auxiliary core-wrapping assembly 31 includes the special shaped pipe 314 and the grid circle 315*c* covered on a surface of the special shaped pipe 314. The grid circle 315*c* only allows airflow to pass therethrough, which widens and spreads the staple fiber strand S11 to form the widened strands, and plays a role in supporting and transporting the widened strands. The grid circle 315*c* is driven by the pressurizing/conveying assembly 32 to rotate forward along the special shaped pipe 314, and drives the widened strands attached to the surface of the grid circle 315*c* to convey forward, so that the core yarn F1 is coated by the widened strands in the wrapping area 34 to form the wrapped-core yarn S2. In this way, the grid circle 315*c* which rotates along the special shaped pipe 314 is used to expand and spread the staple fiber strand S11 to form the widened strands, and the grid circle 315*c* only supports and transports the widened strands, and no twist is applied to the widened strands, so that a fiber layer (i.e., the widened strands) with a certain width, high fiber parallelism and uniform fiber distribution is formed on the surface of the grid circle 315*c*. After the fiber layer converges with the core yarn F1 in the wrapping area 34, the fiber layer is uniformly wrapped around the surface of the core yarn F1 by utilizing the rotation of the core yarn F1.

Particularly, the auxiliary core-wrapping assembly 31 further includes a negative pressure suction port 3133*c* disposed on the special shaped pipe 314, and the negative pressure suction port 3133*c* is covered by the grid circle 315*c* disposed on the surface of the special shaped pipe 314. The negative pressure suction port 3133*c* adsorbs the widened strand on the surface of the grid circle 315*c* under negative pressure, so that the widened strand formed on the surface of the grid circle 315*c* are further widened and spread in a fiber-opening manner, and a fiber layer with a larger width and higher parallelism is formed. In this way, by arranging the negative pressure suction port 3133*c* on the special shaped pipe 314, a clamping force of the grid circle 315*c* on the widened strands is increased, and a flatness of the widened strand is increased. Functions of the negative pressure adsorption assembly 3132*b* and the negative pressure suction port 3133*c* in this embodiment are basically the same as those of the negative pressure suction assembly in the embodiment 1, which is not repeated herein.

Specifically, the negative pressure suction port 3133*c* has one of the following three structures: air inlets uniformly distributed on the special shaped pipe 314, equal-width air inlets formed along a curved surface of the special shaped pipe 314, or air inlets disposed on the special shaped pipe 314 and gradually widened along a conveying direction of the widened strands on the grid circle 315*c*. After the negative pressure suction port 3133*c* of the disclosure adsorbs the staple fiber strand S11, the staple fiber strand S11 are widened and spread on the grid circle 315*c* to form the widened strand, which are evenly dispersed, thereby forming a fiber layer with a uniform structure, which is beneficial to the uniform coating of the core yarn F1 by the widened strand.

More specifically, when the negative pressure suction port 3133*c* has equal-width air inlets formed along the curved surface of the special shaped pipe 314, a width of the negative pressure suction port 3133*c* is 5-10 mm; when the negative pressure suction port 3133*c* has air inlets disposed on the special shaped pipe 314 and gradually widened along the conveying direction of the widened strand on the grid circle 315*c*, a width of a narrowest portion of the negative pressure suction port 3133*c* is 5-7 mm, as such, the widening and expanding of the staple fiber strand S11 with a diameter of 1-3 mm is achieved, and widened strand with interactive force are formed. In this way, by limiting the shape and size of the negative pressure suction port 3133*c*, it is avoided that when the negative pressure suction port 3133*c* adsorbs the widened strand, the widened strands will gather on the grid circle 315*c*, which will affect the subsequent winding effect of the core yarn F1.

The pressurizing/conveying assembly 320 includes a front top roller 321*c*, a drive top roller 323*c*, and a bridge component 322*c* connecting the front top roller 321*c* and the drive top roller 323*c*. The front top roller 321*c* is configured to drive the bridge component 322*c* to make the drive top roller 323*c* rotate synchronously. The drive top roller 323*c* is in contact with the grid circle 315*c* and is configured to drive the grid circle 315*c* to rotate forward. A middle of the drive top roller 323*c* is provided with a roller groove 324*c* with a certain width, and protrusions at two ends of the drive top roller 323*c* are convenient for pressing the grid circle 315*c* and driving grid circle 315*c* to rotate and convey. The roller groove 324*c* is convenient for the widened strands and the core yarn F1 to pass between the drive top roller 323*c* and the grid circle 315*c*. A width of the roller groove 324*c* is preferably one third of a width of the drive top roller 323*c*.

In some specific embodiments, a bridge gear exists in the bridge component 322*c*, which is connected with a shaft core of the front top roller 321*c* and a shaft core of the drive top roller 323*c* to realize power transmission.

Specifically, the feeding unit further includes a front roller 16*c* disposed at an input end of the auxiliary core-wrapping unit 30. The staple fiber feeding unit 10 includes a bell mouth 11*c*, a rear roller 12*c*, a rear top roller 13*c*, a middle roller 14*c* and a middle top roller 15*c*, which are sequentially arranged along a feeding direction of the roving S1 in that order. After the roving S1 is stretched into staple fiber strand S11 by the staple fiber feeding unit 10, the staple fiber strand S11 are output to the special shaped pipe 314 through the front roller 16*c*, and are adsorbed on the grid circle 315*c* by the negative pressure suction port 3133*c*. The staple fiber strands are widened and expanded to form widened strands or even a fiber layer with a more uniform structure. The core yarn feeding unit 20 includes a godet 21*c* is configured to change an angle of the core yarn F1. The core yarn F1 is guided by the godet 21*c*, is output from a nip formed by engaging the front roller 16*c* and the front top roller 321*a* at a certain angle, and converges with the widened strands on the grid circle 315*c* in the wrapping area 34 at a certain angle. The core yarn F1 rotates to drive the widened strands adsorbed by the grid circle 315*c* to wrap around an outer layer of the core yarn F1 to form the wrapped-core yarn S2.

The godet 21*c* of the core yarn feeding unit 20 can change the angle of the core yarn F1 to control a range of an included angle between the core yarn F1 and the widened strands in the wrapping area to be 5°-65°, so that the widened strands can better rotate and wrap the surface of the core yarn F1. The staple fiber feeding unit 10 is configured to stretch the roving S1 to obtain the staple fiber strand S11, and the obtained staple fiber strand S11 are fed into the core yarn feeding unit 20 to widen and expand the staple fiber strand S11 and thereby form widened strands. The yarn guiding rod 331*c* is disposed on a path for outputting the wrapped-core yarn of the auxiliary core-wrapping assembly 31, and the position of the yarn guiding rod 331*c* satisfies a condition that an angle of the staple fiber strand S11 when staple fiber strand S11 are input into the auxiliary core-wrapping unit 30 is the same as an angle of the widened strand when the widened strands are transported in the auxiliary core-wrapping unit 30. As such, the widened strands can be conveyed in a natural state in the auxiliary core-wrapping unit 30 without changing the angle thereof. In this way, not only the integrity of the widened strands or the formed fiber layer can be maintained and aggregation thereof is avoided, but also it is beneficial for the core yarn F1 to drive the widened strands to cover a surface of the core yarn F1 and form the wrapped-core yarn S2.

Limitation of the position of the yarn guiding rod 331*c* play the same role as limitation of the position of the heating groove 332*b* in the yarn guiding assembly 33 in the embodiment 2.

Compared with the core spinning device in the related art, the spinning device of this embodiment of the disclosure has the same advantages as in the embodiment 1. In addition, when the staple fiber strand S11 encounter breakage or other operational issues, the difficulty for workers to repair is lower, and no additional unnecessary operations on the spinning device are required.

As illustrated in FIG. 18, FIG. 18 illustrates a schematic diagram of a spinning method, which is implemented by the spinning device according to the embodiment 4. The specific method is as follows.

The staple fiber feeding unit 10 stretches the roving S1 into the staple fiber strand S11 and feeds the staple fiber strand S11 into the auxiliary core-wrapping assembly 31 of the auxiliary core-wrapping unit 30. The staple fiber strand S11 are adsorbed on the grid circle 315*c* by the negative pressure suction port 3133*c* on the special shaped pipe 314. The staple fiber strand S11 are widened and expended to form widened strands. The grid circle 315*c* is driven by the pressure/conveying assembly 32 to rotate forward, and the widened strands attached to the surface of the grid circle 315*c* are driven to transport forward.

Simultaneously, the core yarn F1 is guided by the godet 21*c*, is output at a certain angle through a nip of the front roller 16*c*, and converges with the widened strands on the grid circle 315*c* at a certain angle in the wrapping area 34. Then the core yarn F1 rotates to drive the widened strands adsorbed by the grid circle 315*c* to wrap around an outer layer of the core yarn F1 to form a wrapped-core yarn S2.

A transmission path of the wrapped-core yarn S2 is changed by the yarn guiding rod 331*c*, so that a structure of the wrapped-core yarn S2 is more stable, and the wrapped-core yarn S2 is conveyed to the guide hook 41*c* of the yarn winding unit 40, and the wrapped-core yarn S2 is wound on a ring bobbin 44*c* by the traveler 42*c* rotating at higher speed on a steel ring 43*c*, thereby the steady-state wrapped-core yarn process is completed.

In particular, a spacing between the wrapping area 34 and the nip of the front roller 16*c* is greater than a fiber length of the staple fiber strand S11. A spacing between the wrapping area 34 and the nip of the front roller 16*c*, a spacing between the core yarn F1 and the staple fiber strand S11, and an included angle between the core yarn F1 and the staple fiber strand S11 are basically the same as those in the embodiment 2.

In this spinning method, after being guided by the godet 21*c*, the core yarn F1 is separated from the staple fiber strand S11 by a certain spacing, and then the core yarn F1 is fed to the front roller 16*c*. Then the core yarn F1 is output through the nip of the front roller 16*c*, and converges with the widened strands conveyed forward by the grid circle 315*c* in the wrapping area 34 at a certain angle, so that the core yarn F1 can be rotated to drive the widened strands adsorbed by the grid circle 315*c* to wrap around an outer layer of the core yarn F1 to form a wrapped-core yarn with a uniform covering structure. In addition, the spacing between the wrapping area 34 and the nip of the front roller 16*c* is greater than the fiber length of the staple fiber strands, so that the widened strands can be wrapped on the outer layer of the core yarn F1 by better utilizing the rotation of the core yarn F1. Further, the high-speed rotation of the core yarn F1 can also produce a certain stretching effect on the widened strands, further improving the yarn quality of the wrapped-core yarn.

As illustrated in FIG. 18, FIG. 18 illustrates a basalt wrapped-core yarn with a linear density of 43.57 tex spun by the spinning method of the spinning device in the embodiment 4 under 35 times magnification using a 3D microscope. A material of a core yarn of the basalt wrapped-core yarn is 25 tex basalt filament and 50D flame retardant polyester filament. A material of a staple fiber strand is 735 tex cotton fiber roving. Process parameters are as follows: a spindle speed is 11000 r/min, a twist is 90 T/10 cm, a speed of a front roller is 12.22 m/min, a total drafting multiple is 56.24, and a back zone drafting multiple is 1.15. A core yarn ratio of the basalt wrapped-core yarn is 70%.

Figure 19:
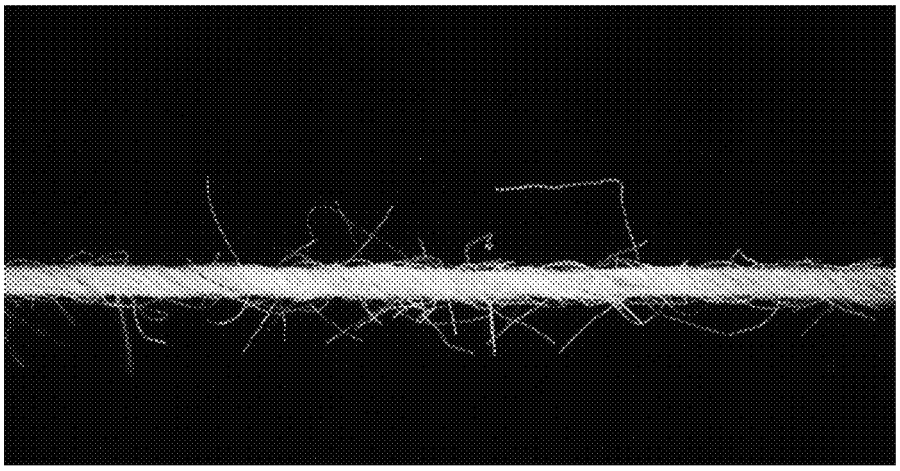
FIG. 19 illustrates a micrograph of a basalt wrapped-core yarn spun in the embodiment 4.

It can be clearly seen from FIG. 19 that when the core yarn ratio is 70%, the wrapped-core yarn is completely covered by the outer fibers in the basalt wrapped-core yarn without exposure. The overall yarn coating effect is good, and the parallelism of the outer coated fiber is higher.

Embodiment 5

The embodiment 5 provides a spinning device and method. Compared with the embodiment 4, in the embodiment 5, a material of a core yarn is 12 tex basalt filament and 20D flame-retardant nylon filament, a material of a staple fiber strand is 600 tex flame retardant nylon, aramid fiber 1313 and flame retardant viscose composite staple fiber roving (a blending ratio is 55/35/10). In the embodiment 5, process parameters are as follows: a spindle speed: is 8500 r/min, a twist is 75 T/10 cm, a speed of the front roller is 11.33 m/min, a total drafting multiple is 63.36, and a back zone drafting multiple is 1.65.

Figure 20:
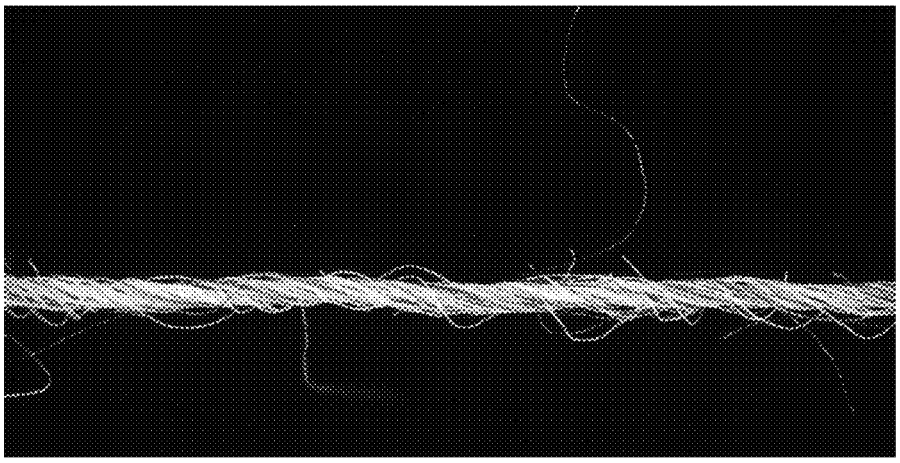
FIG. 20 illustrates a micrograph of a basalt wrapped-core yarn spun in an embodiment 5.

As illustrated in FIG. 20, FIG. 20 illustrates a basalt wrapped-core yarn with a linear density of 23.67 tex spun by the spinning method of the spinning device in the embodiment 5 under 50 times magnification using a 3D microscope. A core yarn ratio of the basalt wrapped-core yarn is 60%. As can be seen from FIG. 20 that when the core yarn ratio is 60%, the core yarn is completely covered by the outer fibers in the basalt wrapped-core yarn without exposure. The overall yarn coating effect is good, and the parallelism of the outer coated fiber is higher.

Comparative Example 5

The comparative example 5 provides a wrapped-core yarn device and a method thereof. The wrapped-core yarn device is a conventional ring spinning device without the auxiliary core-wrapping assembly 31 as in the embodiment 4. The method in the comparative example 5 includes: gathering staple fiber strands around a core yarn and twisting the staple fiber strands to obtain a wrapped-core yarn. A material of a core yarn is 162D blue polyester yarn. A material of a staple fiber strand is 653 tex red colored cotton roving. Process parameters are as follows: a spindle speed is 11000 r/min, a twist is 104 T/10 cm, a speed of a front roller is 10.58 m/min, a total drafting multiple is 54.42, a linear density of cortical cotton fiber is 12.00 tex, and a back zone drafting multiple is 1.25. A core yarn of the wrapped-core yarn is 60%.

Figure 21:
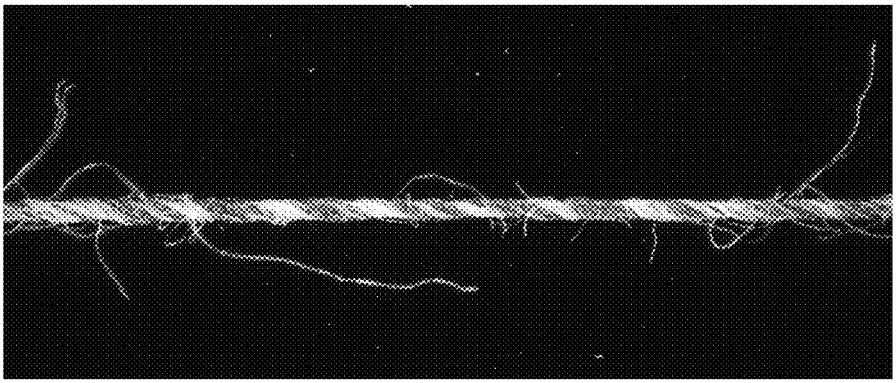
FIG. 21 illustrates a micrograph of a wrapped-core yarn spun in a comparative example 5.
Figure 22:
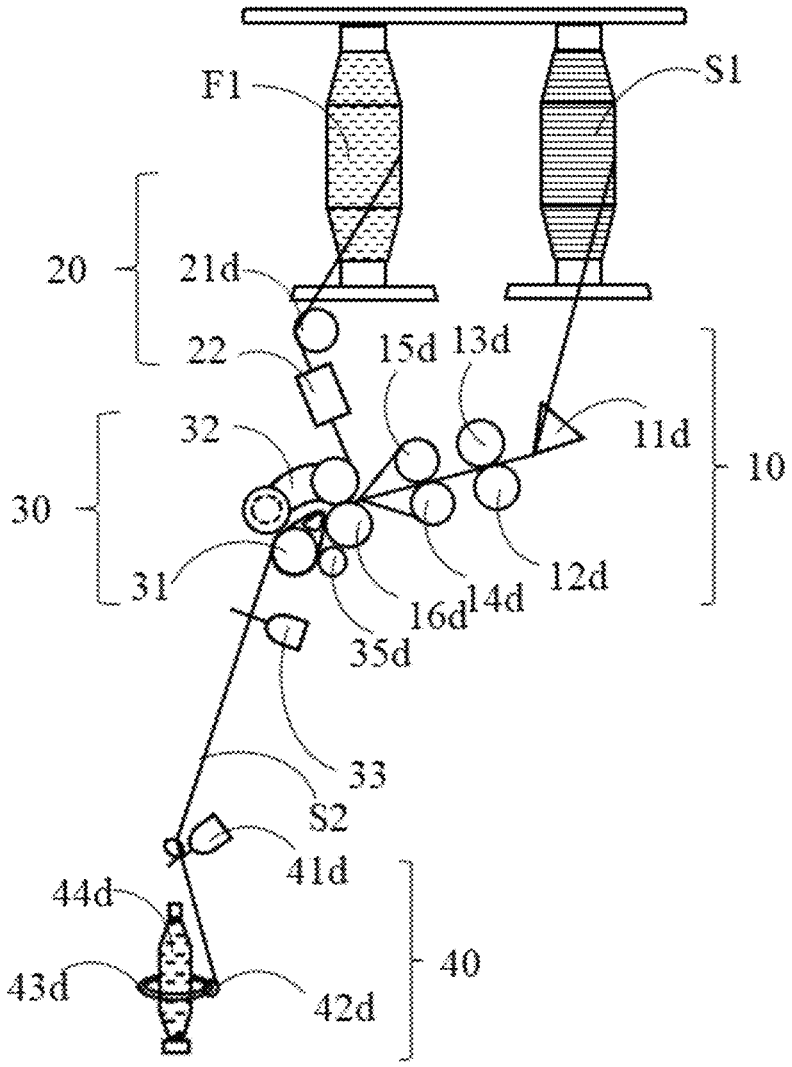
FIG. 22 illustrates a schematic structural diagram of a spinning device according to an embodiment 6.

As can be seen from FIG. 21, compared with the embodiment 5, in the case of the same core yarn ratio, an outer fiber of the conventional ring spinning wrapped-core yarn cannot completely cover the core yarn, and there is a serious exposure phenomenon. The overall yarn coating effect is poorer. This wrapped-core yarn is difficult to be applied in practical production. To improve this situation, the core yarn ratio can only be sacrificed. Therefore, the core yarn ratio of the traditional ring spinning wrapped-core yarn is relatively lower, it is possible to obtain a wrapped-core yarn with an outer fiber well wrapped around the core yarn when the core yarn ratio is about 15%.

Embodiment 6

As illustrated in FIG. 22 through FIG. 25B, the core yarn feeding unit 20 is provided with an electrostatic fiber opening assembly 22 and a threaded guide rod. The electrostatic fiber opening assembly 22 is configured to electrostatically open a core yarn F1 (which is a multifilament) to form expanded ribbon-like filaments F11, and the ribbon-like filaments F11 are input into the auxiliary core-wrapping unit 30 through the threaded guide rod. The staple fiber feeding unit 10 stretches a roving S1 into staple fiber strand S11 and feeds the staple fiber strand S11 into the auxiliary core-wrapping unit 30. The ribbon-like filaments F11 formed after electrostatic filament opening partially or completely overlap with the staple fiber strand S11 in the auxiliary core-wrapping unit 30. The auxiliary core-wrapping assembly 31 is a negative pressure absorption assembly 3132*d*. The negative pressure absorption assembly 3132*d* opens the staple fiber strand S11 fed into the auxiliary core-wrapping unit 30, further expands the ribbon-like filaments F11 fed into the auxiliary core-wrapping unit 30, and embeds or partially embeds the staple fiber strand S11 with the ribbon-like filaments F11 to form a wrapped-core yarn S2. The wrapped-core yarn S2 is collected and wound by the yarn winding unit 40.

In particular, for the spinning device of the embodiment 6, the electrostatic fiber opening assembly 22 is disposed in the core yarn feeding unit 20 and is used to open the core yarn F1 to obtain the ribbon-like filaments F11, and the auxiliary core-wrapping unit 30 is used to open the staple fiber strand S11 and further expand the ribbon-like filaments F11, so that the staple fiber strand S11 and the ribbon-like filaments F11 are completely or partially overlapped and embedded with each other, and then automatically wrapped by the rotation of the ribbon-like filaments F11 and the acting force between the staple fiber strand S11 to form a wrapped-core yarn with a sandwich structure, which greatly increases the proportion of the ribbon-like filaments F11 in the wrapped-core yarn and its mechanical properties, while reducing a hairiness index. The spinning method and the spinning device of the disclosure overcome the technical problems of poorer wrapping effect and higher hairiness index caused by the fact that the staple fiber strand S11 and the filament (i.e., core yarn) of the traditional ring spinning wrapped-core yarn cannot be spread and are difficult to hold, and are of great significance for improving the comprehensive performance of the wrapped-core yarn.

Figure 23:
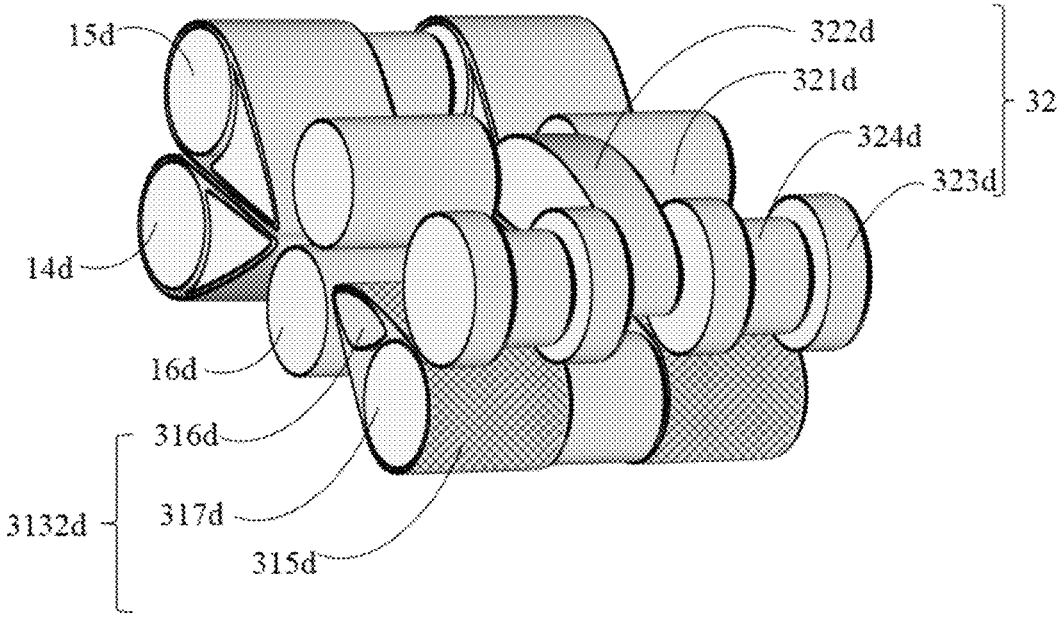
FIG. 23 illustrates a schematic view of a partial structure of an auxiliary core-wrapping unit in FIG. 22.

As illustrated in FIG. 23, the auxiliary core-wrapping assembly 31 is a negative pressure absorption assembly

3132*d*. The negative pressure absorption assembly 3132*d* includes a special shaped air suction plate 316*d*, a drive roller 317*d*, a grid circle 315*d* sleeved on outer surfaces of the special shaped air suction plate 316*d* with grid holes shown in FIG. 13 and the drive roller 317*d*. The air suction assembly adsorbs the staple fiber strand S11 and the ribbon-like filaments F11 on the surface of the grid circle 315*d* under negative pressure. The pressurizing/conveying assembly 32 includes a transmission gear 35*d* and an auxiliary conveying component disposed opposite to the grid circle 315*d*. The grid circle 315*d* is powered by the transmission gear 35*d* and the auxiliary conveying component, rotates and transports forward along the special shaped air suction plate 316*d*, and drives the staple fiber strand S11 and the ribbon-like filaments F11 attached to the grid circle 315*d* to transport forward. In this way, the negative pressure adsorption assembly 3132*d* of the auxiliary core-wrapping unit 30 is used to open the staple fiber strand S11, which does not generate a gathering force on the staple fiber strand S11, and at the same time, the ribbon-like filaments F11 is further expanded by the negative pressure adsorption assembly 3132*d*, so that the staple fiber strand S11 and the ribbon-like filaments F11 are partially or completely overlapped and embedded on a surface of the grid circle 315*d*. The rotation of the ribbon-like filaments F11 drives the staple fiber strand S11 embedded with the ribbon-like filaments F11 to be wrapped on the surface of the ribbon-like filaments F11, and the ribbon-like filaments F11 and the staple fiber strand S11 are further wrapped by the force between the staple fiber strand S11 to form a wrapped-core yarn S2 with a sandwich structure.

Specifically, the negative pressure adsorption assembly 3132*d* further includes the special shaped air suction plate 316*d* with surface grid holes shown in FIG. 13. The special shaped air suction plate 316*d* is covered by the grid circle 315*d*, and a narrowest width of the negative pressure suction port 3133*d* is not less than a width of the staple fiber strand S11 and is not less than a width of the ribbon-like filaments F11. The negative pressure adsorption assembly 3132*d* is configured to adsorb the staple fiber strand S11 and the ribbon-like filaments F11 to a surface of the grid circle 315*d* through the negative pressure suction port 3133*d*, so that the staple fiber strand S11 are opened and the ribbon-like filaments F11 are further expanded. In this way, by defining the shape and size of the negative pressure suction port 3133*d*, when the staple fiber strand S11 and the ribbon-like filaments F11 pass through the grid circle 315*d*, no twist is exerted by the grid circle 315*d* on the staple fiber strand S11 and the ribbon-like filaments F11, the staple fiber strand S11 and the ribbon-like filaments F11 do not gather, and the grid circle 315*d* only plays the role of supporting and conveying the staple fiber strand S11 and the ribbon-like filaments F11. At the same time, under the guiding spreading effect of negative pressure air flow, the fiber opening of the staple fiber strand S11 is realized to obtain the staple fiber strands with a certain width, uniform fiber distribution and certain interaction force. The staple fiber strands are completely or partially overlapped and embedded with the ribbon-like filaments F11, and the ribbon-like filaments F11 are wrapped by the surrounding staple fiber strands by the rotation of the ribbon-like filaments F11, and at the same time, the ribbon-like filaments F11 and the staple fiber strands are further twisted and wrapped by the acting force between the staple fiber strands, and finally a layered structure wrapped-core yarn with tight clamping between the ribbon-like filaments F11 and the staple fiber strand S11 is formed, which improves the mechanical properties of the wrapped-core yarn and has application value in the fields of high-grade sewing, textile clothing, military uniform, protective clothing and the like.

In an embodiment, the negative pressure suction port 3133*d* has air inlets with a same width along a conveying direction of the staple fiber strand S11 and the ribbon-like filaments F11, or the negative pressure suction port 3133*d* has air outlets gradually widened along the conveying direction of the staple fiber strand S11 and the ribbon-like filaments F11, so as to realize the fiber opening of the staple fiber strand S11 and the expansion of the ribbon-like filaments F11. A narrowest width of the negative pressure suction port 3133*d* is 5-10 mm.

The core yarn feeding unit 20 further includes a godet 21*d* configured to change an angle of the core yarn F1. After being guided by the godet 21*d*, the core yarn F1 is input into the electrostatic fiber opening assembly 22 at a certain angle, and the core yarn F1 is electrostatically opened to form ribbon-like filaments F11. Excess static electricity of the ribbon-like filaments F11 is eliminated through the threaded guide rod, after that, the ribbon-like filaments F11 enter the auxiliary core-wrapping unit 30, and partially or completely overlap and embed with the staple fiber strand S11 fed by the staple fiber feeding unit 10, and the ribbon-like filaments F11 rotate to drive the staple fiber strand S11 to wrap and form the wrapped-core yarn S2.

In some specific embodiments, the threaded guide rod is disposed at an outlet of the electrostatic fiber opening assembly 22, and the ribbon-like filaments F11 obtained after yarn opening pass through the threaded guide rod, so that the static electricity carried by the ribbon-like filaments F11 can be eliminated, the negative influence of static electricity on the further expansion of the ribbon-like filaments F11 can be avoided, and the safety of the subsequent spinning process can also be ensured.

The auxiliary conveying component includes a front top roller 321*d*, a drive top roller 323*d*, and a bridge component 322*d* connecting the front top roller 321*d* and the drive top roller 323*d*. The front top roller 321*d* is configured to drive the bridge part 322*d* to synchronously rotate the drive top roller 323*d*. The drive top roller 323*d* is in contact with the grid circle 315*d*, and is configured to drive the grid circle 315*d* to rotate and transport forward stably. In this way, the auxiliary conveying component is disposed above the negative pressure adsorption assembly 3132*d*, and the drive top roller 323*d* is contact with the grid circle 315*d*, such that the grid circle 315*d* is driven to rotate by the joint action of the drive top roller 323*d* and the transmission gear 35*d*, and the transmission of the grid circle 315*d* is more stable, which provides stable conditions for the wrapping process of the ribbon-like filaments F11 and the staple fiber strand S11, and is beneficial to the successful preparation of industrial wrapped-core yarn.

Specifically, the feeding unit further includes a front roller 16*c* disposed at an input end of the auxiliary core-wrapping unit 30. The staple fiber feeding unit 10 includes a bell mouth 11*d*, a rear roller 12*d*, a rear top roller 13*d*, a middle roller 14*d*, a middle top roller 15*d* and a front top roller 217, which are sequentially arranged along a feeding direction of the roving S1 in that order. The front roller 16*c* and the front top roller 321*d* are engaged to form a front roller nip, and both the staple fiber strand S11 and the ribbon-like filaments F11 are input into the auxiliary core-wrapping unit 30 through the front roller nip formed by the meshing of the front roller 16*c* and the front top roller 321*d*.

A spinning method is provided, which is implemented by the spinning device in the embodiment 6. The method specifically includes steps S1 to S4:

In step S1, the staple fiber feeding unit 10 stretches the roving S1 into the staple fiber strand S11, and inputs staple fiber strands into the auxiliary core-wrapping unit 30 through the front roller nip between the front roller 16*d* and the front top roller 321*d*. After the core filaments F1 is guided by the godet 21*d*, the core filaments F1 is electrostatically opened by the electrostatic fiber opening assembly 22 to form ribbon-like filaments F11, and ribbon-like filaments F11 are fed into the front roller nip through the threaded godet and input into the auxiliary core-wrapping unit 30 through the front roller nip.

In step S2, the negative pressure absorption assembly 3132*d* in the auxiliary core-wrapping unit 30 adsorbs the staple fiber strand S11 and the ribbon-like filaments F11 on the surface of the grid circle 315*d* under negative pressure, so that the staple fiber strand S11 are opened and the ribbon-like filaments F11 are further expanded. The staple fiber strand S11 and ribbon-like filaments F11 are partially or completely overlapped and embedded with each other.

In step S3, the grid circle 315*d* is powered by the transmission gear 35*d* and the auxiliary conveying component, and rotates and transports forward along the special shaped air suction plate 316*d* and the drive roller 317*d*, and drives the staple fiber strands S11 and the ribbon-like filaments F11 attached to the grid circle 315*d* to transport forward. During the conveying process, filaments in the ribbon-like filaments F11 rotates to drive the staple fiber strand S11 embedded with the filaments to be wrapped around the outer layer of the filaments, and the staple fiber strand S11 and the filaments are further wrapped by the acting force between the staple fiber strand S11 to form a wrapped-core yarn S2.

In step S4, a transmission path of the wrapped-core yarn S2 is changed through the yarn guiding assembly 33, so that a structure of the wrapped-core yarn S2 is more stable, and the wrapped-core yarn is wound around a guide hook 41*d*, a steel ring 43*d* and a traveler 42*d* of the yarn winding unit 40 in turn, and finally wound on the ring bobbin 44*d* of the yarn winding unit 40, thus completing the double-opening and embedded spinning process of staple fiber strands and filaments. The yarn guiding assembly 33 is a yarn guiding rod.

Specifically, a spacing between an axis of the staple fiber strand S11 along a length direction thereof at the front roller nip and an axis of the ribbon-like filaments F11 along a length direction thereof at the front roller nip is 0-5 mm, so as to realize partial or complete overlapping and embedding of the staple fiber strand S11 and the ribbon-like filaments F11 in the auxiliary core-wrapping unit 30. In this embodiment, firstly, the core yarn F1 is opened by the electrostatic fiber opening assembly 22 to form ribbon-like filaments F11 with a certain width, and then the spacing between the ribbon-like filaments F11 and the staple fiber strand S11 obtained by stretching before entering the auxiliary core-wrapping unit 30 through the front roller nip between the front roller 16*d* and the front top roller 321*d* is controlled. When the axis of the staple fiber strand S11 at the front roller nip and the axis of the ribbon-like filaments F11 at the front roller nip coincide, the yarn guiding rod, the axis of the staple fiber strand S11, and the axis of the ribbon-like filaments F11 are arranged on the same straight line. When a spacing between the axis of the staple fiber strand S11 at the front roller nip and the axis of the ribbon-like filaments F11 at the front roller nip is not zero, the yarn guiding rod is arranged at a position where the wrapped-core yarn is output from the auxiliary core-wrapping unit 30 at an angle of 5°-30°.

In this way, by adjusting the spacing between the axis of the staple fiber strand S11 at the front roller nip between the front roller 16*d* and the front top roller 321*d* and the axis of the ribbon-like filaments F11 at the front roller nip between the front roller 16*d* and the front top roller 321*d*, that is, adjusting the position where the staple fiber strand S11 and the ribbon-like filaments F11 enter the front roller nip, the staple fiber strand S11 and the ribbon-like filaments F11 are partially or completely overlapped and embedded in the auxiliary core-wrapping unit 30. By limiting the position of the yarn guiding rod, the automatic winding of the ribbon-like filaments F11 and staple fiber strand S11 is realized, so that the preparation of wrapped-core yarns with different structures is realized, and the application of wrapped-core yarns with different requirements is specifically met.

Figure 24A:
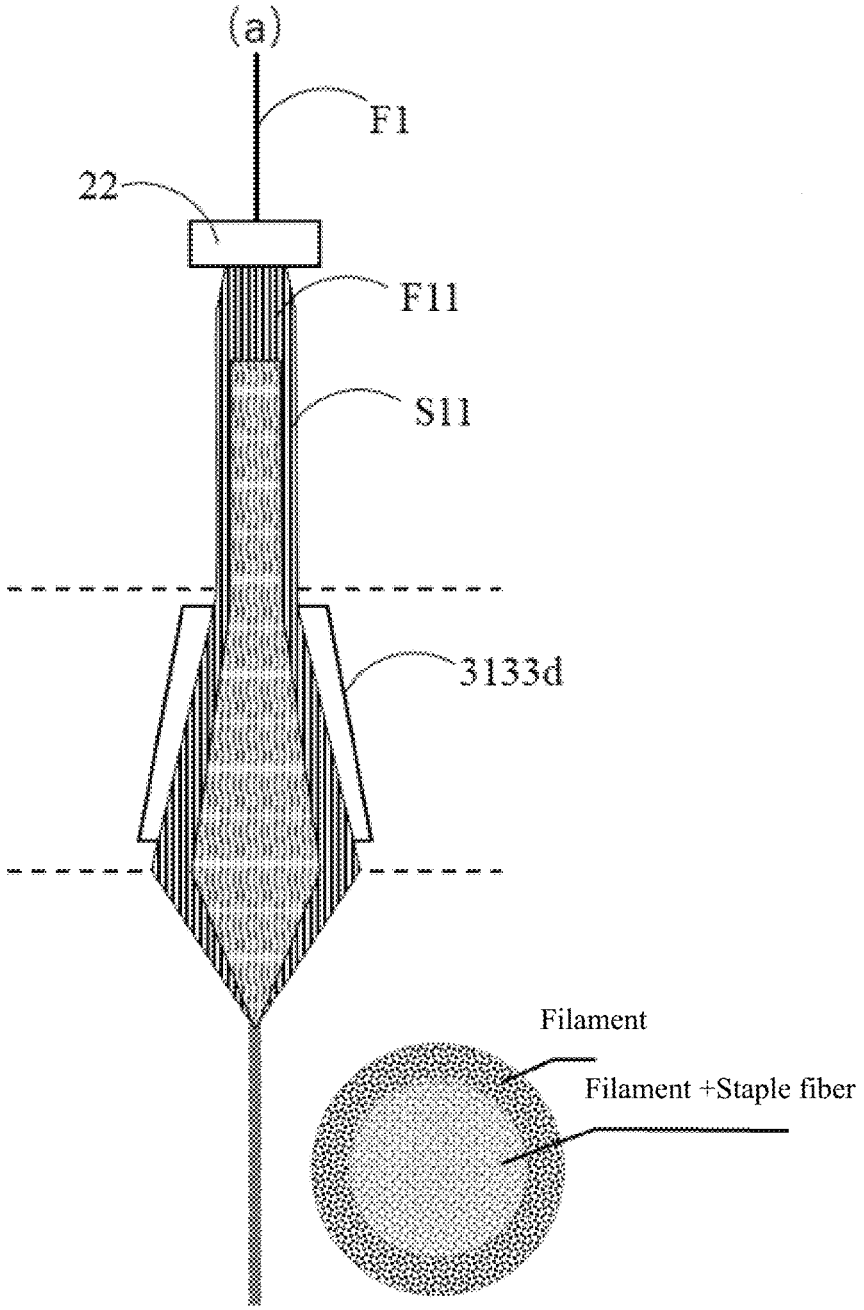
FIG. 24A through FIG. 24C illustrate a preparation process and a schematic structural diagram of a wrapped-core yarn when an axis of a staple fiber strand and an axis of a ribbon-like fiber are coincided and input in a front roller nip.
Figure 24B:
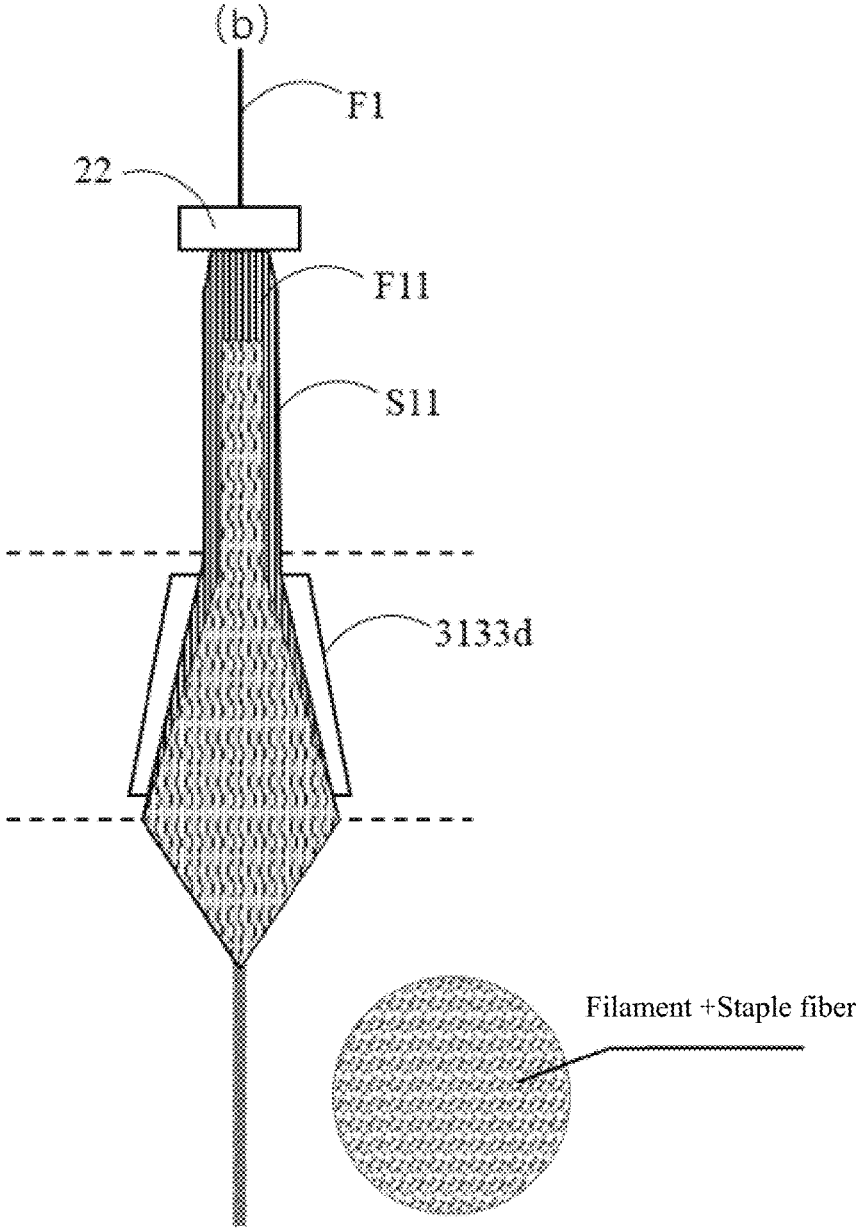
Figure 24C:
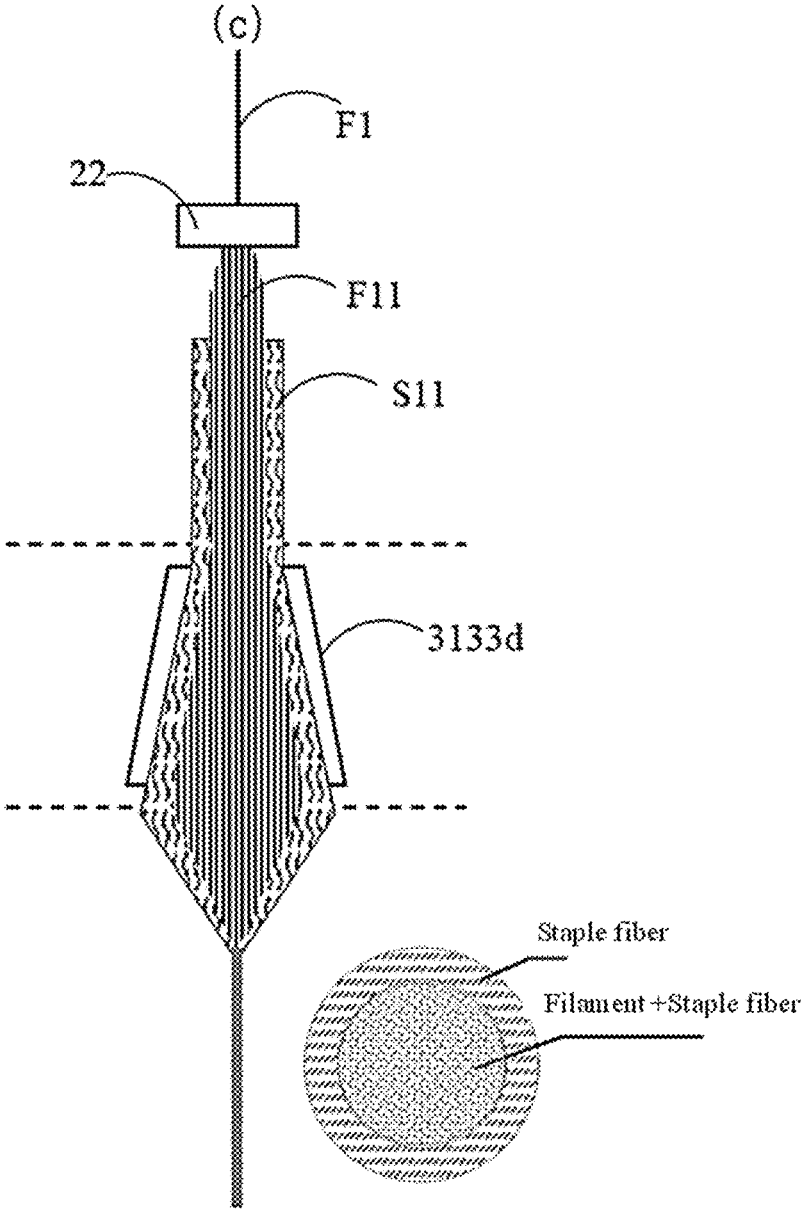

As illustrated in FIG. 24A through FIG. 24C, FIG. 24A through FIG. 24C illustrate a schematic diagram of a preparation process and a structure of a wrapped-core yarn when an axis of staple strand S11 and an axis of the ribbon-like filaments F11 coincide and are input at the front roller nip. In FIG. 24A, after opening and expanding through the negative pressure suction port 3133*d*, a width of the ribbon-like filaments F11 is larger than that of the staple strand S11, a wrapped-core yarn having a core layer composed of embedded staple fiber strands and filaments and an outer layer composed of filaments is formed, and the wrapped-core yarn shows an excellent wear resistance. In FIG. 24B, after opening and expanding through the negative pressure suction port 3133*d*, a width of ribbon-like filaments F11 is equal to a width of staple strand S11, a wrapped-core yarn is formed in which staple fiber strands and filaments are completely embedded, and the wrapped-core yarn has good mechanical properties, less surface hairiness, larger locking cohesion between filaments and staple fiber strands, and stable and durable yarn structure. In FIG. 24C, after opening and expanding through the negative pressure suction port 3133*d*, a width of the ribbon-like filaments F11 is smaller than that of the staple fiber strand S11, a wrapped-core yarn having a core layer composed of embedded staple fiber strands and filaments and an outer layer composed of staple fiber strands is formed, and wrapped-core yarn has the appearance and hand feel of a staple fiber yarn on the outside, and a stable structure with filaments holding the staple fiber strands in the core.

Figure 25A:
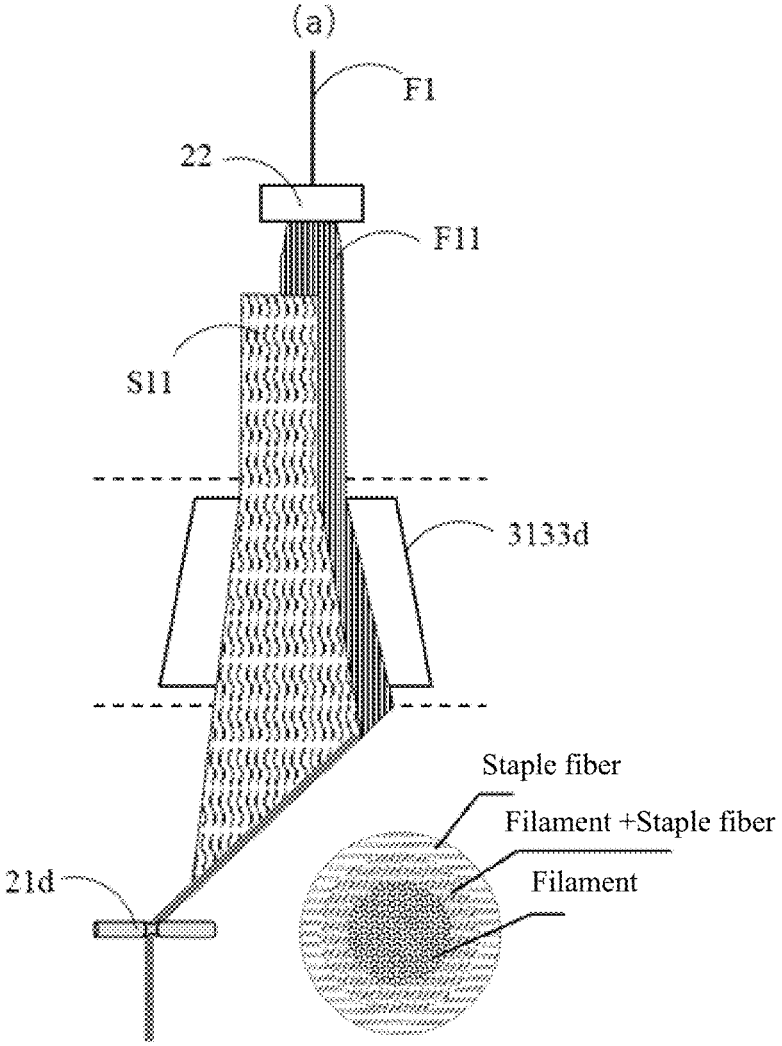
FIG. 25A and FIG. 25B illustrate a preparation process and a schematic structural diagram of a wrapped-core yarn when an axis of a staple fiber strand and an axis of a ribbon-like fiber are spaced from each other at a certain spacing and input in a front roller nip.
Figure 25B:
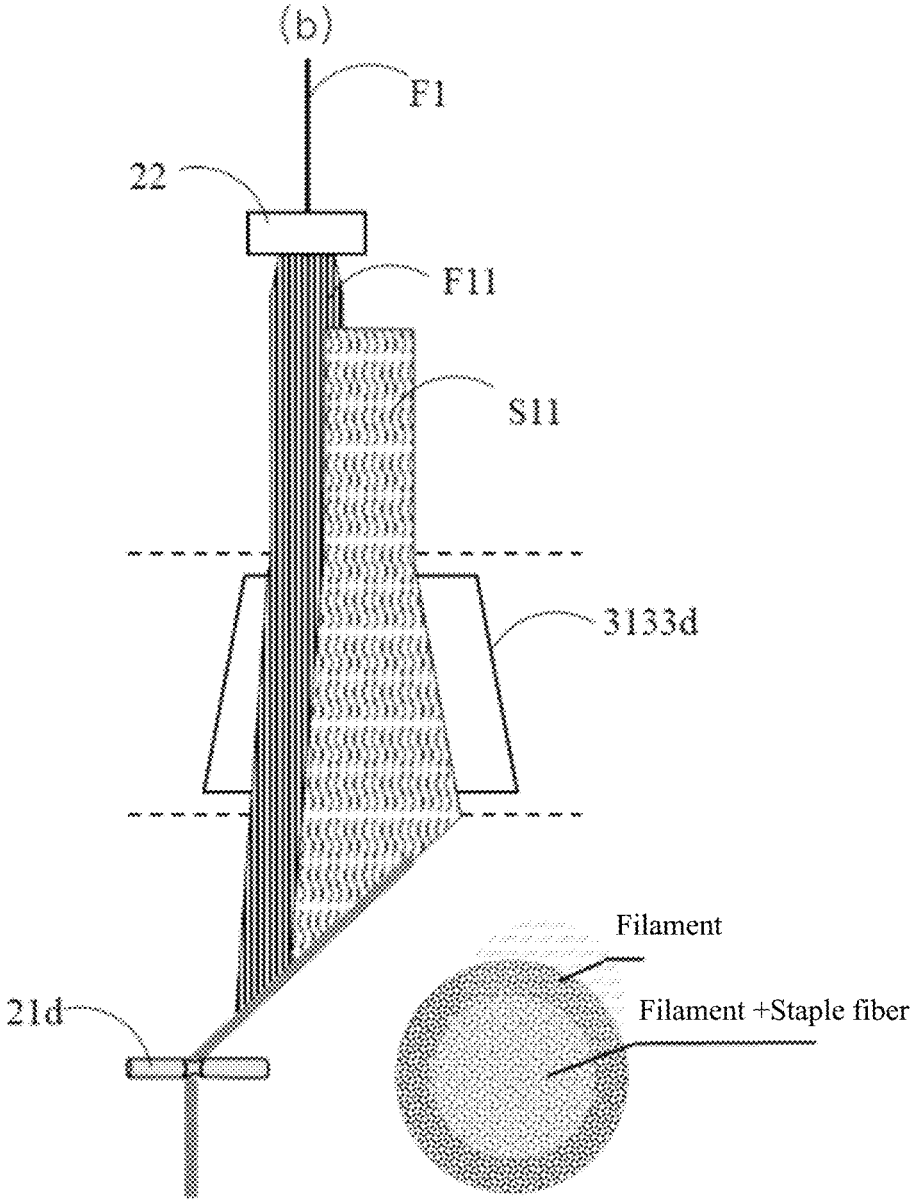

As illustrated in FIG. 25A and FIG. 25B, FIG. 25A and FIG. 25B illustrate a schematic diagram of a preparation process and a structure of a wrapped-core yarn when an axis of staple fiber strand S11 at the front roller nip and an axis of ribbon-like filaments F11 at the front roller nip are separated by a certain spacing. As shown in FIG. 25A, a spacing between the axis of the staple fiber strand S11 at the front roller nip and the axis of the ribbon-like filaments F11 at the front roller nip is 1-5 mm, and the yarn guiding rod is disposed at a side close to the staple fiber strand S11; and after the opening and expansion of the negative pressure suction port 3133*d*, a three-layer wrapped-core yarn is obtained, in which a core layer is composed of filaments, a shell layer is composed of embedded filaments and staple fiber strands, and a surface layer is composed of staple fiber strands. In FIG. 25B, a spacing between the axis of the staple fiber strand S11 at the front roller nip and the axis of the ribbon-like filaments F11 at the front roller nip is 1-5 mm, and the yarn guiding rod is disposed at a side close to the ribbon-like filaments F11; and after the opening and expansion of the negative pressure suction port 3133*d*, a two-layer wrapped-core yarn is obtained, in which a core layer is composed of embedded staple fiber strands and filaments, and an outer layer is composed of filaments.

In the wrapped-core yarn spun in this embodiment, the core yarn F1 is scattered to form ribbon-like filaments F11 with filaments, and the ribbon-like filaments F11 and the staple fiber strand S11 are twisted and embraced, so that the clamping cohesion between the filaments and the staple fiber strand S11 is effectively improved, and the formed wrapped-core yarn has stable structure, good mechanical properties and less hairiness. In practical application, the spinning device of this embodiment only needs to adjust an input spacing between the axis of the staple fiber strand S11 at the front roller nip between the front roller 16*d* and the front top roller 321*d* and the axis of the ribbon-like filaments F11 at the front roller nip between the front roller 16*d* and the front top roller 321*d*, and adjust the position of the yarn guiding rod accordingly, so that wrapped-core yarns with various structures can be obtained without changing the device itself, thus realizing the diversified preparation of wrapped-core yarns, and the comprehensive performance of wrapped-core yarns is good; wrapped-core yarn with outstanding performance in a certain aspect can also be specially prepared according to requirements; and the double-opening and mutual-embedding spinning device and process method of staple fiber and filament have industrial application value.

In the embodiment 6, a pure cotton staple fiber and a nylon filament as shown in FIG. 24A are used for spinning, the axis of staple fiber strand S11 and the axis of ribbon-like filaments F11 are set to be coincided at the front roller nip, a yarn surface is a nylon filament, and a core layer is smooth and wear-resistant yarn with nylon filament and cotton fiber embedded and twisted.

A conventional ring spindle compact wrapped-core yarn device is used to make cotton staple fiber strands and nylon filaments be completely overlapped and twisted to obtain a conventional compact wrapped-core yarn, in which a yarn surface is cotton fiber strands, and a core layer is nylon filaments. Performances of the conventional compact wrapped-core yarn are compared with performances of the wrapped-core yarn spun in the embodiment 6, and test results show that compared with the conventional compact wrapped-core yarn, a hairiness index and a wear resistance of the smooth and wear-resistant yarn obtained in the embodiment 6 are respectively improved by 92% and 67%.

Embodiment 7

A cotton staple fiber and a nylon filament as shown in FIG. 25A are used for spinning, a spacing between the axis of staple fiber strand S11 and the axis of ribbon-like filaments F11 is 5 mm at the front roller nip, and a three-layer composite wrapped-core yarn with higher strength, overall wear resistance, and softness and comfort is formed. A surface layer of the three-layer composite wrapped-core yarn is composed of soft and comfortable cotton fibers, a core layer of the three-layer composite wrapped-core yarn is composed of nylon filaments, and a shell layer between the surface layer and the core layer is composed of embedded nylon filaments and cotton fibers.

A conventional ring-spun Sirofil spinning device is used to set a spacing between cotton staple fiber strands and nylon filaments to be 5 mm at a front roller nip, and is used to twist the cotton staple fiber strands and the nylon filaments to obtain a filament wrapping yarn with cotton fiber and nylon filament twisted together. Performance of filament wrapping yarn are compared with performances of the wrapped-core yarn spun in the embodiment 7, and test results show that a strength of the three-layer composite wrapped-core yarn obtained in the embodiment 7 is improved by 30% and a wear resistance of the three-layer composite wrapped-core yarn obtained in the embodiment 7 is improved by 42% compared with the filament wrapping yarn obtained by using the conventional ring-spun Sirofil spinning device.

Embodiment 8

As illustrated in FIG. 36 through FIG. 41, the feeding unit further includes a front roller 16*f* disposed at an input end of the auxiliary core wrapping unit 30. The core yarn feeding unit 20 is configured to simultaneously feed at least one core yarn F1 and at least one wrapping yarn F2 into the auxiliary core wrapping unit 30, and the core yarn F1 and the wrapping yarn F2 are set apart from each other. The staple fiber feeding unit 10 is configured to feed at least one staple fiber roving S1 at intervals into the auxiliary core wrapping unit 30. The wrapping yarn F2 is overlapped with a staple strand after drafting of the staple fiber roving S1 close to the core yarn F1, and a spacing between the core yarn F1 and the staple strand close to the core yarn F1 is 2-5 mm on the front roller 16*f*. In this way, the core yarn F1 and the staple fiber strand are separated by a certain spacing when passing through the front roller 16*f*, and will not be directly entangled, which provides conditions for the smooth transportation of the staple fiber strand to the subsequent auxiliary core-wrapping unit 30, and at the same time provides favorable conditions for the subsequent y-shaped structure.

The auxiliary core-wrapping assembly 31 is a negative pressure absorption assembly 3132*f*, and the pressurizing/conveying assembly 32 includes a transmission gear 35*f* and an auxiliary conveying component. The negative pressure adsorption assembly 3132*f* includes a special shaped air suction plate 316*f*, a drive roller 317*f* and a grid circle 315*f* wrapped on surfaces of the special shaped air suction plate 316*f* and the drive roller 317*f*. The special shaped air suction plate 316*f* is provided with a negative pressure suction grid hole zone with a width greater than or equal to a width of the staple fiber strand. The grid circle 315*f* only allows airflow to pass therethrough, which plays a role in supporting and transporting the staple fiber strand. The front roller 16*f*, the transmission gear 35*f* and the drive roller 317*f* are in meshing connection. In this way, the following effects are obtained. Firstly, the front roller 16*f* rotates to drive the transmission gear 35*f* to rotate, thereby driving the drive roller 317*f* to rotate, and further driving the grid circle 315*f* on the surface of the drive roller 317*f* to rotate; secondly, the staple fiber strand input through the front roller 16*f* is conveyed to the grid circle 315*f* and pass through the negative pressure suction port 3133*f*. Because the width of the negative pressure suction port 3133*f* is greater than or equal to the width of the staple fiber strand, the staple fiber strand is evenly spread on the grid circle 315*f* with a certain width and fiber parallelism without accumulation. Thirdly, under the continuous transportation of the grid circle 315*f*, the staple fiber strand finally converges with the core yarn F1 and the wrapping yarn F2 output from the front roller 16*f* at the wrapping area 34, and twisting formed by the spindle rotation of the ring frame makes the core yarn F1 rotate, which drives the staple fiber strand and the wrapping yarn F2 to wrap around an outer layer of the core yarn F1 to form a wrapped-core yarn S2. Then, the wrapped-core yarn S2 is transmitted to the yarn winding unit 40 for twisting and winding.

As illustrated in FIG. 36 through FIG. 39, the core yarn feeding unit 20 simultaneously feeds at least one core yarn F1 (when the at least one core yarn F1 is multiple in number, core yarns F1 overlap) and at least one wrapping yarn F2 (when the at least one wrapping yarn F2 is multiple in number, the wrapping yarns F2 overlap), which are arranged at intervals. The staple fiber feeding unit 10 feeds one staple fiber strand S11 into the auxiliary core wrapping unit 30, and the wrapping yarn F2 is arranged within ½ of a width of the staple fiber strand S11 close to the core yarn F1. A spacing between the core yarn F1 and an end of the staple fiber strand S11 near the core yarn F1 is 2-5 mm on the front roller 16*f*. The staple fiber strand S11 and the wrapping yarn F2 intersect with the core yarn F1 at the wrapping area 34. A staple fiber strand S113 near the core yarn F1, the wrapping yarn F2 and a staple fiber strand S14 far away from the core yarn F1 are sequentially wrapped and wound to an outer layer of the core yarn F1 at the wrapping area 34, thereby forming a wrapped-core yarn S2 with the wrapping yarn F2 and the core yarn F1 holding the staple fiber strand S13 close to the core yarn F1 as a core and with the staple fiber strand S14 far away from the core yarn F1 as a sheath. Specifically, the core yarn F1 rotates, so that the core yarn F1, the wrapping yarn F2 and the staple fiber strand S13 close to the core yarn F1 are twisted with each other to form a core layer in which the wrapping yarn F2 and the core yarn F1 clamp the staple fiber strand S13 close to the core yarn F1; then, the staple fiber strand S14 far away from the core yarn F1 is wrapped and wound on the core layer under the rotation of the core yarn F1. In this process, the evenly spread staple fiber strand S11 is adsorbed on the grid circle 315*f* without rotating, and then the staple fiber strand S11 is wrapped under the cooperative action of the core yarn F1 and the wrapping yarn F2 to form a wrapped-core yarn S2 with a special structure.

Figure 40:
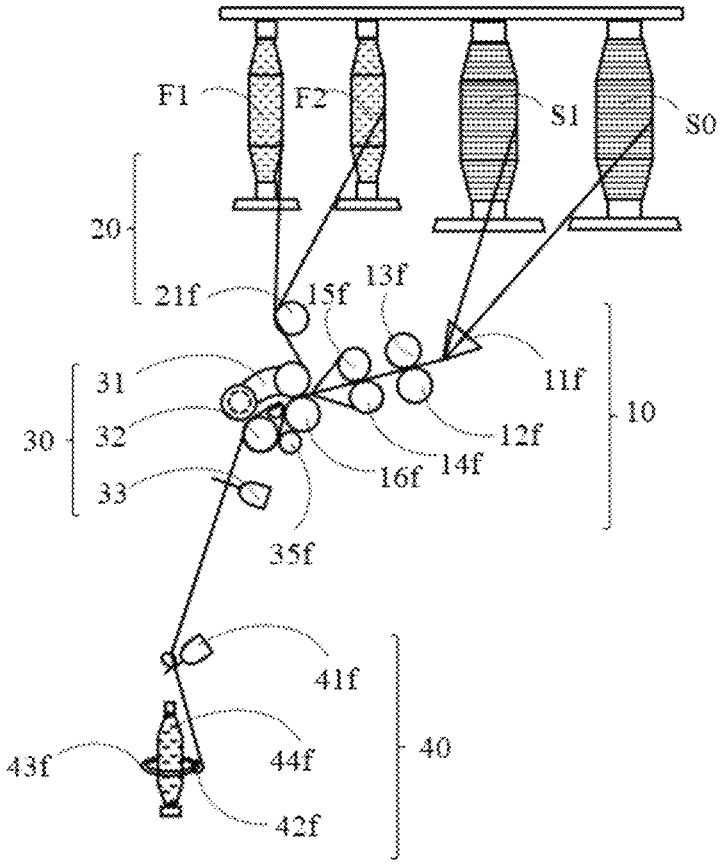
FIG. 40 illustrates a schematic structural diagram of a spinning device according to an embodiment 9.
Figure 41:
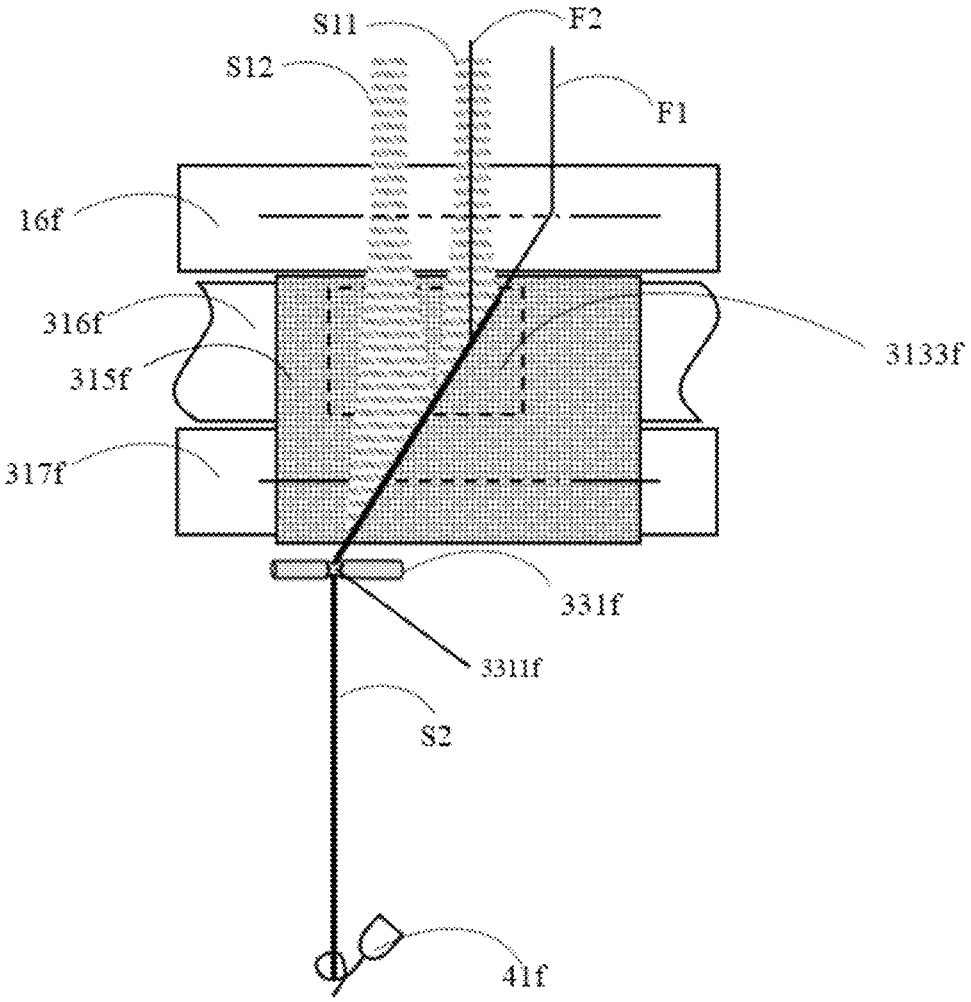
FIG. 41 illustrates a path diagram of forming a wrapped-core yarn by using a staple fiber wide strand, a wrapping yarn and a core yarn in the embodiment 9.

As illustrated in FIG. 40 and FIG. 41, the core yarn feeding unit 20 simultaneously feeds at least one core yarn F1 and at least one wrapping yarn F2, which are arranged at intervals. The staple fiber feeding unit 10 simultaneously feeds a staple fiber strand S11 and a second staple fiber strand S12, which are sequentially far away from the core yarn F1. The wrapping yarn F2 coincides with the staple fiber strand S11. A spacing between the core yarn F1 and an end of the staple fiber strand S11 close to the core yarn F1 is 2-5 mm on the front roller 16*f*. The staple fiber strand S11, the second staple fiber strand S12 and the wrapping yarn F2 intersect and converge with the core yarn F1 at the wrapping area 34, and the staple fiber strand S11, the wrapping yarn F2 and the second staple fiber strand S12 are sequentially wrapped and wound to an outer layer of the core yarn F1 at the wrapping area 34 to form a wrapped-core yarn S2 with the staple fiber strand S11 sandwiched by the wrapping yarn F2 and the core yarn F1 as a core and with the second staple fiber strand S12 as a sheath. Specifically, the core yarn F1 rotates, so that the core yarn F1, the wrapping yarn F2 and the staple fiber strand S11 are twisted with each other to form a core layer in which the wrapping yarn F2 and the core yarn F1 clamp the staple fiber strand S11; and then, the second staple fiber strand S12 is wrapped around the core layer under the rotation of the core yarn F1.

The negative pressure suction port 3133*f* is a structure having an equal width from top to bottom or a structure narrower at the top and wider at the bottom, so that the staple fiber strand S11 and the second staple fiber strand S12 are evenly laid on the grid circle 315*f* with a certain width and fiber parallelism. Preferably, the negative pressure suction port 3133*f* is the structure narrower at the top and wider at the bottom, that is, an end of the negative pressure suction port 3133*f* close to the feeding unit is narrower (still not less than the width of the staple fiber strand S11 and not less than the width of the second staple fiber strand S12 conveyed by the front roller 16*f*), and an end of the negative pressure suction port 3133*f* far away from the feeding unit is wider. In this way, when the staple fiber strand S11 and the second staple fiber strand S12 pass through the negative pressure suction port 3133*f* with a narrower top and a wider bottom, the air suction assembly at the negative pressure suction port 3133*f* stretches the staple fiber strand S11 and the second staple fiber strand S12 in width and length directions, and the staple fiber strand S11 and the second staple fiber strand S12 are stretched to both sides, so as to be evenly laid. At the same time, the staple fiber strand S11 and the second staple fiber strand S12 are also stretched by a stretching force in the conveying direction, so that each single fiber is straightened. Under the coordinated stretching forces in both the width and length directions, the staple fiber strand S11 and the second staple fiber strand S12 will neither be over-stretched to create gaps nor will they be pulled apart. Finally, a fiber layer with a certain width and higher parallelism and uniform distribution is obtained on the grid circle 315*f*, which results in a significantly better wrapping effect for the core yarn F1 and provides favorable conditions for obtaining a structurally uniform wrapped-core yarn S2. Additionally, the negative pressure suction port 3133*f* can also capture uncontrolled floating fibers from the staple fiber strand S11 and the second staple fiber strand S12.

Figure 36:
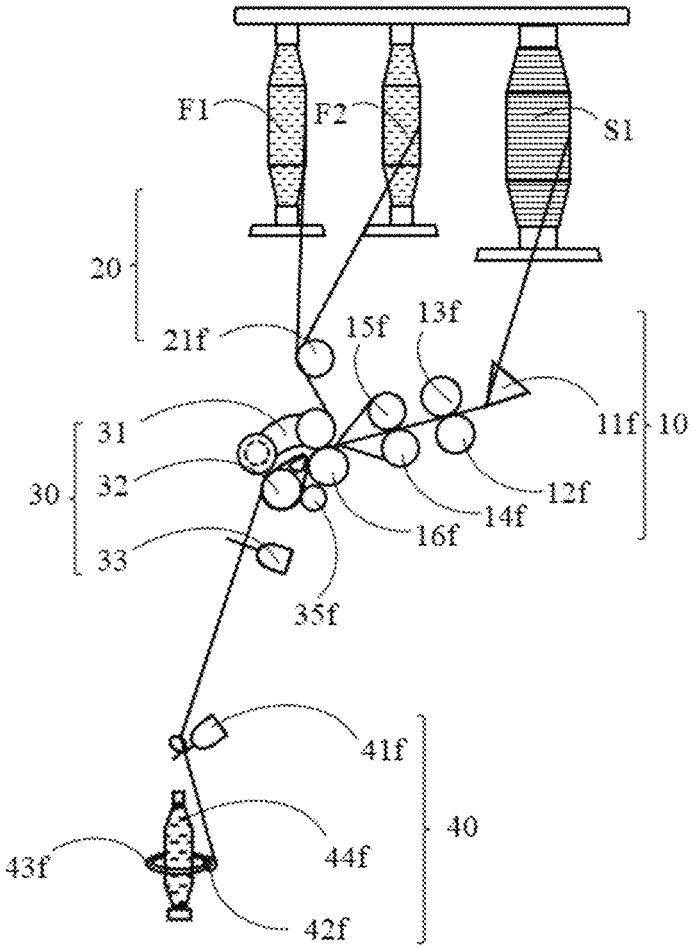
FIG. 36 illustrates a schematic structural diagram of a spinning device according to an embodiment 8.
Figure 39:
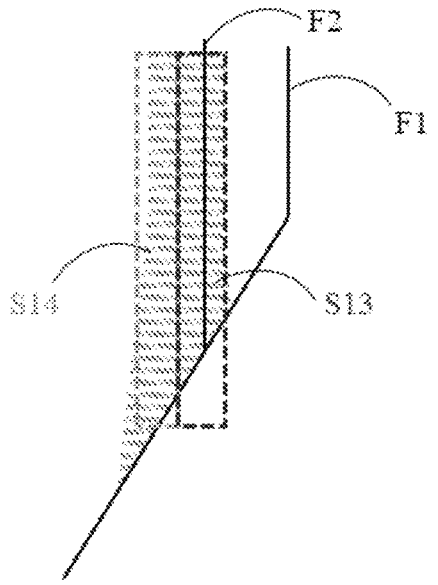
FIG. 39 illustrates a composition diagram of the staple fiber wide strand in FIG. 36.

Particularly, as shown in FIG. 36 and FIG. 39, the wrapped-core yarn S2 formed in the wrapping area 34 is in a straight line with the core yarn F1 conveyed to the grid circle 315*f*, and the wrapped-core yarn S2 formed in the wrapping area 34 forms a y-shaped structure with each of the staple fiber strand S11, the wrapping yarn F2 and the second staple fiber strand S12 conveyed to the grid circle 315*f*. In this way, since the wrapped-core yarn S2 is in a straight line with the core yarn F1 conveyed to the grid circle 315*f*, a twist formed by the rotation of airflow is transmitted to the wrapping area 34 from bottom to top, and then most of the twist is transmitted to the core yarn F1, so that a twist and a tension of the core yarn F1 are much greater than those of each of the staple fiber strand S11 and the second staple fiber strand S12, making the core yarn F1 dominant in the twisting process and provides the core yarn F1 with enough rotation, and at the same time keeping the core yarn F1 in a straightened state. However, only a small part of the twist is transferred to the staple fiber strand S11 and the second staple fiber strand S12, and at the same time, the twist of each of the staple fiber strand S11 and the second staple fiber strand S2 is further reduced by a suction force of the negative pressure suction port 3133*f*, so that the staple fiber strand S11 and the second staple fiber strand S2 are laid flat on the grid circle 315*f* and are uniformly wrapped around the core yarn F1 by the rotation of the core yarn F1.

Before entering into the wrapping area 34, the staple fiber strand S11 is in a straight line, and the second staple fiber strand S12 in in a straight line, which further hinders the twist transmission of the staple fiber strand S11 and the second staple fiber strand S12, and further reduces the twist and the tension of each of the staple fiber strand S11 and the second staple fiber strand S12 again.

Before entering the wrapping area 34, an extension line of the core yarn F1 input to the grid circle 315*f* is not in a straight line with the fed core yarn F1 from the core yarn feeding unit 20, so that the core yarn F1 is input to the grid circle 315*f* in a broken line form, which further increases the tension of the core yarn F1, provides auxiliary conditions for ensuring that the core yarn F1 is in a straight state at the wrapping area 34, and improves the wrapping effect.

In some embodiments, a spacing between the wrapping area 34 and the nip of the front roller 16*f* is greater than a fiber length of the staple fiber strand S11 and is greater than a fiber length of the second staple fiber strand S12. In this way, firstly, a single fiber in the staple fiber strand S11 and the second staple fiber strand S12 can be stretched sufficiently to be straightened; secondly, a longer wrapping length within the wrapping area 34 further improves the twist and tension of the core yarn F1, which is beneficial to the rotation of the core yarn F1 to drive the staple fiber strand S11 and the second staple fiber strand S12 to wrap; and thirdly, a high-speed rotation of the core yarn F1 can also produce a certain stretching effect on the staple fiber strand S11 and the second staple fiber strand S12, which further improves the yarn quality.

Figure 37:
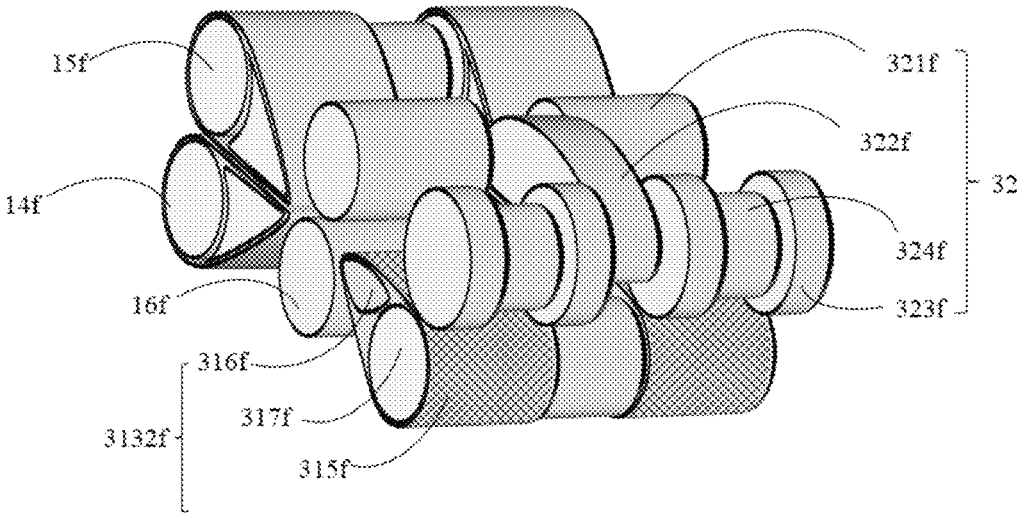
FIG. 37 illustrates a connection relationship diagram between a negative pressure adsorption assembly and an auxiliary conveying component.
Figure 38:
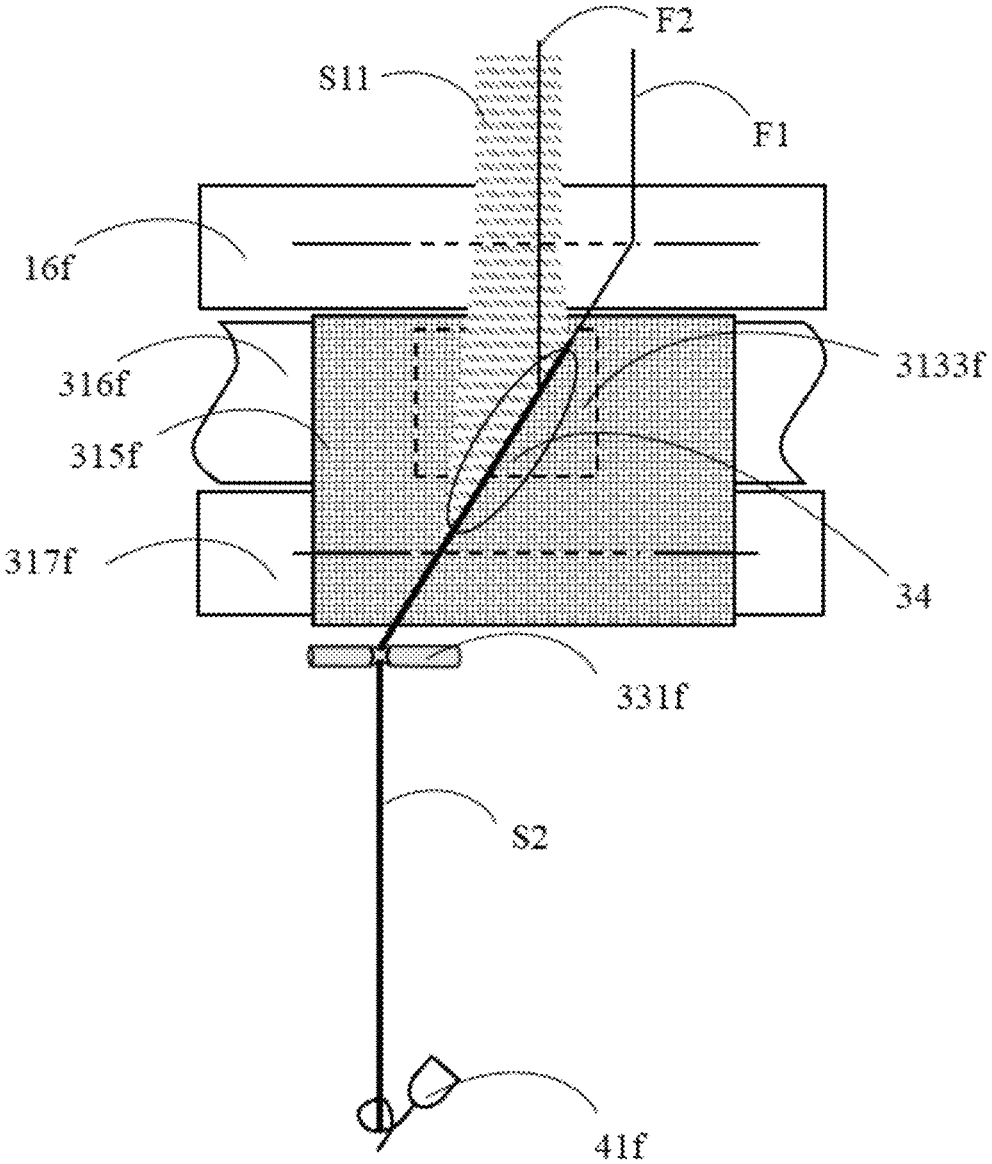
FIG. 38 illustrates a path diagram of forming a wrapped-core yarn by using a staple fiber wide strand, a wrapping yarn and a core yarn in the embodiment 8.

The auxiliary conveying component includes a front top roller 321*f*, a drive top roller 323*f* and a bridge component 322*f* disposed between the front top roller 321*f* and the drive top roller 323*f*. A shaft core of the front top roller 321*f* and the bridge component 322*f* are connected with a shaft core of the drive top roller 323*f*, and the bridge component 322*f* can play a role in structural fixing and positioning the front top roller 321*f* and the drive top roller 323*f*. As shown in FIG. 37, the front top roller 321*f* is arranged vertically corresponding to the front roller 16*f*, and the drive top roller 323*f* is arranged vertically corresponding to the drive roller 317*f*. The drive top roller 323*f* is in contact with the grid circle 315*f*, and the grid circle 315*f* is driven to rotate by the joint action of the drive top roller 323*f* and the transmission gear 35*f*. This arrangement makes the transmission of the grid circle 315*f* more stable and provides stable conditions for the wrapping process.

In some embodiments, a middle of the drive top roller 323*f* is provided with a roller groove 324*f* for the wrapped-core yarn S2 to pass through. A width of the roller groove 324*f* is smaller than a width of the grid circle 315*f* and larger than one third of a width of the drive top roller 323*f*. In this way, convex structures of two ends of the drive top roller 323*f* are more convenient to press the grid circle 315*f* and drive the grid circle 315*f* to rotate and convey. At the same time, the roller groove 324*f* facilitates the wrapped-core yarn S2 to pass between the drive top roller 323*f* and the grid circle 315*f*.

The yarn guiding assembly 33 is a yarn guiding rod 331*f*, and a middle of the yarn guiding rod 331*f* is provided with a yarn groove 3311*f* for positioning the wrapped-core yarn S2. The yarn groove 3311*f* is configured to make the wrapped-core yarn S2 pass therethrough, and is further configured to position a yarn forming path. Specifically, the yarn guiding rod 331*f* moves left and right to adjust an offset of a path of the core yarn F1, thereby adjusting the y-shaped structure. The yarn guiding rod 331*f* moves up and down in a direction perpendicular to the yarn forming path, which can not only adjust a tension of the wrapped-core yarn S2 to the grid circle 315*f*, but also eliminate the yarn lateral movement caused by airflow, making a structure of the wrapped-core yarn S2 more stable, and also adjust the tension and twist of the core yarn F1.

The staple fiber feeding unit 10 includes a bell mouth 11*f* for feeding the staple fiber strand S11 and the second staple fiber strand S12, a rear roller 12*f*, a rear top roller 13*f*, a middle roller 14*f* and a middle top roller 15*f*. The core yarn feeding unit 20 includes a godet 21*f* for guiding the core yarn F1 and the wrapping yarn F2.

the yarn winding unit 40 includes a guide hook 41*f*, a traveler 42*f*, a steel ring 43*f* and a ring bobbin 44*f*. The wrapped-core yarn S2 enters a balloon twisting section through the guide hook 41*f*, and fibers in an outer layer of the wrapped-core yarn S2 are further twisted and tightly held in this process, and finally wound on the ring bobbin 44*f* through the rotation of the traveler 42*f* on the steel ring 43*f*.

The working principle of the spinning device is as follows: firstly, the roving is unwound and enters the staple fiber feeding unit through the bell mouth 11*f*, the roving is stretched by the rear roller 12*f*, the rear top roller 13*f*, the middle roller 14*f* and the middle top roller 15*f* to obtain a staple fiber strand S11, and the staple fiber strand S11 is further stretched by the front roller 16*f* and then output; secondly, the staple fiber strand S11 and the second staple fiber strand S12 are adsorbed onto the grid circle 315*f* by the air suction assembly in the special shaped air suction plate 316*f*. In this process, the rotation of the front roller 16*f* drives the transmission gear 35*f* to rotate, which in turn drives the drive roller 317*f* to rotate. At the same time, the auxiliary conveying component presses down, and the drive top roller 323*f* presses on the drive roller 317*f*, which further drives the grid circle 315*f* to rotate, so that the staple fiber strand S11 and the second staple fiber strand S12 are conveyed forward. The core yarn F1 and the wrapping yarn F2 with a certain spacing are unwound and fed into the nip formed between the front roller 16*f* and the front top roller 321*f* under the guidance of the godet 21*f* for output, so as to ensure that the wrapping yarn F2 is located within ½ of the width of the staple fiber strand S11 close to the core yarn F1 or that the wrapping yarn F2 overlaps with the staple fiber strand S11, and a spacing between the core yarn F1 and an end of the staple fiber strand S11 close to the core yarn F1 is 2-5 mm on the front roller 16*f*. The staple fiber strand S11 is conveyed forward under the support of the grid circle 315*f*, and the staple fiber strand S11, the wrapping yarn F2 and the second staple fiber strand S11 are sequentially wrapped and wound to an outer layer of the core yarn F1 at the wrapping area 34 by the rotation of the core yarn F1 to form a wrapped-core yarn S2. After passing through the yarn guiding rod 331*f* and the guide hook 41*f*, the wrapped-core yarn S2 is wound on the ring bobbin 44*f* by the traveler 42*f* rotating at higher speed on the steel ring 43*f*.

A spinning method is provided, which is implemented by the spinning device in the embodiment 8. The method specifically includes steps S1' to S3'.

In step S1', at least one staple fiber strand S11, at least one wrapping yarn F2 and at least one core yarn F1, which are arranged at intervals, are fed from the feeding unit to the auxiliary wrapping unit 30.

In step S2', the wrapping yarn F2 is overlapped with a staple fiber strand of the at least one staple fiber strand S11 close to the core yarn F1, and the staple fiber strand of the at least one staple fiber strand S11 close to the core yarn F1 keeps a spacing of 2-5 mm from the core yarn F1 at a front nip formed by the meshing of the front roller 16*f* and the front top roller 321*f*, and is output to the grid circle 315*f* through the front nip. The staple fiber strand S11 is held by the suction assembly at the negative pressure suction port 3133*f*, and evenly spread on the grid circle 315*f* with a certain width and fiber parallelism. The rotation of the core yarn F1 drives the staple fiber strand and the wrapping yarn F2 to wrap around an outer layer of the core yarn F1 in turn at the wrapping area 34 to form a wrapped-core yarn S2.

In step S3', The wrapped-core yarn S2 is twisted and wound by the yarn winding unit 40.

As shown in FIG. 36 through FIG. 39, the core yarn feeding unit 20 of the embodiment 8 feeds one core yarn F1 and one wrapping yarn F2 at the same time, and the staple fiber feeding unit 10 feeds one staple fiber strand S11. Technical parameters of a corresponding spinning process are as follows: the core yarn F1 is a black nylon filament with a fiber fineness of 81D, the wrapping yarn F2 is a white nylon filament with a fiber fineness of 50D, and the staple fiber strand S11 is a pink cotton fiber roving with a linear density of 450 tex; a speed at which the front roller 16*f* outputs the staple fiber strand S11 is 9.48 m/min; a rotating speed of the ring bobbin 44*f* is 11,000 r/min; a twist is 80 T/10 cm; a total drafting multiple (that is, a drafting ratio of the front roller rotational linear speed to the back roller rotational linear speed during stretching the staple fiber strand S11) is 57.40, a linear density of cortical cotton fiber (that is, a linear density of a roving after stretching) is 7.84 tex; a back zone drafting multiple (that is, a ratio of a rotational linear speed of the middle roller to a rotational linear speed of the back roller) is 1.25, a double-core yarn (core yarn F1 and wrapping yarn F2) accounts for 65% of the total yarn; a spacing between the wrapping yarn F2 and the core yarn F1 on the front roller 16*f* is 6.5 mm, and a spacing between the core yarn F1 and the staple fiber strand S11 on the front roller 16*f* is 5 mm; and the wrapping yarn F2 is fed at a position slightly to the right of a center of the staple fiber strand S11 (as shown in FIG. 36).

Figure 42:
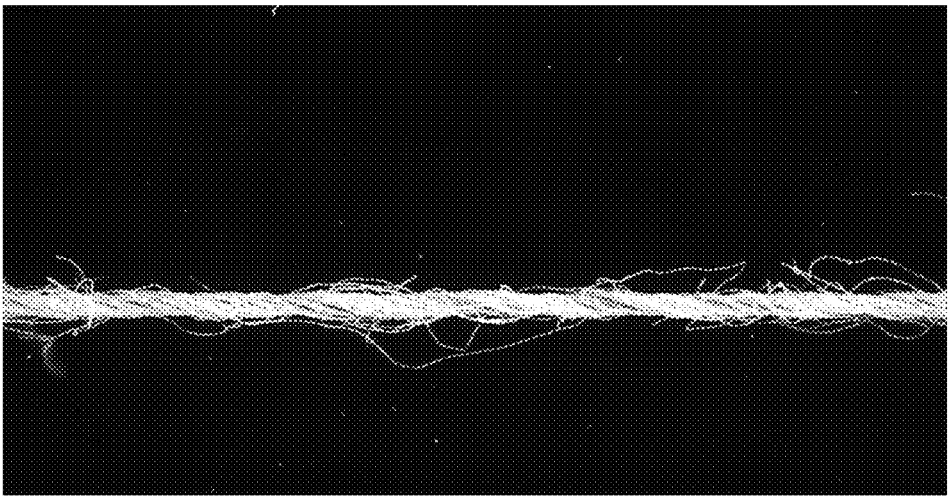
FIG. 42 illustrates an image of a wrapped-core yarn spun in the embodiment 8 under 35 times magnification using a 3D microscope with a scale of 200 μm.

FIG. 42 illustrates an image of the wrapped-core yarn spun in the embodiment 8 under 35 times magnification using a 3D microscope. As can be seen from FIG. 42, in the obtained wrapped-core yarn, an outer cotton fiber completely covers a core yarn and a wrapping yarn, and the overall yarn covering effect is good, and there is no filament exposure. In addition, the parallelism of the outer coated fiber is higher.

Embodiment 9

As shown in FIG. 40 and FIG. 41, the core yarn feeding unit 20 of the embodiment 9 feeds one core yarn F1 and at least one wrapping yarn F2 at the same time, and the staple fiber feeding unit 10 feeds one staple fiber strand S11 and one second staple fiber strand S12 (at this time, the staple fiber feeding unit 10 needs to feed a roving S0 and a roving S1). The staple fiber strand S11 is close to the core yarn F1, and the wrapping yarn F2 overlaps with the staple fiber strand S11. Technical parameters of a corresponding spinning process are as follows: the core yarn F1 is a black nylon filament with a fiber fineness of 81D, the wrapping yarn F2 is a white nylon filament with a fiber fineness of 50D, the staple fiber strand S11 is a pink cotton fiber roving with a linear density of 450 tex, and the second staple fiber strand S12 is a pink cotton fiber roving with a linear density of 450 tex; a speed at which the front roller 16*f* outputs the staple fiber strand S11 and the second staple fiber strand S12 is 9.48 m/min; a rotating speed of the ring bobbin 44*f* is 11,000 r/min; a twist is 80 T/10 cm; a total drafting multiple (that is, a drafting multiple of a ratio of the front roller rotational linear speed to the back roller rotational linear speed during stretching the staple fiber strand S11) is 57.40; a linear density of cortical cotton fiber (that is, a linear density of a roving after stretching) is 7.84 tex; a back zone drafting multiple (that is, a ratio of a rotational linear speed of the middle roller to a rotational linear speed of the back roller) is 1.25; a double-core yarn (core yarn F1 and wrapping yarn F2) accounts for 70% of the total yarn; a spacing between the wrapping yarn F2 and the core yarn F1 on the front roller 16*f* is 5 mm, and a spacing between the staple fiber strand S11 and the second staple fiber strand S12 on the front roller 16*f* is 5 mm (that is, a spacing between a left edge of the staple fiber strand S11 and a right edge of the second staple fiber strand S12 in FIG. 41); a spacing between aside of the staple fiber strand S11 close to the core yarn F1 and the core yarn F1 on the front roller 16*f* is 3.5 mm; and the wrapping yarn F2 is fed at a center of the staple fiber strand S11 (as shown in FIG. 41).

Comparative Example 6

Compared with the embodiment 8, the difference is that in the comparative example 6, the core yarn feeding unit 20 only feeds one core yarn F1, and the other parameters are basically the same as those of the embodiment 1, which will not be described herein.

Although the wrapped-core yarn obtained in the comparative example 6 does not have a very serious core yarn exposure, compared to the embodiment 8, occasional core yarn exposure occurs, and it is easy to slide and fall off between the core yarn F1 and the staple fiber strand S11.

Comparative Example 7

In the comparative example 7, a traditional ring core spinning device is used for core spinning, and the auxiliary core-wrapping unit 30 is not provided. The other parameters are basically the same as those in the embodiment 8, which will not be described herein.

Figure 43:
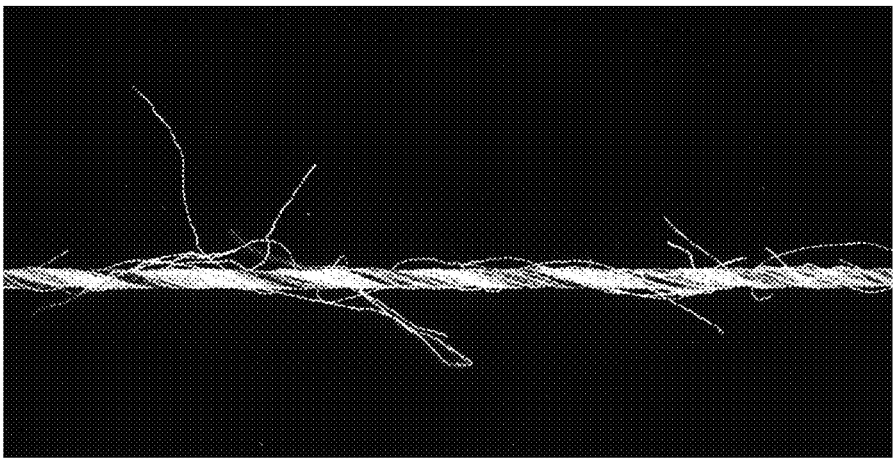
FIG. 43 illustrates an image of a wrapped-core yarn spun in a comparative example 7 under 35 times magnification using a 3D microscope with a scale of 200 μm.

FIG. 43 illustrates an image of a wrapped-core yarn spun in the comparative example 7 under 35 times magnification using a 3D microscope. As can be seen from FIG. 43, the wrapped-core yarn of the comparative example 7 has serious core yarn exposure, and it can be clearly seen that multiple filaments are exposed.

Comparative Example 8

In the comparative example, through the adjustment of the yarn guiding rod and the core yarn feeding unit, the wrapped-core yarn S2 formed in the wrapping area 34 is not in a straight line with the core yarn F1 conveyed to the grid circle 315*f*, and the wrapped-core yarn S2 formed in the wrapping area 34 is not in a straight line with the staple fiber strand S11 conveyed to the grid circle 315*f*, thus destroying the y-shaped structure. The other parameters are basically the same as those in the embodiment 8, and will not be described herein.

Figure 44:
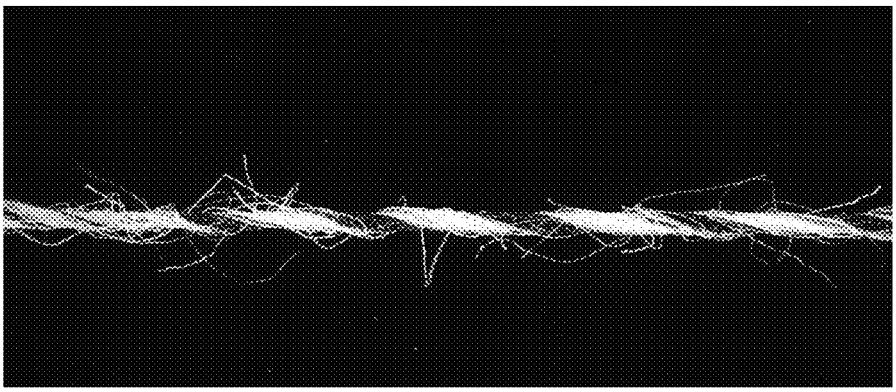
FIG. 44 illustrates an image of a wrapped-core yarn spun in a comparative example 8 under 35 times magnification using a 3D microscope with a scale of 200 μm.

FIG. 44 illustrates an image of a wrapped-core yarn spun in the comparative example 8 under 35 times magnification using a 3D microscope. As can be seen from FIG. 44, the wrapped-core yarn spun in comparative example 8 has a morphological structure of plied yarn after the y-shaped structure was destroyed, and the core yarn F1, the wrapping yarn F2 and the staple fiber strand S11 are twisted and wrapped with each other, and the filaments are exposed.

Embodiment 10

Compared with the embodiment 8, the core yarn feeding unit 20 of the embodiment 10 simultaneously feeds a fine-denier flat core yarn F1 and a fine-denier flexible wrapping yarn F2, which are arranged at intervals.

Specifically, in the process of yarn formation, the fine-denier flat core yarn F1 rotates to form a uniform spiral structure, and at the same time, the rotation of the core yarn F1 causes the core yarn F1, the wrapping yarn F2 and a part of staple fiber strand S13 close to the core yarn F1 to twisted together, and the wrapping yarn F2 and the part of staple fiber strand S13 near the core yarn F1 reinforce and shape the spiral structure formed by the rotation of the core yarn F1. At the same time, uniform pores are formed between the spiral structure, the wrapping yarn F2 and the part of staple fiber strand S13 close to the core yarn F1, so as to obtain a spiral, uniform and fluffy core layer in which the wrapping yarn F2 and the core yarn F1 clamp the part of staple fiber strand S13 close to the core yarn F1; then, under the rotation of the core yarn F1, a part of the staple fiber strand S13 far away from the core yarn F1 is further wrapped and wound on the core layer to obtain a soft and wear-resistant yarn.

A single filament width of the fine-denier flat core yarn F1 is 10-80 μm, and the single filament width of the core yarn F1 is controlled within a narrower range to obtain the following effects. On the one hand, a spiral degree of the spiral structure formed by the self-rotation of the core yarn F1 is more compact and uniform, so that the core layer is more uniform and stable. On the other hand, a fineness of the obtained wrapped-core yarn S2 is controlled in a fine range, so that the obtained soft and wear-resistant yarn has higher softness and wear resistance.

The core yarn F1 is a water-soluble fiber or a water-insoluble fiber. When the core yarn F1 is the water-soluble fiber, after washing, the core yarn F1 is dissolved and removed to form a hollow structure, thus making the core structure fluffier and the obtained yarn softer.

A single filament fineness of the fine-denier flexible wrapping yarn F2 is 0.3-1.0 dtex. First of all, a width of the wrapping yarn F2 is also controlled within a narrower range, which not only makes the widths of the wrapping yarn F2 and the core yarn F1 more matched, but also makes the winding of the wrapping yarn F2 and the core yarn F1 firmer and improves the wear resistance. In addition, a fineness of the obtained wrapped-core yarn S2 can be controlled in a finer range. Moreover, the wrapping yarn F2 is flexible, which will not restrain the spiral structure while reinforcing the spiral structure of the core layer, thus not affecting the torsion of the spiral structure, and further not affecting the softness of the obtained soft wear-resistant yarn.

The staple fiber strand S11 input to the front roller **16*f*** is expanded. A width of the staple fiber strand S11 is also controlled within a certain range, so as to ensure the wrapping and not over-wrap, thereby improving the softness of the soft and wear-resistant yarn.

A width of the negative pressure suction port **3133*f*** is greater than or equal to the width of the staple fiber strand S11, and in the wrapping process, the wrapped-core yarn is wrapped more evenly and thinly, so that the obtained wrapped-core yarn is thinner and the spiral structure is uniform.

When the negative pressure suction port **3133*f* is narrower at the top and wider at the bottom, the staple fiber strand S11 on the grid circle 315*f*** can be laid more smoothly, lightly and uniformly, so that the spiral structure and the peripheral wrapping structure of the obtained soft wear-resistant yarn are more uniform and the performance is better.

Compared with the wrapped-core yarn made by conventional core-spun composite spinning under the same technological parameters, a softness and a wear resistance of the soft and abrasion-resistant yarn spun in the embodiment 10 are improved by more than 20% and 30% respectively. In addition, a fineness (i.e., linear density) of a finest yarn of the soft wear-resistant yarn is 2.1 tex.

In the embodiment 10, the core yarn F1 is a viscose filament fiber with a single filament width of 80 μm, the wrapping yarn F2 is a nylon filament fiber with a fineness of 1.0 dtex, and the staple fiber strand S11 is a pure cotton fiber. A speed at which the front roller **16*f* outputs the staple fiber strand S11 is 9.48 m/min; a rotating speed of the ring bobbin 44*f* is 11,000 r/min, a twist is 80 T/10 cm; a total drafting multiple (that is, a drafting multiple of a ratio of the front roller rotational linear speed to the back roller rotational linear speed during stretching the staple fiber strand S11) is 57.40; a linear density of cortical cotton fiber (that is, a linear density of a roving after stretching) is 7.84 tex; a back zone drafting multiple (that is, a ratio of a rotational linear speed of the middle roller to a rotational linear speed of the back roller) is 1.25; a spacing between the wrapping yarn F2 and the core yarn F1 on the front roller 16*f* is 6.5 mm, and a spacing between the core yarn F1 and the staple fiber strand S11 on the front roller 16*f* is 5 mm; and the wrapping yarn F2 is fed at a position slightly to the right of a center of the staple fiber strand S11 (as shown in FIG. 36**). For comparison, under the condition that other parameters are unchanged, the wrapping yarn F2 and the core yarn F1 are first overlapped, and then are fed to a middle of the staple fiber strand S11 to overlap with the staple fiber strand S11, thereby forming a traditional wrapped-core yarn. Test is performed on the traditional wrapped-core yarn and the wrapped-core yarn obtained in the embodiment 10 and a corresponding test result shows that compared with the traditional wrapped-core yarn, a softness of the wrapped-core yarn obtained in the embodiment 10 is improved by 22%, and a wear resistance of the wrapped-core yarn obtained in the embodiment 10 is improved by 30.1%.

Embodiment 11

Compared with the embodiment 10, the differences are that in the embodiment 11, a single filament width of the core yarn F1 is 10 μm, a fineness of the wrapping yarn F2 is 0.3 dtex, the staple fiber strand S11 is a fine cashmere roving, a fineness of a wrapped-core yarn spun in the embodiment 11 is 2.1 tex, and the wrapped-core yarn spun has a good wear resistance and a smooth surface. For comparison, under the condition that other parameters are unchanged, the wrapping yarn F2 and the core yarn F1 are first overlapped, and then are fed to a middle of the staple fiber strand S11 to overlap with the staple fiber strand S11, thereby forming a traditional wrapped-core yarn. Test is performed on the traditional wrapped-core yarn and the wrapped-core yarn obtained in the embodiment 10 and a corresponding test result shows that the traditional wrapped-core yarn can't catch a few external staple fibers for yarn formation, and the traditional wrapped-core yarn is a twisted yarn in which the core yarn F1 and the wrapping yarn F2 are twisted into a tightly-knit structure, and a softness of the traditional wrapped-core yarn is significantly lower than that of the yarn obtained in the embodiment 10.

Embodiment 12

As illustrated in FIG. 26 through FIG. 30, the feeding unit further includes a front roller **16*e* disposed at an input end of the auxiliary core-wrapping unit 30. A spacing between the core yarn F1 and the staple fiber strand S11 on the front roller 16*e*** is 2-5 mm, and a setting principle of this spacing is basically the same as that in the embodiment 8, which is not repeated herein.

The auxiliary core-wrapping unit 30 also includes a negative pressure air flow guide assembly 36 disposed above the auxiliary core-wrapping assembly 31 and configured to provide a diffusion air flow for the staple fiber strand S11. With the cooperation of the auxiliary core-wrapping assembly 31 and the negative pressure air flow guide assembly 36, the staple fiber strand S11 is differentially dispersed and spread into a highly straight and fully dispersed single fiber paving belt. The differentially spread staple fiber strand S11 intersects and converges with the core yarn F1 at the wrapping area 34, and the core yarn F1 rotates to drive the differentially spread staple fiber strand S11 to wrap around an outer layer of the core yarn F1 under the yarn twisting, thereby forming a wrapped-core yarn S2. Compared with a traditional ring-spun wrapped-core yarn, the wrapped-core yarn S2 exhibits a stronger wrapping tightness (with an increase of over 20% compared to the traditional ring-spun wrapped-core yarn), a higher wrapping coverage (100% full coverage), a larger core yarn ratio (up to 70%), and superior quality.

Figure 26:
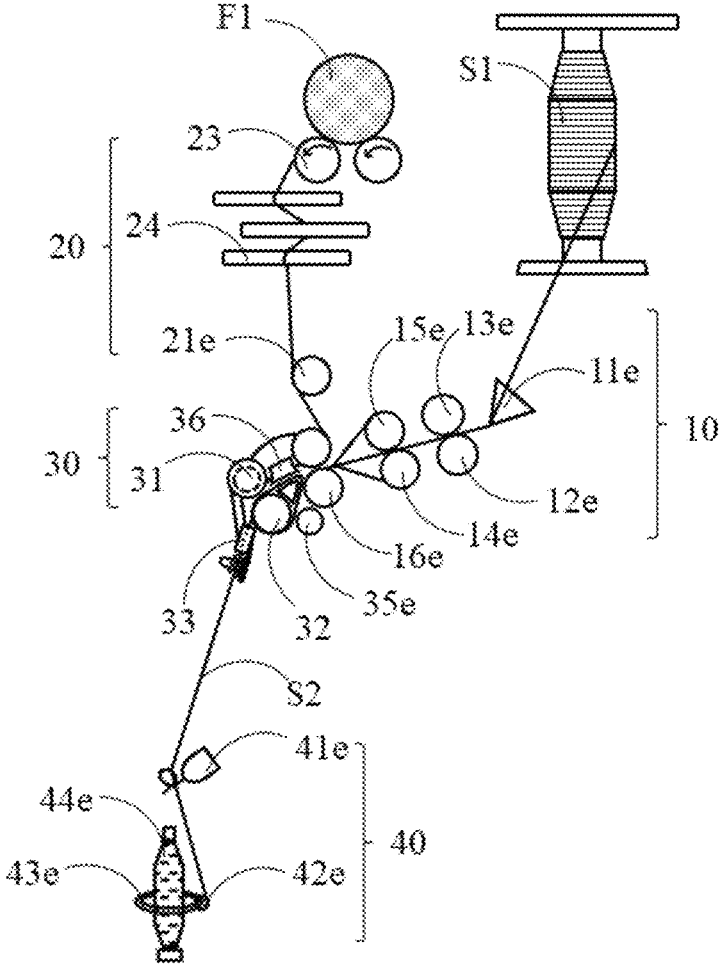
FIG. 26 illustrates a schematic structural diagram of a spinning device according to an embodiment 12.

As shown in FIG. 26, the staple fiber feeding unit 10 includes a bell mouth 11*e*, a rear roller 12*e*, a rear top roller 13*e*, a middle roller 14*e* and a middle top roller 15*e*, which are sequentially arranged along a feeding direction of the roving S1 in that order. The auxiliary core-wrapping assembly 31 includes a front top roller 321*e* disposed above the front roller 16*e*, and a spacing between the core yarn F1 and the staple fiber strand S11 is 2-5 mm in a front roller nip formed by the meshing of the front roller 16*e* and the front top roller 321*e*. The roving S1 is gradually formed into a staple fiber strand S11 under a stretching action of a spinning frame stretching system composed of the back roller 12*e*, the back top roller 13*e*, the middle roller 14*e*, the middle top roller 15*e*, the front roller 16*e*, and the front top roller 321*e*. The staple fiber strand S11 is output through the front roller nip formed by the meshing of the front roller 16*e* and the front top roller 321*e*, and is fed to the auxiliary core-wrapping unit 30. In this process, by controlling rotating speeds of the front roller 16*e*, the middle roller 14*e* and the rear roller 12*e*, an overall drafting multiple is adjusted so that the staple fiber strand S11 with a certain amount required by the process can be continuously and smoothly fed to the auxiliary core-wrapping unit 30.

The core yarn feeding unit 20 includes a core yarn unwinding unit 23, a tension adjusting frame 24 and a godet 21*e*, which are sequentially arranged along an advancing direction of the core yarn F1 in that order.

Specifically, the core yarn unwinding unit 23 includes a pair of unwinding rollers that rotate in a same direction, and the pair of unwinding rollers are engaged with a winding roller for winding the core yarn F1. In this way, the core yarn F1 is actively unwound by the rotation of the unwinding roller. The tension adjusting frame 23 includes tension adjusting rods arranged in parallel. In this process, first, the core yarn unwinding unit 23 actively unwound the core yarn F1 from the winding roller, then, a tension of the core yarn F1 is stabilized under the adjustment of the tension adjusting frame 24 and the core yarn F1 is continuously conveyed to the godet 21*e*, and finally, under the guidance of the godet 21*e*, the core yarn F1 is fed to the front roller nip formed by the meshing of the front roller 16*e* and the front top roller 321.

In some embodiments, the core yarn feeding unit 20 adopts an existing spandex yarn positive feeding mechanism of elastic wrapped-core yarn.

Figure 27:
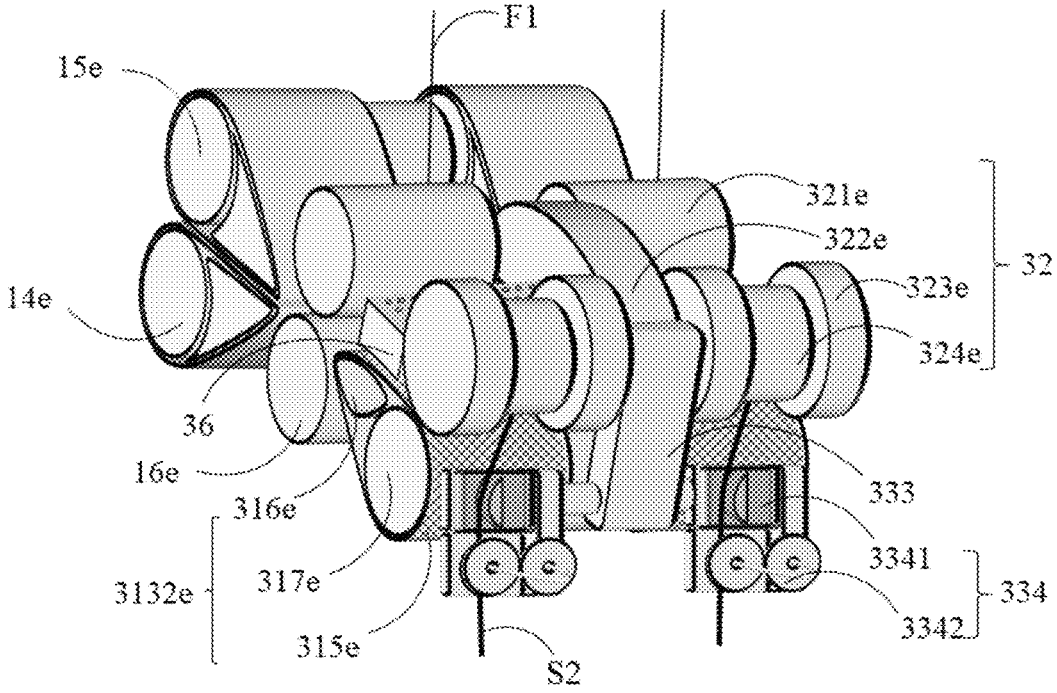
FIG. 27 illustrates a connection relationship diagram of a negative pressure adsorption assembly, an auxiliary conveying component and a negative pressure airflow guide assembly in FIG. 26.

As shown in FIG. 26 and FIG. 27, the auxiliary core-wrapping assembly 31 is a negative pressure absorption assembly 3132*e*. The negative pressure absorption assembly 3132*e* includes a special shaped air suction plate 316*e*, a drive roller 317*e* and a grid circle 315*e* sleeved on outer surfaces of the special shaped air suction plate 316*e* and the drive roller 317*e*. In order to make the grid circle 315*e* tense, the negative pressure absorption assembly 3132*e* also includes a tensioning mechanism (not shown), and the grid circle 315*e* is sleeved on outer surfaces of the special shaped air suction plate 316*e*, the drive roller 317*e* and the tensioning mechanism. The special shaped air suction plate 316*e* has a hollow structure inside. The special shaped air suction plate 316*e* is provided with a negative pressure suction port 3133*e* with a width greater than or equal to that of the staple fiber strand S11, and an air suction assembly is arranged at the negative pressure suction port 3133*e*. The air around the negative pressure suction port 3133*e* is gathered towards negative pressure suction port 3133*e* under the action of the air suction assembly. The grid circle 315*e* only allows airflow to pass therethrough, and plays a role in supporting and transporting the staple fiber strand S11. In this process, the staple fiber strand S11 output through the front roller nip is conveyed to the grid circle 315*e* and passes through the negative pressure suction port 3133*e*. Because the width of the negative pressure suction port 3133*e* is greater than or equal to the width of the staple fiber strand S11, the staple fiber strand S11 with a certain width and fiber parallelism is widened and spread evenly on the grid circle 315*e* to prevent the differential fiber of the staple fiber strand S11 from shaking and reunion. In addition, the negative pressure suction port 3133*e* can also capture uncontrolled floating fibers in the staple fiber strand S11.

The shape setting principle of the negative pressure suction port 3133*e* is the same as that of negative pressure suction port 3133*f* of the embodiment 8.

Figure 28:
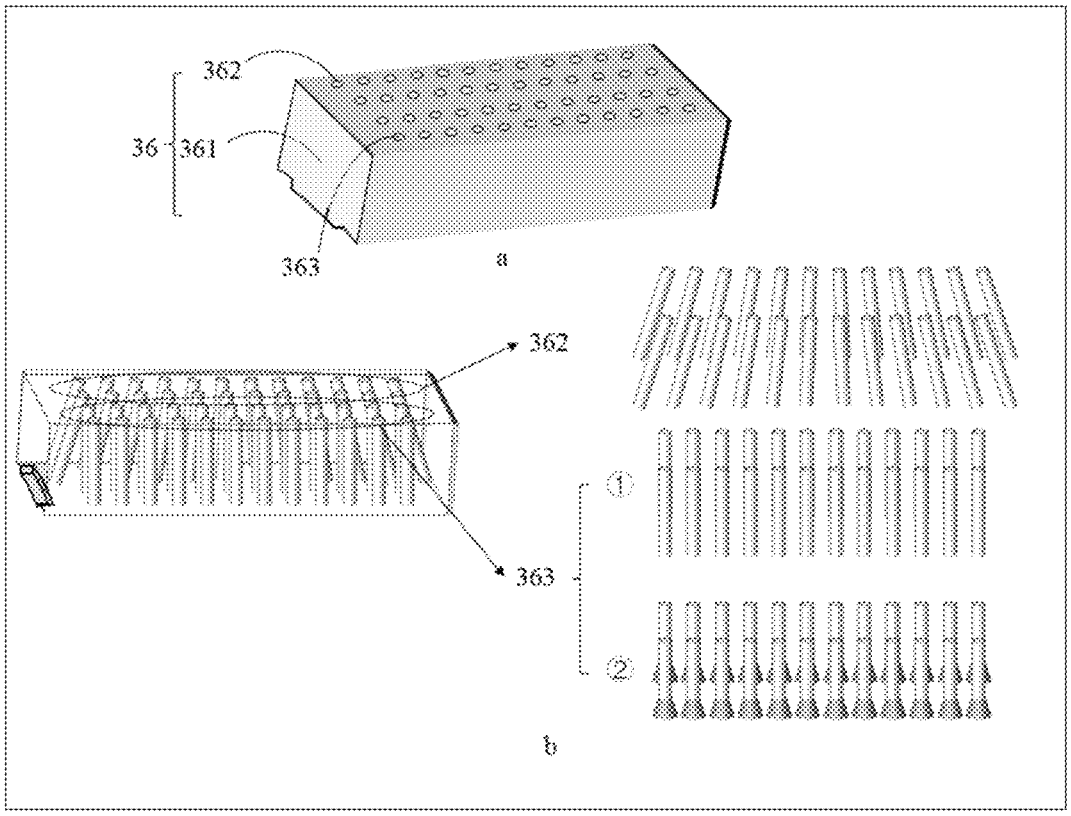
FIG. 28 illustrates a schematic structural diagram of the negative pressure air flow guide assembly.
Figure 29:
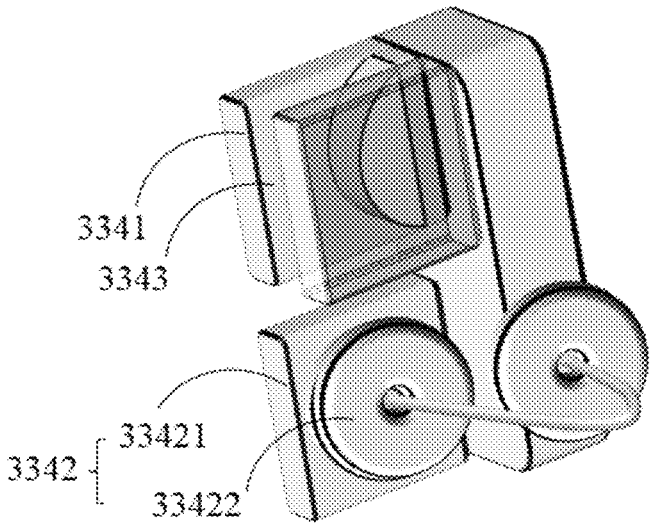
FIG. 29 illustrates a schematic structural diagram of a compliant reinforcement component.

The negative pressure air flow guide assembly 36 is disposed above the special shaped air suction plate 316*e*, and includes a diversion housing 361 and rows of diffusion guide holes 362 and 363 obliquely arranged on the diversion housing 361. A shape of the diversion housing 361 of the negative pressure air flow guide assembly 36 is consistent with that of the special shaped air suction plate 316*e* (that is, as shown in FIG. 28, aside of the diversion housing 361 close to the special shaped air suction plate 316*e* is curved), and an airflow pipeline is arranged on a side of the diversion housing 361 facing the special shaped air suction plate 316*e*. The boss is perpendicular to a running direction of the staple fiber strand S11, and a height of the boss is 1.0-3.0 mm. The thicker the staple fiber strand S11 used in spinning, the greater the height of the boss; or the thinner the staple fiber strand S11 used in spinning, the smaller the height of the boss. The negative pressure suction port 3133*e* on the special shaped air suction plate 316*e* corresponds to the diffusion guide holes 362, so that the airflow enters the negative pressure suction port 3133*e* through the diffusion guide holes 362. In this way, a negative pressure formed inside the special shaped air suction plate 316*e* makes the air surrounding the special shaped air suction plate 316*e* gather towards the special shaped air suction plate 316*e*, and at the same time, the negative pressure air flow guide assembly 36 makes the gathered air flow pass through the diffusion guide holes 362 to form a diffusion air flow, that is, after the air flow passes through the diffusion guide holes 362, the diffusion air flow will be formed between the special shaped air suction plate 316*e* and the diversion housing 361, so that the flexible fiber (i.e., the staple fiber strand S11 output through the front roller nip) passing between the special shaped air suction plate 316*e* and the diversion housing 361 is differentially widened to form a fiber flat strand of a certain width and then is adsorbed onto the grid circle 315*e*. Specifically, the air surrounding the negative pressure suction port 3133*e* and the negative pressure air flow guide assembly 36 forms a diffusion air flow under the action of the diffusion guide holes 362, and the diffusion air flow further opens and widens the staple fiber strand S11. With the cooperation of the diffusion guide holes 362 and the air suction assembly, on the one hand, the staple fiber strand S11 is stretched to both sides (in a width direction), and then is evenly spread on the grid circle 315*e*; on the other hand, the staple fiber strand S11 is also stretched by a stretching force in the conveying direction, so that each single fiber is straightened. Under the coordinated stretching forces in both the width and length directions, the staple fiber strand S11 opens and widens to the greatest extent, which will neither be over-stretched to create gaps nor will they be pulled apart. Finally, the staple fiber strand S11 will be spread evenly on the grid circle 315*e* with a certain width and fiber parallelism. At the same time, the airflow passing through the diffusion guide holes 362 can further firmly adsorb the slightly differentiated and dispersed staple fiber strand S11 on the grid circle 315*e*, so as to prevent the slightly differentiated and dispersed staple fiber strand S11 from accumulating and shaking, and the evenly spread staple fiber strand S11 are adsorbed on the grid circle 315*e* without rotating, and finally, the staple fiber strand S11 is wrapped by winding revolution twisting under the action of the stretched and self-rotating twisted core yarn F1, thus forming a winding wrapped-core yarn S2 with a special structure.

As shown in FIG. 28, there are two rows of diffusion guide holes 362 in this embodiment, and inclination angles of the diffusion guide holes in the same row gradually increase from the middle to two opposite sides, and the inclination angle is in a range from 0° to 60°. After the air flow around the negative pressure absorption assembly 3132*e* passes through the inclined diffusion guide holes 362, the air flow changes from a disordered state to a stable state to spread to the two sides, so as to widen and smooth the staple fiber strand S11 to the two sides.

The negative pressure air flow guide assembly 36 further includes rows of airflow stabilizing holes 363 vertically arranged on the diversion housing 361, and the diffusion guide holes 362 and the airflow stabilizing holes 363 are sequentially arranged along an advancing direction of the core yarn F1 and the staple fiber strand S11. The airflow stabilizing holes 363 are used to further attach the widened and flattened staple fiber strand S11 to the surface of the grid circle 315*e* under the action of a vertical airflow. As shown in FIG. 28, a diameter of each airflow stabilizing hole 363 remains constant from top to bottom, or a tail end along an airflow direction of the airflow stabilizing hole 363 is horn-shaped. When the tail end along an airflow direction of the airflow stabilizing hole 363 is horn-shaped, the horn shape at the tail end can obtain a wider range of stable airflow, so that the widened and smoothed staple fiber strand S11 can be more firmly attached to the surface of the grid circle 315*e*.

As shown in FIGS. 26 and 27, the pressurizing/conveying assembly 32 includes a transmission gear 35*e* and an auxiliary conveying component. Specifically, the front roller 16*e*, the transmission gear 35*e* and the drive roller 317*e* are engaged. The auxiliary conveying component includes a front top roller 321*e*, a drive top roller 323*e* and a bridge component 322*e* disposed between the front top roller 321*e* and the drive top roller 323*e*. A shaft core of the front top roller 321*e* and the bridge component 322*e* are connected with a shaft core of the drive top roller 323*e* (that is, the bridge component 322*e* connects the shaft cores of the front top roller 321*e* and the drive top roller 323*e* to make them integrated). The front top roller 321*e* and the front roller 16*e* are arranged up and down correspondingly, and the drive top roller 323*e* and the drive roller 317*e* are arranged up and down correspondingly. The drive roller 323*e* is in contact with the grid circle 315*e*. A rotation process of the grid circle 315*e* driven by the pressurizing/conveying assembly 32 is the same as that in the embodiment 8. Under the continuous transportation of the grid circle 315*e*, the staple fiber strand S11 and the core yarn F1 are finally transmitted to the core yarn F1 at the wrapping area 34 under the cooperative twisting action of the steel ring, the traveler and a spindle, so that the stretched core yarn F1 is twisted by rotation, which drives the differential dispersed staple fiber strand S11 to spread into a highly straight and fully dispersed flat ribbon-shaped single fiber, which is wrapped around an outer layer of the self-rotating twisted core yarn F1 in an orderly revolution one by one, and the staple fiber strand S11 is wrapped around the core yarn F1 to a wrapped-core yarn S2. The whole process adopts the principle of "differentiating first and then integrating".

In some embodiments, a roller groove 324*e* is provided in a middle of the drive top roller 323*e*. A width arrangement and an arrangement advantage of the roller groove 324*e* are the same as those of the roller groove 324*f* in the embodiment 8.

The diversion housing 361 is embedded below the bridge component 322*e* and connected with the shaft core of the front top roller 321*e*, so that there is a certain gap between the diversion housing 361 and the grid circle 315*e*, which is convenient for the staple fiber strand S11 and the core yarn F1 to pass therethrough.

Figure 30:
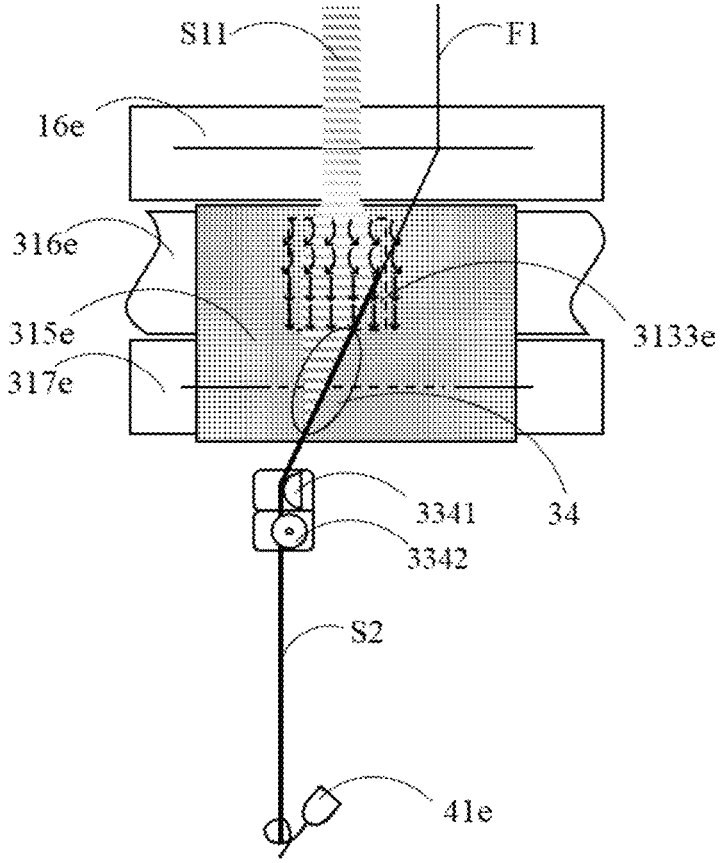
FIG. 30 illustrates a path diagram of forming a wrapped-core yarn through staple fiber strand and core yarn.

As shown in FIG. 30, the wrapped-core yarn S2 formed in the wrapping area 34 is in a straight line with the core yarn F1 fed into the grid circle 315*e*, and merges with the staple fiber strand S11 fed into the grid circle 315*e* to form a y-shape. The staple fiber strand S11 before entering the wrapping area 34 is in a straight state. In this way, since the wrapped-core yarn S2 from bottom to top is in a straight line with the core yarn F1 conveyed to the grid circle 315*e*, a twist formed by the rotation of airflow is transmitted to the wrapping area 34 from bottom to top, and then most of the twist is transmitted to the core yarn F1, so that a twist and a tension of the core yarn F1 are much greater than those of the staple fiber strand S11, making the core yarn F1 dominant in the twisting process and provides the core yarn F1 with enough rotation, and at the same time keeping the core yarn F1 in a straightened state. Further, the twist is difficult to be transmitted to the staple fiber strand S11 along an axial direction of the staple fiber strand S11. At the same time, the straightness, parallelism and expansion of staple fibers in the staple fiber strand S11 are further improved by the action of the negative pressure suction port 3133*e* and the negative pressure air flow guide assembly 36, so that the staple fiber strand S11 spreads on the grid circle 315*e*, the staple fibers in the staple fiber strand S11 only undergoes revolution and wrapping motion without self-rotation twisting under the drive of the core yarn F1, and the staple fiber strand S11 is uniformly and tightly wrapped around the core yarn F1 in a core-winding manner. In addition, the staple fiber strand S11 in the wrapping area 34 being tightly adsorbed on the grid circle 315*e* further hinders the twist transmission of the staple fiber strand S11, and ensures that the staple fiber strand S11 is tensioned and highly parallel and oriented in the untwisted state.

Before entering the wrapping area 34, the staple fiber strand S11 is in a straight line. Before entering the wrapping area 34, an extension line of the core yarn F1 input to the grid circle 315*e* is not in a straight line with the fed core yarn F1 from the core yarn feeding unit 20, so the core yarn F1 input to the grid circle 315*e* before entering the wrapping area 34 needs to be configured with a large tension. The principle and function of the above arrangement are the same as those in the embodiment 8.

A spacing between the wrapping area 34 and the nip of the front roller 16 is greater than a fiber length of the staple fiber strand S11. The principle and function of this setting are the same as in the embodiment 8.

The yarn guiding assembly 33 includes a connecting member 333 and a compliant reinforced component 334. The connecting member 333 is connected with the bridge component 322*e*, and the compliant reinforced component 334 is connected with the connecting member 333. The compliant reinforced component 334 includes a heating compliant block 3341 and a reinforcing block 3342 which are sequentially arranged along an advancing direction of the wrapped-core yarn S2 in that order.

Specifically, the heating compliant block 3341 is made of a heated ceramic block, which can be heated to a temperature of 130-220° C. when energized. The temperature can be adjusted to a corresponding glass transition temperature according to a material characteristic of the heated ceramic block. At a higher temperature, the staple fiber strand S11 at an outer layer of the preliminarily formed wrapped-core yarn S2 can be softened, and the staple fiber strand S11 can be further adhered to the core yarn F1 through the twisting rotation of the core yarn F1, thus improving the yarn quality. The middle part of the heating compliant block 3341 is provided with an arc groove 3343, which is convenient for clamping the wrapped-core yarn S2 and positioning the yarn forming path at the same time, thus playing a yarn forming guiding role and making the yarn forming process more stable.

The reinforcing block 3342 includes a fixing block 33421 and a tension adjusting plate 33422. The wrapped-core yarn S2 passes through between the fixing block 33421 and the tension adjusting plate 33422, and at the same time, the wrapped-core yarn S2 is in contact with the tension adjusting plate 33422 with a certain tension, so that fibers on a surface layer of the wrapped-core yarn S2 can be more closely attached to the core yarn F1 during twisting rotation by friction, thereby improving the smoothness of a yarn body and reducing a yarn hairiness. By increasing or decreasing the number of tension adjusting plates 33422, a friction force between tension adjusting plates 33422 and wrapped-core yarn S2 can be adjusted to adapt to different raw material characteristics. It can be seen that after the wrapped-core yarn S2 passes through the compliant reinforced component 334, the staple fiber coating of its outer layer is more closely attached to the outer layer of the core yarn F1 under the action of higher temperature and pressure.

As shown in FIG. 27 and FIG. 30, the compliant reinforced component 334 is disposed on an axial left side of the spinning device, so that when the core yarn F1 converges with the staple fiber strand S11 in the wrapping area 34 to form yarn, the whole structure further forms a y-shaped structure.

the yarn winding unit 40 includes a guide hook 41*e*, a traveler 42*e*, a steel ring 43*e* and a ring bobbin 44*e*. The wrapped-core yarn S2 enters a balloon twisting section through the guide hook 41*e*, and fibers in the outer layer of the wrapped-core yarn S2 are further twisted and tightly held, and finally wound on the ring bobbin 44*e* through the rotation of the traveler 42*e* on the steel ring 43*e*.

A spinning method is provided, which is implemented by the spinning device in the embodiment 12. The method specifically includes steps S1' to S3'.

In step S1', the roving S1 is stretched into the staple fiber strand S11 by the staple fiber feeding unit 10 and fed to the auxiliary core-wrapping unit 30, and the core yarn F1 is fed to the auxiliary core-wrapping unit 30 through the core-covering unit 20.

In step S2', the core yarn F1 and the staple fiber strand S11 are fed into the front roller nip formed by the meshing of the front roller 16*e* and the front top roller 321*e*, the core yarn F1 and the staple fiber strand S11 are separated with a spacing of 2-5 mm, and then the core yarn F1 and the staple fiber strand S11 are output to the grid circle 315*e* through the front roller nip at a speed required by the process. With the cooperation of the air suction assembly and the negative pressure air flow guide assembly 36, the staple fiber strand S11 is evenly spread on the grid circle 315*e* with a certain width and fiber parallelism. The rotation of the core yarn F1 drives the staple fiber strand S11 to wrap around an outer layer of the core yarn F1 in turn at the wrapping area 34 to form a wrapped-core yarn S2.

In step S3', the wrapped-core yarn S2 passes through the yarn guiding assembly 33, the staple fiber strand of the wrapped-core yarn S2 is more tightly attached to the outer layer of the core yarn F1 under the high temperature environment and pressure friction, and then the wrapped-core yarn S2 is transmitted to the yarn winding unit 40 for twisting and winding.

The spinning device and the spinning method are used to carry out lossless spinning processing on inorganic fiber materials, and the spinning processing of fiber materials can achieve a core yarn ratio up to 70% and a higher yarn quality. The prepared wrapped-core yarn S2 can be applied to clothes, fire blankets and ropes in the field of firefighting; casual clothes, sportswear, curtains and bed sheets in the field of clothing and home; tents, clothing, shoes and boots in the military field; and automobile interior fabrics, aerospace seat covers, high-speed rail seat covers, aviation insulation blankets in the field of transportation. For example, when the staple fiber strand S11 is a PI fiber and the core yarn F1 is an inorganic basalt filament, the prepared wrapped-core yarn S2 can be applied to clothes, ropes and other equipment in the firefighting field; when the staple fiber strand S11 is a cotton fiber and the core yarn F1 is a polyester filament, the prepared wrapped-core yarn S2 can be applied to products such as casual wear, sportswear, bed sheets and the like in the field of clothing and home.

Technological parameters of the spinning process in the embodiment 12 are specifically as follows: the core yarn F1 is a twisted yarn formed by compounding a basalt filament with a linear density of 12 tex and a flame-retardant nylon filament with a fiber fineness of 20 D, and the roving S1 is a flame-retardant fiber blended roving with a linear density of 520 tex; a speed at which the front roller 16*e* outputs the staple fiber strand S11 and the core yarn F1 is 12.22 m/min; a rotating speed of the ring bobbin 44*e* is 11,000 r/min; a twist is 90 T/10 cm; a total drafting multiple (that is, a drafting multiple of the staple fiber strand S11 by the staple fiber feeding unit 10) is 62.58; a linear density of sheath flame retardant fiber blended roving (that is, that is, a linear density of a roving after stretching) is 8.31 tex; a back zone drafting multiple (that is, a ratio of a rotation speed of the middle roller 14*e* to a rotation speed of the back roller 12*e*) is 1.25; a spacing between the core yarn F1 and the staple fiber strand S11 on the front roller is 5 mm; a diameter of each airflow stabilizing hole remains constant from top to bottom; and the heating compliant block 3341 is started, a temperature of the heating compliant block 3341 is set to 180° C., and the core yarn F1 in the wrapped-core yarn S2 accounts for 70% of the whole yarn.

Figure 31:
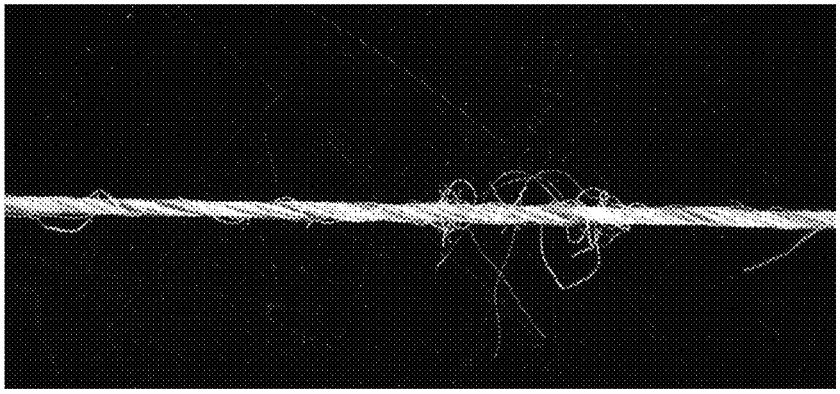
FIG. 31 illustrates an image of wrapped-core yarn spun in the embodiment 12 under 35 times magnification using a 3D microscope with a scale of 500 μm.

FIG. 31 illustrates an image of wrapped-core yarn spun in the embodiment 12 under 35 times magnification using a 3D microscope. As can be seen from FIG. 31, in the obtained wrapped-core yarn, the core yarn material is completely covered by the outer flame-retardant fiber, and the overall yarn covering effect is good, without filament exposure, and the overall yarn covering effect is good. In addition, at the same time, the parallelism of the outer coated fiber is higher, and the surface forms a better yarn appearance.

Embodiment 13

Compared with the embodiment 12, the difference is that in the embodiment 13, a tail end along an airflow direction of the airflow stabilizing hole 363 is horn-shaped, and the others are basically the same as those of the embodiment 12, so the details are not repeated here. The core yarn F1 in the wrapped-core yarn S2 accounts for 70% of the total yarn.

Figure 32:
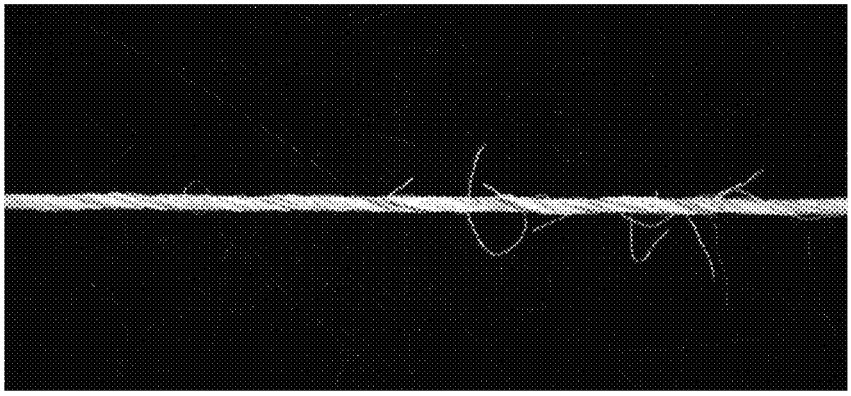
FIG. 32 illustrates an image of a wrapped-core yarn spun in the embodiment 13 under 35 times magnification using a 3D microscope with a scale of 500 μm.

FIG. 32 illustrates an image of wrapped-core yarn spun in the embodiment 13 under 35 times magnification using a 3D microscope. As can be seen from FIG. 32, the wrapped-core yarn obtained in the embodiment 13 has a neater appearance and less hairiness compared with the embodiment 12, which shows that when the tail end along an airflow direction of the airflow stabilizing hole 363 is horn-shaped, the core yarn is more covered by the outer fiber.

Comparative Example 9

In the comparative example 9, a traditional ring spinning core-spun device is used for wrapped-core yarn, and the auxiliary core-wrapping unit 30 is not provided. The other parameters are basically the same as those in the embodiment 12, so they will not be described here. The core yarn F1 in the wrapped-core yarn S2 accounts for 72% of the total yarn (during the spinning process, some staple fibers are sucked away by the negative pressure suction port to escape, thus increasing the proportion of filaments (i.e., the core yarn ratio) in the final yarn).

Figure 33:
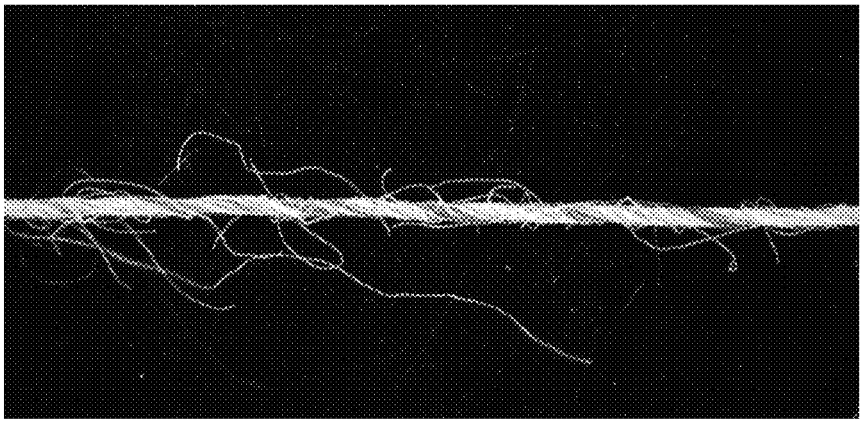
FIG. 33 illustrates an image of a wrapped-core yarn spun in a comparative example 9 under 35 times magnification using a 3D microscope with a scale of 500 μm.

FIG. 33 illustrates an image of a wrapped-core yarn spun in the comparative example 9 under 35 times magnification using a 3D microscope. As can be seen from FIG. 33, in the wrapped-core yarn obtained in the comparative example 9, there is obvious "yarn leakage" phenomenon, basalt is exposed, and the yarn has more apparent hairiness.

Comparative Example 10

Compared with the embodiment 12, the difference is that in the comparative example 10, the negative pressure airflow guide assembly 36 is not provided, and the other parts are basically the same as the embodiment 12, so they will not be described herein. The core yarn F1 in the wrapped-core yarn S2 accounts for 70% of the total yarn.

Figure 34:
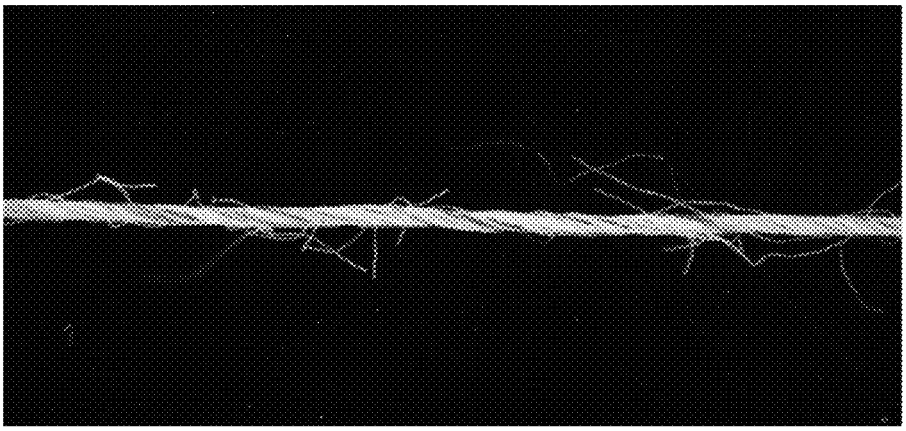
FIG. 34 illustrates an image of a wrapped-core yarn spun in a comparative example 10 under 35 times magnification using a 3D microscope with a scale of 500 μm.

FIG. 34 illustrates an image of a wrapped-core yarn spun in a comparative example 10 under 35 times magnification using a 3D microscope. As can be seen from FIG. 34, there is no core leakage in the yarn obtained in the comparative example 10, but the overall covering effect is slightly worse than that in the embodiment 12.

Comparative Example 11

Through the adjustment of the yarn guiding assembly 33, the wrapped-core yarn S2 formed in the wrapping area 34 is not in a straight line with the core yarn F1 conveyed to the grid circle 315*e*, thus destroying the y-shaped structure. The other parameters are basically the same as those in the embodiment 12, and will not be described herein.

Figure 35:
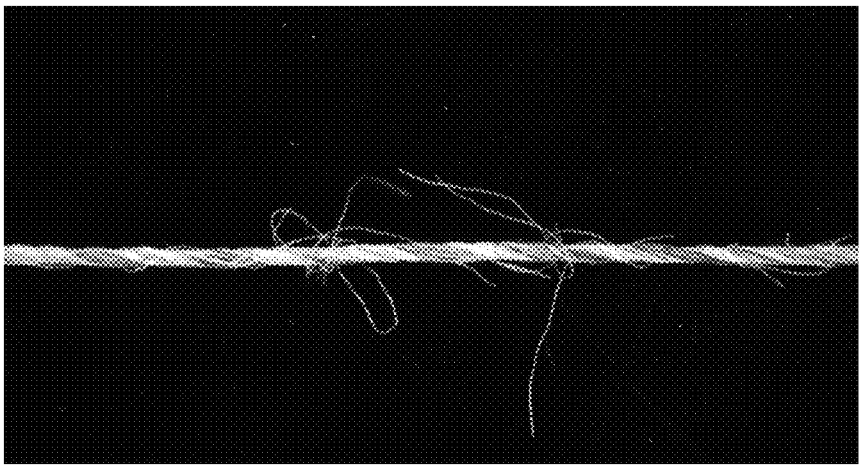
FIG. 35 illustrates an image of a wrapped-core spun in a comparative example 11 under 35 times magnification using a 3D microscope with a scale of 500 μm.

FIG. 35 illustrates an image of a wrapped-core yarn spun in the comparative example 11 under 35 times magnification using a 3D microscope. As can be seen from FIG. 35, in the wrapped-core yarn spun obtained in the comparative example 11, because the y-shaped structure was not formed during yarn formation, the overall yarn formation structure was similar to the form of a strand, the core yarn and the staple fiber strand are intertwined, and the core yarn was exposed on the surface of the yarn body, resulting in serious yarn leakage.

The wrapped-core yarns obtained in the embodiments 12-13 and the comparative examples 9-11 are tested for yarn basic indexes, and the obtained data are averaged for data comparison. The specific results are as follows.

TABLE 3

Tensile fracture properties of wrapped-core yarns

| Example | Breaking strength (CN) | Elongation at break (%) |
|---|---|---|
| Embodiment 12 | 1441.66 | 6.71 |
| Embodiment 13 | 1590.22 | 5.63 |
| Comparative example 9 | 933.91 | 13.35 |
| Comparative example 10 | 1398.79 | 6.24 |
| Comparative example 11 | 1075.21 | 10.57 |

It can be seen from Table 3 that the breaking strengths of the wrapped-core yarns spun in the embodiments 12 and 13 are obviously higher than those of the wrapped-core yarns spun in the comparative examples 9 and 11. This is mainly because, in the wrapped-core yarns with basalt core yarn spun coated by flame-retardant fiber in the embodiments 12 and 13, the rigid basalt core yarn is in a straight state in the yarn body, with higher breaking strength and lower elongation at break; however, in the wrapped-core yarns with basalt core yarn coated by flame-retardant fiber spun by the traditional ring spinning core-spun method in the comparative example 9, the basalt core yarn is spirally distributed, and the rigid basalt core yarn is easier to break under the shear force during stretching, so the breaking strength thereof is lower. The wrapped-core yarn in the comparative example 11 is similar to a stranded yarn. During the stretching process, the wrapped-core yarn and the staple fiber strand are jointly stressed, and the core yarn and the staple fiber strand are twisted together, so the breaking strength is reduced.

TABLE 4

| Number of yarn hairiness of wrapped-core yarn | | | | | | | | |
|---|---|---|---|---|---|---|---|---|
| Example | 1 mm | 2 mm | 3 mm | 4 mm | 5 mm | 6 mm | 8 mm | 10 mm |
| Embodiment 12 | 427.90 | 36.20 | 6.30 | 3.90 | 0.80 | 0.10 | 0.00 | 0.00 |
| Embodiment 13 | 552.00 | 51.20 | 7.80 | 1.50 | 0.50 | 0.10 | 0.00 | 0.00 |
| Comparative example 9 | 1073.31 | 149.40 | 24.00 | 5.15 | 1.15 | 0.30 | 0.20 | 0.35 |
| Comparative example 10 | 597.85 | 67.35 | 8.75 | 3.75 | 0.90 | 0.10 | 0.00 | 0.00 |
| Comparative example 11 | 859.37 | 97.83 | 19.65 | 4.10 | 1.10 | 0.30 | 0.20 | 0.10 |

As can be seen from Table 4, the hairiness of the wrapped-core yarns spun in the embodiments 12 and 13 is greatly improved compared with the wrapped-core yarns spun in the comparative example 9. The hairiness with a length of 3 mm of the wrapped-core yarns with basalt core yarn coated by flame-retardant fiber spun in the embodiments 12 and 13 is basically eliminated, and the number of short hairiness with a length of 1 mm is also reduced by about 50% compared with that of the comparative example 9.

TABLE 5

| yarn evenness of wrapped-core yarn | | | | | |
|---|---|---|---|---|---|
| Example | Uneven rate U (%) | Coefficient of variation CV (%) | Fine end (−50%) | Slub (+50%) | Nep (+200%) |
| Embodiment 12 | 7.18 | 9.44 | five | five | 0 |
| Embodiment 13 | 6.77 | 8.68 | 0 | five | 0 |
| Comparative example 9 | 11.34 | 14.80 | 55 | 95 | 60 |
| Comparative example 10 | 8.04 | 10.28 | 0 | five | five |
| Comparative example 11 | 10.57 | 12.67 | 35 | 50 | 15 |

As can be seen from Table 5, the yarn evenness of the wrapped-core yarns spun in the embodiments 12 and 13 is better than that of the wrapped-core yarn in the comparative example 11. The fine end ((−50%), the slub (+50%) and the nep (+200%) of the wrapped-core yarns with basalt core yarn coated by flame-retardant fiber spun in the embodiments 12 and 13 are basically eliminated, while the wrapped-core yarn of the wrapped-core yarn with basalt core yarn coated by flame-retardant fiber spun in the comparative example 9 has more yarn defects in the fine end ((−50%), the slub (+50%) and the nep (+200%).

To sum up, the disclosure provides a spinning device and method. The spinning device is provided with an auxiliary core-wrapping unit with a special structure, so that a staple fiber strand forms staple fiber strands with a certain width and a uniform structure in the auxiliary core-wrapping assembly. By cooperating with a feeding unit, other components of the auxiliary core-wrapping unit and a yarn winding unit, the auxiliary core-wrapping assembly realizes the tight integral wrapping of the staple fiber strands on a core yarn, so as to obtain a wrapped-core yarn with a good covering effect and a relatively larger core yarn ratio, which maximizes the utilization of the staple fiber and reduces the raw material cost of the wrapped-core yarn; and solves the problem that the core yarn is easily exposed on a ring spinning machine, and the core yarn ratio is lower.

The above embodiments are only used to illustrate the technical solutions of the disclosure, but not to limit it. Although the disclosure has been described in detail with reference to the preferred embodiments, it should be understood by those skilled in the art that the technical solutions of the disclosure can be modified or replaced by equivalents without departing from the spirit and scope of the technical solutions of the disclosure.

What is claimed is:

1. A spinning device, the spinning device comprising a feeding unit, an auxiliary core-wrapping unit and a yarn winding unit;

wherein the feeding unit comprises:

a staple fiber feeding unit, configured to stretch a roving into differential dispersed staple fiber strands and feed the staple fiber strands into the auxiliary core-wrapping unit;

a core yarn feeding unit, configured to feed a core yarn into the auxiliary core-wrapping unit; and a front roller disposed at an input end of the auxiliary core-wrapping unit;

wherein the auxiliary core-wrapping unit comprises:

an auxiliary core-wrapping assembly;

a pressurizing/conveying assembly, configured to provide pressure or power to the auxiliary core-wrapping assembly;

a yarn guiding assembly, disposed between the auxiliary core-wrapping assembly and the yarn winding unit; and a wrapping area for wrapping and converging; and wherein the auxiliary core-wrapping unit is configured to make the staple fiber strands intersect and converge with the core yarn at the wrapping area and make the staple fiber strands integrally wrap the core yarn to form a wrapped-core yarn; and is configured to convey the wrapped-core yarn to the yarn winding unit for twisting and winding;

wherein the auxiliary core-wrapping assembly is internally provided with a staple fiber channel and a filament channel, the filament channel is separated from the staple fiber channel by a target spacing, a width of the staple fiber channel is 5-10 mm, the target spacing between the staple fiber channel and the filament channel is 2-5 mm, a width of the filament channel is 3-5 mm, the staple fiber channel is a channel with a same width along a conveying direction of the staple fiber strands, or a channel with a shape of gradually widening along the conveying direction of the staple fiber strands; and when the staple fiber channel is the channel with the shape of gradually widening, a width of a narrower channel portion of the staple fiber channel is 5-7 mm;

wherein the auxiliary core-wrapping assembly is internally provided with a negative pressure air suction assembly, a surface facing towards the negative pressure air suction assembly of the staple fiber channel is provided with uniform grid holes, and the negative pressure air suction assembly is configured to adsorb the staple fiber strands in the staple fiber channel through the uniform grid holes; and wherein the pressurizing/conveying assembly comprises a front top roller and a bridge component connecting the front top roller and the auxiliary core-wrapping assembly, the front top roller and the front roller are oppositely arranged, a nip is defined between the front top roller and the front roller and is configured to output the staple fiber strands and the core yarn to the auxiliary core-wrapping assembly, and the bridge component is configured to exert pressure on the auxiliary core-wrapping assembly to make an inner side of the auxiliary core-wrapping assembly attach to a surface of the front roller.

2. The spinning device as claimed in claim 1, wherein the core yarn feeding unit is provided with an electrostatic fiber opening assembly and a threaded guide rod, the electrostatic fiber opening assembly is configured to electrostatically open the core yarn to form a ribbon-like fiber, the threaded guide rod is configured to input the ribbon-like fiber into the auxiliary core-wrapping unit, and the ribbon-like fiber is partially or completely overlapped with the staple fiber strands in the auxiliary core-wrapping unit;

wherein the auxiliary core-wrapping assembly is a negative pressure adsorption assembly, the negative pressure adsorption assembly comprises an air suction plate, a drive roller, an annular grid sleeved on outer surfaces of the air suction plate and the drive roller, and an air suction assembly disposed in the air suction plate, and the air suction assembly is configured to adsorb the staple fiber strands and the ribbon-like fiber on a surface of the annular grid under negative pressure;

wherein the negative pressure adsorption assembly further comprises a negative pressure suction port disposed on a surface of the air suction plate, the negative pressure suction port is covered by the annular grid, a narrowest width of the negative pressure suction port is not less than a width of each of the staple fiber channel and the ribbon-like fiber, the negative pressure adsorption assembly is configured to adsorb the staple fiber strands and the ribbon-like fiber on the surface of the annular grid through the negative pressure suction port, to open the staple fiber strands and further expand the ribbon-like fiber, the negative pressure suction port is an air outlet with a same width along a conveying direction of the staple fiber strands and the ribbon-like fiber, or an air outlet with a shape of gradually widening along a conveying direction of the staple fiber strands and the ribbon-like fiber, and a narrowest width of the negative pressure suction port is 5-10 mm; and wherein the pressurizing/conveying assembly comprises a transmission gear and an auxiliary conveying component disposed opposite to the annular grid, the auxiliary conveying component comprises a front top roller, a drive top roller and a bridge component connecting the front top roller and the drive top roller, the front top roller is configured to drive the bridge component to synchronously rotate the drive top roller; and the drive top roller is configured to be in contact with the annular grid to drive the annular grid to rotate and transport forward.

3. The spinning device as claimed in claim 1, wherein the staple fiber feeding unit comprises a bell mouth, a rear roller, a rear top roller, a middle roller and a middle top roller;

wherein the core yarn feeding unit comprises a godet, the yarn guiding assembly comprises a yarn guiding rod and a heating groove disposed on the yarn guiding rod, and the yarn winding unit comprises a guide hook, a traveler, a steel ring and a ring bobbin.

4. The spinning device as claimed in claim 1, wherein the staple fiber feeding unit comprises a bell mouth, a rear roller, a rear top roller, a middle roller and a middle top roller;

wherein the core yarn feeding unit comprises a godet, the yarn guiding assembly comprises a connecting component connected with the pressurizing/conveying assembly and a compliant reinforcing component connected with the connecting component, and the compliant reinforcing component comprises a heating compliant block and a reinforcing block arranged along an advancing direction of the wrapped-core yarn; and wherein the yarn winding unit comprises a guide hook, a traveler, a steel ring and a ring bobbin.

5. The spinning device as claimed in claim 1, wherein the staple fiber feeding unit comprises a bell mouth, a rear roller, a rear top roller, a middle roller and a middle top roller;

wherein the core yarn feeding unit comprises a core yarn unwinding unit, a tension adjusting frame and a godet arranged along an advancing direction of the core yarn; the core yarn unwinding unit comprises a pair of unwinding rollers rotating in a same direction, and the unwinding rollers are meshed with a winding roller for winding the core yarn; and the tension adjusting frame comprises tension adjusting rods arranged in parallel; and wherein the yarn guiding assembly comprises a yarn guiding rod and a heating groove disposed on the yarn guiding rod, and the yarn winding unit comprises a guide hook, a traveler, a steel ring and a ring bobbin.

6. The spinning device as claimed in claim 1, wherein the staple fiber feeding unit comprises a bell mouth, a rear roller, a rear top roller, a middle roller and a middle top roller;

wherein the core yarn feeding unit comprises a core yarn unwinding unit, a tension adjusting frame and a godet arranged along an advancing direction of the core yarn; the core yarn unwinding unit comprises a pair of unwinding rollers rotating in a same direction, and the unwinding rollers are meshed with a winding roller for winding the core yarn; and the tension adjusting frame comprises tension adjusting rods arranged in parallel;

wherein the yarn guiding assembly comprises a connecting component connected with the pressurizing/conveying assembly and a compliant reinforcing component connected with the connecting component, and the compliant reinforcing component comprises a heating compliant block and a reinforcing block arranged along an advancing direction of the wrapped-core yarn; and wherein the yarn winding unit comprises a guide hook, a traveler, a steel ring and a ring bobbin.

7. A spinning device, the spinning device comprising a feeding unit, an auxiliary core-wrapping unit and a yarn winding unit;

wherein the feeding unit comprises:

a staple fiber feeding unit, configured to stretch a roving into differential dispersed staple fiber strands and feed the staple fiber strands into the auxiliary core-wrapping unit;

a core yarn feeding unit, configured to feed a core yarn into the auxiliary core-wrapping unit; and a front roller, disposed at an input end of the auxiliary core-wrapping unit;

wherein the auxiliary core-wrapping unit comprises:

an auxiliary core-wrapping assembly;

a pressurizing/conveying assembly, configured to provide pressure or power to the auxiliary core-wrapping assembly;

a yarn guiding assembly, disposed between the auxiliary core-wrapping assembly and the yarn winding unit; and a wrapping area for wrapping and converging; and wherein the auxiliary core-wrapping unit is configured to make the staple fiber strands intersect and converge with the core yarn at the wrapping area and make the staple fiber strands integrally wrap the core yarn to form a wrapped-core yarn; and is configured to convey the wrapped-core yarn to the yarn winding unit for twisting and winding; and wherein the auxiliary core-wrapping assembly comprises:

a pipe, an annular grid covered on a surface of the pipe, and negative pressure suction ports disposed on the pipe, the annular grid is configured to only allow airflow to pass therethrough, and is configured to widen and spread the staple fiber strands to form a differential dispersed widened strand, and the negative pressure suction ports are covered by the annular grid arranged on the surface of the pipe.

8. The spinning device as claimed in claim 7, wherein the pressurizing/conveying assembly comprises a front top roller, a drive top roller and a bridge component connecting the front top roller and the drive top roller, the front top roller is configured to drive the bridge component to synchronously rotate the drive top roller, the drive top roller is configured to be in contact with the annular grid to drive the annular grid to rotate and transport forward, a middle of the drive top roller is provided with a roller groove with a width, and the width of the roller groove is one third of a width of the drive top roller.

9. The spinning device as claimed in claim 8, wherein the negative pressure suction ports are one of the following three types: air ports uniformly distributed on the pipe, equal-width air ports formed along a curved surface of the pipe, or air ports disposed on the pipe and gradually widened along a conveying direction of the widened strands on the annular grid.

10. The spinning device as claimed in claim 9, wherein the yarn guiding assembly comprises a yarn guiding rod and a heating groove disposed on the yarn guiding rod.

11. The spinning device as claimed in claim 10, wherein a temperature of the heating groove is 100-200° C., the heating groove is configured to change a transmission path of a yarn output from the auxiliary core-wrapping unit, and the yarn guiding rod is configured to convey the yarn to the yarn winding unit.

12. The spinning device as claimed in claim 9, wherein the yarn guiding assembly comprises a connecting component connected with the pressurizing/conveying assembly and a compliant reinforcing component connected with the connecting component, and the compliant reinforcing component comprises a heating compliant block and a reinforcing block arranged along an advancing direction of the wrapped-core yarn.

13. The spinning device as claimed in claim 12, wherein the auxiliary core-wrapping assembly is internally provided with a staple fiber channel and a filament channel, the filament channel is separated from the staple fiber channel by a target spacing, a width of the staple fiber channel is 5-10 mm, the target spacing between the staple fiber channel and the filament channel is 2-5 mm, a width of the filament channel is 3-5 mm, the staple fiber channel is a channel with a same width along a conveying direction of the staple fiber strands, or a channel with a shape of gradually widening along the conveying direction of the staple fiber strands; and when the staple fiber channel is the channel with the shape of gradually widening, a width of a narrower channel portion of the staple fiber channel is 5-7 mm.

14. A spinning device, the spinning device comprising a feeding unit, an auxiliary core-wrapping unit and a yarn winding unit;

wherein the feeding unit comprises:

a staple fiber feeding unit, configured to stretch a roving into differential dispersed staple fiber strands and feed the staple fiber strands into the auxiliary core-wrapping unit;

a core yarn feeding unit, configured to feed a core yarn into the auxiliary core-wrapping unit; and a front roller disposed at an input end of the auxiliary core-wrapping unit;

wherein the auxiliary core-wrapping unit comprises:

an auxiliary core-wrapping assembly;

a pressurizing/conveying assembly, configured to provide pressure or power to the auxiliary core-wrapping assembly;

a yarn guiding assembly, disposed between the auxiliary core-wrapping assembly and the yarn winding unit; and a wrapping area for wrapping and converging; and wherein the auxiliary core-wrapping unit is configured to make the staple fiber strands intersect and converge with the core yarn at the wrapping area and make the staple fiber strands integrally wrap the core yarn to form a wrapped-core yarn; and is configured to convey the wrapped-core yarn to the yarn winding unit for twisting and winding;

wherein the auxiliary core-wrapping assembly is internally provided with a negative pressure air suction assembly and a staple fiber channel, a surface facing towards the negative pressure air suction assembly of the staple fiber channel is provided with uniform grid holes, and the negative pressure air suction assembly is configured to adsorb the staple fiber strands in the staple fiber channel through the uniform grid holes; and wherein the pressurizing/conveying assembly comprises a front top roller and a bridge component connecting the front top roller and the auxiliary core-wrapping assembly, the front top roller and the front roller are oppositely arranged, a nip is defined between the front top roller and the front roller and is configured to output the staple fiber strands and the core yarn to the auxiliary core-wrapping assembly, and the bridge component is configured to exert pressure on the auxiliary core-wrapping assembly to make an inner side of the auxiliary core-wrapping assembly attach to a surface of the front roller.

* * * * *